US010325609B2

(12) United States Patent
Moriya et al.

(10) Patent No.: US 10,325,609 B2
(45) Date of Patent: Jun. 18, 2019

(54) CODING AND DECODING A SOUND SIGNAL BY ADAPTING COEFFICIENTS TRANSFORMABLE TO LINEAR PREDICTIVE COEFFICIENTS AND/OR ADAPTING A CODE BOOK

(71) Applicants: NIPPON TELEGRAPH AND TELEPHONE CORPORATION, Chiyoda-ku (JP); The University of Tokyo, Bunkyo-ku (JP)

(72) Inventors: Takehiro Moriya, Atsugi (JP); Yutaka Kamamoto, Atsugi (JP); Noboru Harada, Atsugi (JP); Hirokazu Kameoka, Atsugi (JP); Ryosuke Sugiura, Bunkyo-ku (JP)

(73) Assignees: NIPPON TELEGRAPH AND TELEPHONE CORPORATION, Chiyoda-ku (JP); The University of Tokyo, Bunkyo-ku (JP)

( * ) Notice: Subject to any disclaimer, the term of this patent is extended or adjusted under 35 U.S.C. 154(b) by 0 days.

(21) Appl. No.: 15/562,689

(22) PCT Filed: Apr. 11, 2016

(86) PCT No.: PCT/JP2016/061682

§ 371 (c)(1),
(2) Date: Sep. 28, 2017

(87) PCT Pub. No.: WO2016/167215

PCT Pub. Date: Oct. 20, 2016

(65) Prior Publication Data

US 2018/0096694 A1 Apr. 5, 2018

(30) Foreign Application Priority Data

Apr. 13, 2015 (JP) ..... 2015-081746
Apr. 13, 2015 (JP) ..... 2015-081747

(51) Int. Cl.
*G10L 19/02* (2013.01)
*G10L 19/04* (2013.01)
(Continued)

(52) U.S. Cl.
CPC ..... *G10L 19/09* (2013.01); *G10L 19/06* (2013.01); *G10L 19/13* (2013.01); *G10L 19/26* (2013.01);
(Continued)

(58) Field of Classification Search
CPC ..... G10L 19/02; G10L 19/032; G10L 19/04; G10L 19/08; G10L 25/12; G10L 25/18
(Continued)

(56) References Cited

U.S. PATENT DOCUMENTS 5,999,899 A * 12/1999 Robinson ..... G10L 19/0208 704/219
8,938,387 B2 * 1/2015 Hedelin ..... G10L 19/035 704/219
(Continued)

FOREIGN PATENT DOCUMENTS

EP 3 226 243 A1 10/2017
JP 62-53028 A 3/1987
(Continued)

OTHER PUBLICATIONS

Extended European Search Report dated Jul. 26, 2018 in European Patent Application No. 16780006.9, 11 pages.
(Continued)

*Primary Examiner* — Martin Lerner
(74) *Attorney, Agent, or Firm* — Oblon, McClelland, Maier & Neustadt, L.L.P.

(57) ABSTRACT

A linear predictive coding apparatus is provided that performs linear predictive analysis using a pseudo correlation function signal sequence obtained by performing inverse
(Continued)

Fourier transform regarding the $\eta_1$-th power of the absolute values of the frequency domain sample sequence corresponding to the time-series signal as a power spectrum to obtain coefficients transformable to linear predictive coefficients. The apparatus further adapts values of $\eta$ for a plurality of candidates for coefficients transformable to linear predictive coefficients stored in a code book and the coefficients transformable to linear predictive coefficients are obtained by the linear predictive analysis. The apparatus further obtains a linear predictive coefficient code corresponding to the coefficients transformable to linear predictive coefficients obtained by the linear predictive analysis, using the plurality of candidates for coefficients transformable to linear predictive coefficients and the coefficients transformable to linear predictive coefficients for which the values of $\eta$ have been adapted.

29 Claims, 28 Drawing Sheets

(51) Int. Cl.

| | |
|---|---|
| ***G10L 25/12*** | (2013.01) |
| ***G10L 19/09*** | (2013.01) |
| ***G10L 19/26*** | (2013.01) |
| ***G10L 19/13*** | (2013.01) |
| ***G10L 19/06*** | (2013.01) |
| *G10L 19/07* | (2013.01) |
| *G10L 19/00* | (2013.01) |
| *G10L 19/038* | (2013.01) |

(52) U.S. Cl.
CPC ..... *G10L 19/038* (2013.01); *G10L 19/07* (2013.01); *G10L 2019/0007* (2013.01); *G10L 2019/0016* (2013.01)

(58) Field of Classification Search
USPC ..... 704/203, 205, 206, 219, 221, 500, 501
See application file for complete search history.

(56) References Cited

U.S. PATENT DOCUMENTS

| | | | | |
|---|---|---|---|---|
| 9,524,725 | B2 * | 12/2016 | Moriya | G10L 19/265 |
| 9,838,700 | B2 * | 12/2017 | Moriya | G10L 19/035 |
| 10,147,443 | B2 * | 12/2018 | Moriya | G10L 25/18 |
| 2013/0103408 | A1 * | 4/2013 | Philippe | G10L 19/06 704/500 |
| 2016/0232907 | A1 * | 8/2016 | Kovesi | G10L 19/04 |
| 2017/0249947 | A1 * | 8/2017 | Moriya | G10L 19/07 |
| 2017/0272766 | A1 | 9/2017 | Moriya et al. | |
| 2018/0047401 | A1 * | 2/2018 | Moriya | G10L 19/06 |
| 2018/0090155 | A1 * | 3/2018 | Moriya | G10L 25/18 |
| 2018/0268843 | A1 * | 9/2018 | Moriya | G10L 19/02 |

FOREIGN PATENT DOCUMENTS

| | | | | |
|---|---|---|---|---|
| JP | 3186013 | B2 | 7/2001 | |
| WO | WO 2007/105586 | A1 | 9/2007 | |
| WO | WO2014/054556 | * | 4/2014 | G10L 19/035 |

OTHER PUBLICATIONS

Hermansky, H. et al. "Analysis and Synthesis of Speech Based on Spectral Transform Linear Predictive Method", IEEE International Conference on Acoustics, Speech, and Signal Processing, XP055491687, vol. 8, Jan. 1983 pp. 777-780.

Sugiura, R. et al. "Optimal Coding of Generalized-Gaussian-Distributed Frequency Spectra for Low-Delay Audio Coder with Powered All-Pole Spectrum Estimation", IEEE/ACM Transactions on Audio, Speech, and Language Processing, XP011582768, vol. 23, No. 8, Aug. 2015, pp. 1309-1321.

International Search Report dated Jun. 14, 2016 in PCT/JP2016/061682 filed Apr. 11, 2016.

Takehiro Moriya, "Essential Technology for High-Compression Voice Encoding: Line Spectrum Pair (LSP)" NTT Technical Journal, vol. 26, No. 9, Sep. 2014, pp. 58-60 (with corresponding English version).

Japanese Office Action dated Dec. 18, 2018 in Patent Application No. 2017-512523 (with English translation), 9 pages.

Office Action dated Apr. 4, 2019 in European Application No. 16780006.9.

* cited by examiner

CODING AND DECODING A SOUND SIGNAL BY ADAPTING COEFFICIENTS TRANSFORMABLE TO LINEAR PREDICTIVE COEFFICIENTS AND/OR ADAPTING A CODE BOOK

TECHNICAL FIELD

The present invention relates to a technique for coding or decoding coefficients transformable to linear predictive coefficients.

BACKGROUND ART

As techniques for quantizing an LSP parameter, which is one of coefficients transformable to linear predictive coefficients, methods such as vector quantization are known (see, for example, Non-patent literature 1).

By the way, a parameter $\eta$ has been proposed by the inventor though it is not publicly known. This parameter $\eta$ is a shape parameter that defines probability distribution to which coding targets of arithmetic coding belong, in such a coding system for performing arithmetic coding of quantized values of coefficients in a frequency domain, utilizing a linear prediction envelope as is used in the 3GPP EVS (Enhanced Voice Services) standard. The parameter $\eta$ has relevance to distribution of the coding targets, and it is possible to perform efficient coding and decoding by appropriately setting the parameter $\eta$.

Further, the parameter $\eta$ can be an indicator indicating characteristics of a time-series signal. Therefore, when the parameter $\eta$ is appropriately used, it is possible to efficiently perform coding and decoding coefficients transformable to linear predictive coefficients such as LSP parameters.

PRIOR ART LITERATURE

Non-Patent Literature

Non-patent literature 1: Takehiro Moriya "Essential Technology for High-Compression Voice Coding: Line Spectrum Pair (LSP)", NTT Technical Journal, September 2014, pp. 58-60

SUMMARY OF THE INVENTION

Problems to be Solved by the Invention

However, a technique for coding and decoding coefficients transformable to linear predictive coefficients using the parameter $\eta$ has not been known.

An object of the present invention is to provide a linear predictive coding apparatus and a linear predictive decoding apparatus for coding or decoding coefficients transformable to linear predictive coefficients using the parameter $\eta$, methods, programs and a recording medium therefor.

Means to Solve the Problems

According to a linear predictive coding apparatus according to one aspect of the present invention, a parameter $\eta$ is a positive number; a parameter $\eta$ corresponding to a time-series signal is a shape parameter of generalized Gaussian distribution that approximates a histogram of a whitened spectral sequence, which is a sequence obtained by dividing a frequency domain sample sequence corresponding to the time-series signal by a spectral envelope estimated by regarding the $\eta$-th power of absolute values of the frequency domain sample sequence as a power spectrum; and $\eta_1$ is a predetermined value of the parameter $\eta$; and there are provided: a linear predictive analysis part performing linear predictive analysis using a pseudo correlation function signal sequence obtained by performing inverse Fourier transform regarding the $\eta_1$-th power of the absolute values of the frequency domain sample sequence corresponding to the time-series signal as a power spectrum to obtain coefficients transformable to linear predictive coefficients; a code book storing part storing N (N is an integer equal to or larger than 1) code books corresponding to N kinds of parameters $\eta$, respectively, each code book storing a plurality of candidates for coefficients transformable to linear predictive coefficients corresponding to each parameter $\eta$; an adaptation part adapting values of $\eta$ for the plurality of candidates for coefficients transformable to linear predictive coefficients stored in a code book stored in the code book storing part and the coefficients transformable to linear predictive coefficients obtained by the linear predictive analysis part; and a coding part obtaining a linear predictive coefficient code corresponding to the coefficients transformable to linear predictive coefficients obtained by the linear predictive analysis part, using the plurality of candidates for coefficients transformable to linear predictive coefficients and the coefficients transformable to linear predictive coefficients for which the values of $\eta$ have been adapted.

According to a linear predictive coding apparatus according to one aspect of the present invention, a parameter $\eta$ is a positive number; a parameter $\eta$ corresponding to a time-series signal is a shape parameter of generalized Gaussian distribution that approximates a histogram of a whitened spectral sequence, which is a sequence obtained by dividing a frequency domain sample sequence corresponding to the time-series signal by a spectral envelope estimated by regarding the $\eta$-th power of absolute values of the frequency domain sample sequence as a power spectrum; and $\eta_1$ is a predetermined value of the parameter $\eta$; and there are provided: a linear predictive analysis part performing linear predictive analysis using a pseudo correlation function signal sequence obtained by performing inverse Fourier transform regarding the $\eta_1$-th power of the absolute values of the frequency domain sample sequence corresponding to the time-series signal as a power spectrum to obtain coefficients transformable to linear predictive coefficients; a code book storing part storing a code book; an adaptation part adapting at least either of the code book stored in the code book storing part and the coefficients transformable to linear predictive coefficients on the basis of the $\eta_1$ inputted; and a coding part coding the coefficients transformable to linear predictive coefficients or the adapted coefficients transformable to linear predictive coefficients using the code book or the adapted code book.

According to a linear predictive decoding apparatus according to one aspect of the present invention, there are provided a code book storing part storing a code book; and an adaptation part adapting at least either of the code book stored in the code book storing part and a candidate for coefficients transformable to linear predictive coefficients corresponding to an inputted linear predictive coefficient code among a plurality of candidates for coefficients transformable to linear predictive coefficients stored in the code book, on the basis of inputted the $\eta_1$, $\eta_1$ being a positive number; wherein the coefficients transformable to linear predictive coefficients are used to obtain an unsmoothed spectral envelope sequence, which is a sequence obtained by raising a sequence of an amplitude spectral envelope corresponding to the coefficients transformable to linear predictive coefficients to the power of

Effects of the Invention

It is possible to code or decode coefficients transformable to linear predictive coefficients using the parameter $\eta$.

DETAILED DESCRIPTION OF THE EMBODIMENTS

[Linear Predictive Coding Apparatus, Linear Predictive Decoding Apparatus and Methods Therefor]

An example of a coding apparatus, a decoding apparatus and methods therefor, for which a linear predicting coding apparatus, a linear predictive decoding apparatus and methods therefor are used, will be described below.

First Embodiment of Linear Predictive Coding Apparatus, Linear Predictive Decoding Apparatus and Methods Therefor (Coding)

An example of a linear predictive coding apparatus and method of a first embodiment will be described.

Figure 1:
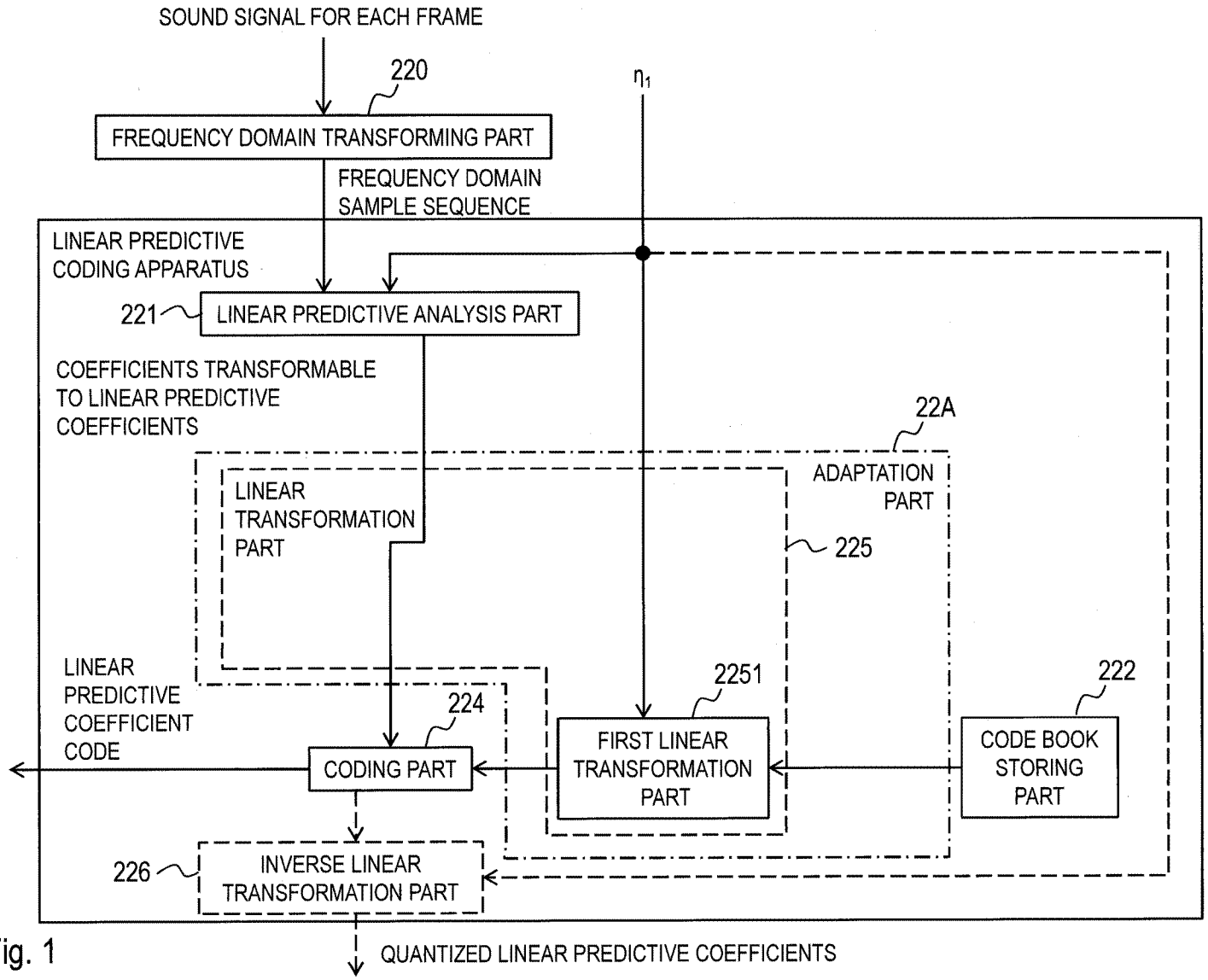
FIG. 1 is a block diagram for illustrating an example of a linear predictive coding apparatus.
Figure 2:
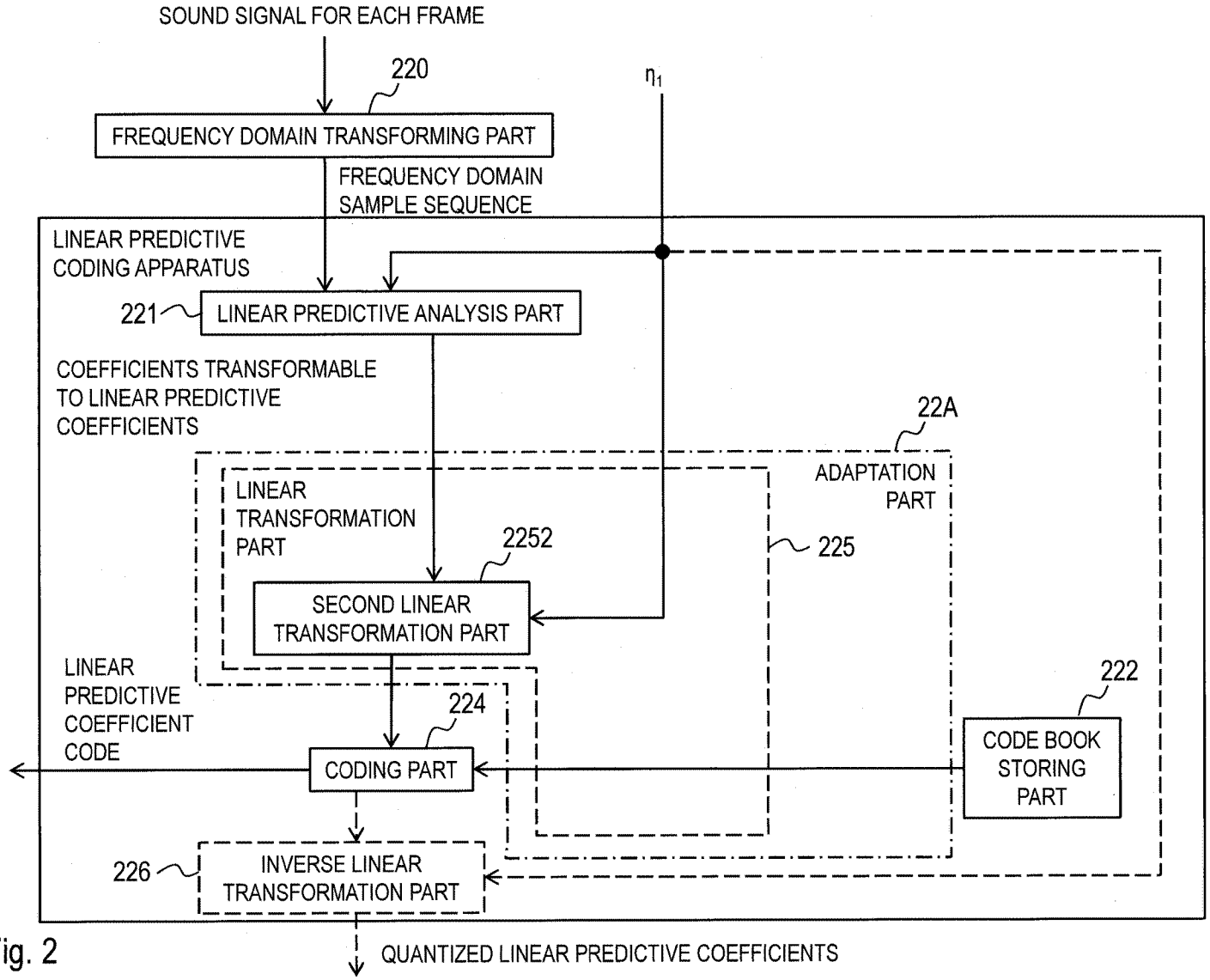
FIG. 2 is a block diagram for illustrating an example of the linear predictive coding apparatus.
Figure 3:
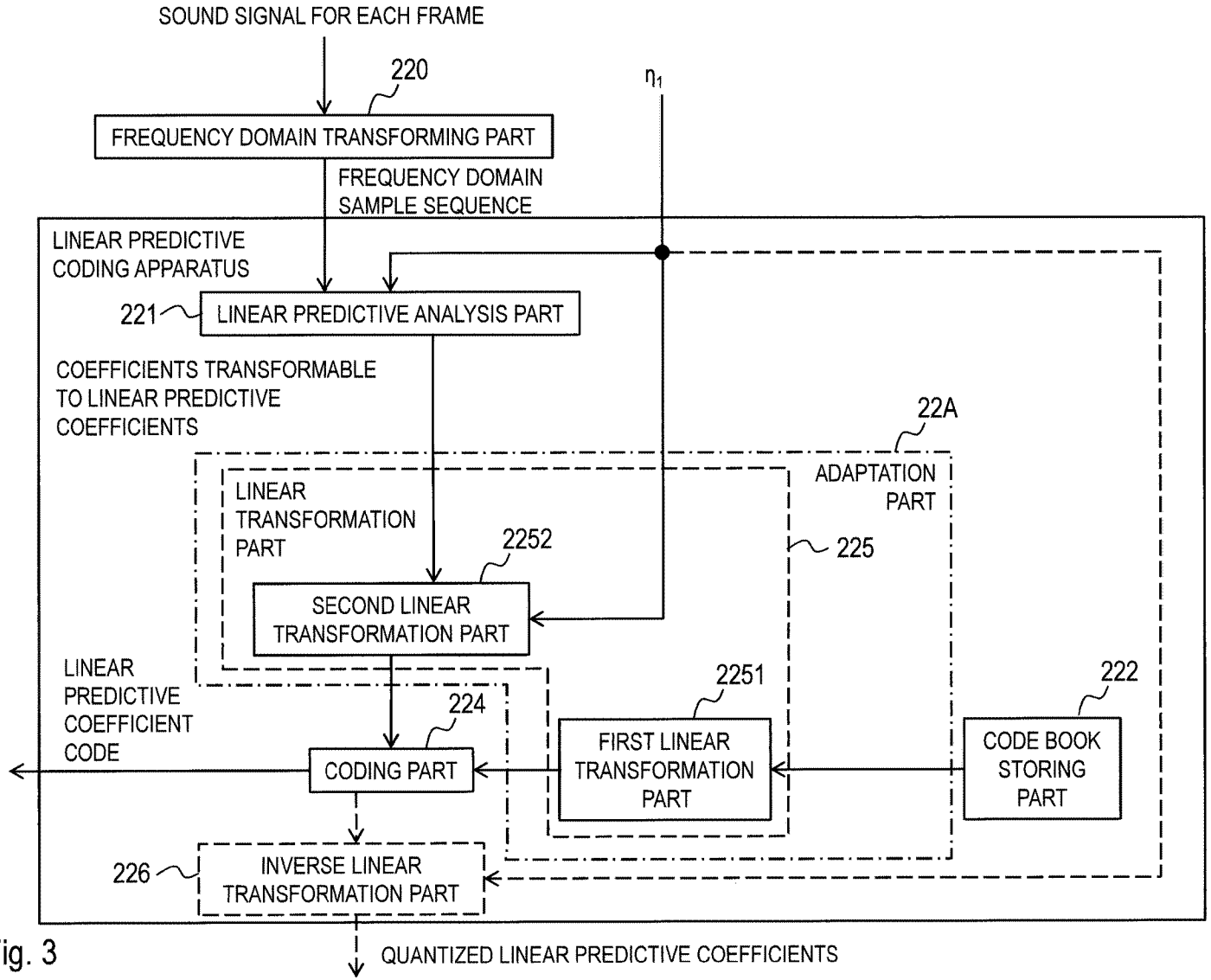
FIG. 3 is a block diagram for illustrating an example of the linear predictive coding apparatus.
Figure 4:
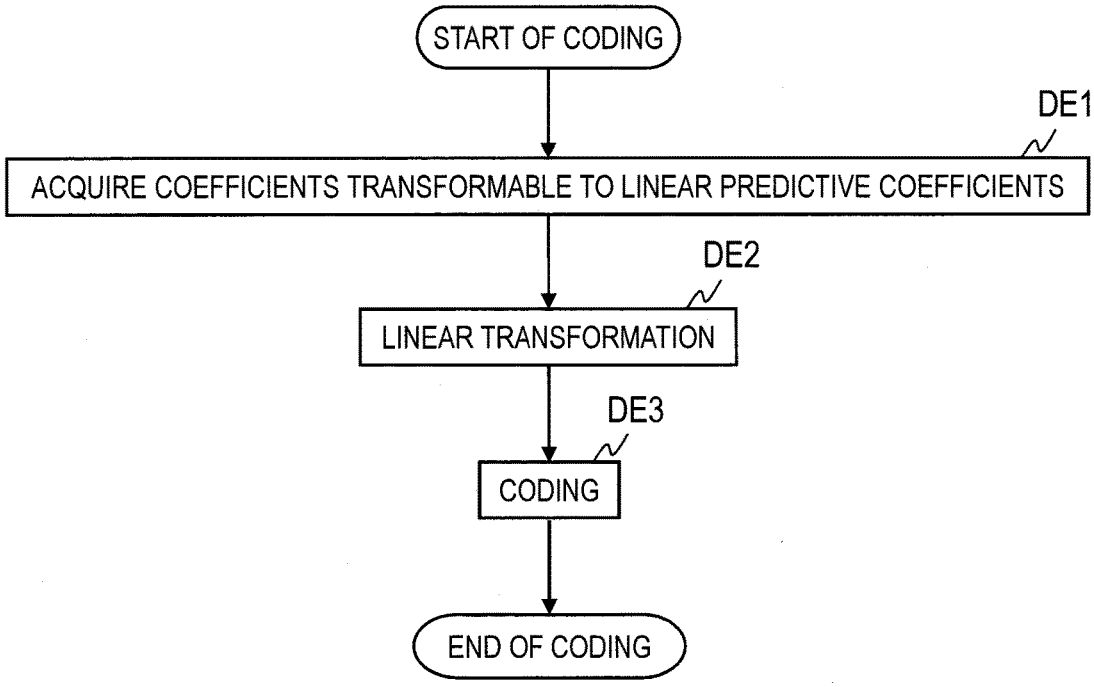
FIG. 4 is a flowchart for illustrating an example of a linear predictive coding method.

The linear predictive coding apparatus of the first embodiment is, for example, provided with a linear predictive analysis part 221, a code book storing part 222, a coding part 224 and a linear transformation part 225 as shown in FIGS. 1, 2 and 3. Though a frequency domain transforming part 220 is provided outside the linear predictive coding apparatus in the examples of FIG. 1, 2 or 3, the linear predictive coding apparatus may be further provided with the frequency domain transforming part 220. A linear predictive coding method is realized by the parts of the linear predictive coding apparatus performing processes illustrated in FIG. 4, respectively.

<Frequency Domain Transforming Part 220>

A time domain sound signal, which is a time-series signal, is inputted to the frequency domain transforming part 220.

A frequency domain transforming part 220 transforms the inputted time domain sound signal to an MDCT coefficient sequence $X(0), X(1), \ldots, X(N-1)$ at N points in a frequency domain for each frame with a predetermined time length. Here, N is a positive integer.

The obtained MDCT coefficient sequence $X(0), X(1), \ldots, X(N-1)$ is outputted to the linear predictive analysis part 221.

It is assumed that subsequent processes are performed for each frame unless otherwise stated.

In this way, the frequency domain transforming part 220 determines a frequency domain sample sequence, which is, for example, an MDCT coefficient sequence, corresponding to the time-series signal.

<Linear Predictive Analysis Part 221>

The frequency domain sample sequence, which is, for example, an MDCT coefficient sequence $X(0), X(1), \ldots, X(N-1)$, and a parameter $\eta_1$ corresponding to the frequency domain sample sequence are inputted to the linear predictive analysis part 221.

The parameter $\eta_1$ is a positive integer. The parameter $\eta_1$ is determined, for example, by a parameter determining part 27 or 27' to be described later. The parameter $\eta_1$ is a parameter $\eta$ that defines probability distribution to which coding targets of arithmetic coding belong, in such a coding system for performing arithmetic coding of quantized values of coefficients in a frequency domain, utilizing a linear prediction envelope as is used in the 3GPP EVS (Enhanced Voice Services) standard. The parameter $\eta$ can be an indicator indicating characteristics of a time-series signal. Parameters $\eta_2$ and $\eta_3$ that will appear later are also the parameters $\eta$. It can be said that $\eta_1$, $\eta_2$ and $\eta_3$ are predetermined values of the parameter $\eta$.

It is assumed that information about the parameter $\eta_1$ is transmitted to a linear predictive decoding apparatus. For example, a parameter code indicating the parameter $\eta_1$ is transmitted to the linear predictive decoding apparatus.

The linear predictive analysis part 221 performs linear predictive analysis using ~R(0), ~R(1), . . . , ~R(N−1) that is explicitly defined by the following expression (A7) using the MDCT coefficient sequence X(0), X(1), . . . , X(N−1) and $\eta_1$ and generates coefficients transformable to linear predictive coefficients (step DE1).

[Expression 1]

$$\tilde{R}(k) = \sum_{n=0}^{N-1} |X(n)|^{\eta_1} \exp\left(-j\frac{2\pi kn}{N}\right), k = 0, 1, \ldots, N-1 \quad \text{(A7)}$$

The generated coefficients transformable to linear predictive coefficients are outputted to the coding part 224.

Specifically, by performing operation corresponding to inverse Fourier transform regarding the $\eta_1$-th power of absolute values of the MDCT coefficient sequence X(0), X(1), . . . , X(N−1) as a power spectrum, that is, the operation of the expression (A7) first, the linear predictive analysis part 221 determines a pseudo correlation function signal sequence ~R(0), ~R(1), . . . , ~R(N−1), which is a time domain signal sequence corresponding to the $\eta_1$-th power of the absolute values of the MDCT coefficient sequence X(0), X(1), . . . , X(N−1). Then, the linear predictive analysis part 221 performs linear predictive analysis using the determined pseudo correlation function signal sequence ~R(0), ~R(1), . . . , ~R(N−1) and generates coefficients transformable to linear predictive coefficients.

In this way, the linear predictive analysis part 221 performs linear predictive analysis using a pseudo correlation function signal sequence obtained by performing inverse Fourier transform regarding the $\eta_1$-th power of absolute values of a frequency domain sample sequence corresponding to a time-series signal as a power spectrum, the $\eta_1$ being a positive number, and obtains the coefficients transformable to linear predictive coefficients.

The coefficients transformable to linear predictive coefficients are, for example, LSP, PARCOR coefficients, ISP and the like. The coefficients transformable to linear predictive coefficients may be linear predictive coefficients themselves.

It is assumed that p is a positive number, and the order of the coefficients transformable to linear predictive coefficients is the p-th order.

<Code Book Storing Part 222>

A code book in which a plurality of candidates for coefficients transformable to linear predictive coefficients corresponding to the parameter $\eta_2$ are stored is stored in the code book storing part 222.

Hereinafter, a pair of a candidate for coefficients transformable to linear predictive coefficients and a code corresponding to the candidate for coefficients transformable to linear predictive coefficients will be referred to as a candidate/code pair. A plurality of candidate/code pairs are stored in the code book. In other words, when N is assumed to be a predetermined number equal to or larger than 2, N candidate/code pairs are stored in the code book. A predetermined number of bits are assigned to each of codes corresponding to the candidates for coefficients transformable to linear predictive coefficients. Each code is expressed with the assigned predetermined number of bits.

Since the order of coefficients transformable to linear predictive coefficients is p, each of the candidates for coefficients transformable to linear predictive coefficients is configured with p values.

The candidates for coefficients transformable to linear predictive coefficients corresponding to the parameter $\eta_2$ are candidates for coefficients transformable to linear predictive coefficients optimized in order to code coefficients transformable to linear predictive coefficients corresponding to a frequency domain sample sequence for which the value of the parameter $\eta$ is $\eta_2$.

<Linear Transformation Part 225>

The coefficients transformable to linear predictive coefficients obtained by the linear predictive analysis part 221 and the parameter $\eta_1$ corresponding to the coefficients transformable to linear predictive coefficients are inputted to the linear transformation part 225. The parameter $\eta_1$ is determined, for example, by the parameter determining part 27 or 27' to be described later.

The linear transformation part 225 is provided with at least one of a first linear transformation part 2251 and a second linear transformation part 2252.

On the assumption that (1) a case where the linear transformation part 225 is provided with the first linear transformation part 2251 as shown in FIG. 1 is a first case, (2) a case where the linear transformation part 225 is provided with the second linear transformation part 2252 as shown in FIG. 2 is a second case, and (3) a case where the linear transformation part 225 is provided with the first linear transformation part 2251 and the second linear transformation part 2252 as shown in FIG. 3 is a third case, each case will be described below.

(1) First Case

In this case, the first linear transformation part 2251 of the linear transformation part 225 performs first linear transformation at least according to the inputted parameter $\eta_1$ for the candidates for coefficients transformable to linear predictive coefficients stored in the code book storing part 222 (step DE2).

For example, by the first linear transformation according to the inputted parameter $\eta_1$ and the parameter $\eta_2$ corresponding to the candidates for coefficients transformable to linear predictive coefficients stored in the code book storing part 222, the first linear transformation part 2251 transforms the candidates for coefficients transformable to linear predictive coefficients corresponding to the parameter $\eta_2$ read from the code book storing part 222 to candidates for coefficients transformable to linear predictive coefficients corresponding to the parameter $\eta_1$.

The candidates for coefficients transformable to linear predictive coefficients corresponding to the parameter $\eta_1$ are candidates for coefficients transformable to linear predictive coefficients optimized in order to code coefficients transformable to linear predictive coefficients corresponding to a frequency domain sample sequence for which the value of the parameter $\eta$ is $\eta_1$.

The candidates for coefficients transformable to linear predictive coefficients after the first linear transformation are outputted to the coding part 224.

When the values of the parameter $\eta_1$ and the parameter $\eta_2$ are the same, the first linear transformation part 2251 may not perform the first linear transformation.

Further, for example, the first linear transformation part 2251 of the linear transformation part 225 performs the first linear transformation for the candidates for coefficients transformable to linear predictive coefficients read from the code book storing part 222 so that, according to the inputted parameter $\eta_1$, a sequence of an amplitude spectral envelope corresponding to the candidates for coefficients transformable to linear predictive coefficients after the first linear transformation is flatter as the inputted parameter $\eta_1$ is smaller, and outputs the candidates for coefficients transformable to linear predictive coefficients after the transformation.

In general, as the parameter $\eta$ is smaller, an unsmoothed spectral envelope sequence tends to be flatter, and coefficients transformable to linear predictive coefficients tend to take the same value. For example, when the coefficients transformable to linear predictive coefficients are LSP, the coefficients transformable to linear predictive coefficients, which are LSP, tend to come closer to values obtained by equal division between 0 and $\pi$ as the parameter $\eta$ is smaller.

Figure 5:
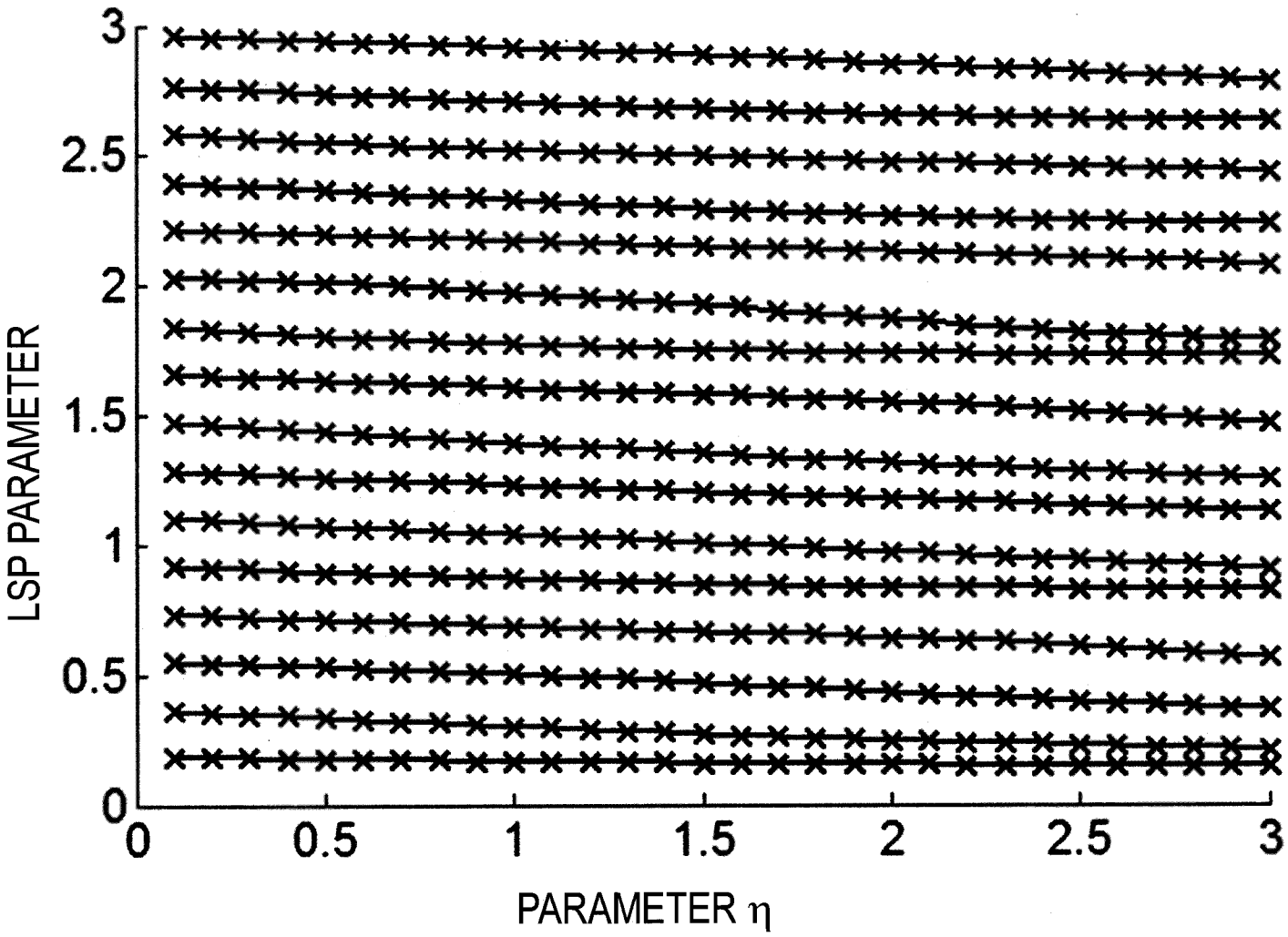
FIG. 5 is a diagram for illustrating an example of a relationship between LSP parameters and $\eta$.

An example of values of LSP parameters when the parameter $\eta$ takes each value is shown in FIG. 5. The horizontal axis in FIG. 5 indicates the parameter $\eta$, and the vertical axis indicates the LSP parameters. From FIG. 5, it is seen that the LSP parameters tend to come closer to the values obtained by equal division between 0 and $\pi$ as the parameter $\eta$ is smaller.

By performing coding and decoding using what are obtained by transforming the candidates for coefficients transformable to linear predictive coefficients so as to correspond to the case where an unsmoothed spectral envelope sequence is flatter as the parameter $\eta_1$ is smaller, utilizing this tendency, it is possible to cause quantization performance to be improved.

(2) Second Case

In this case, the second linear transformation part 2252 of the linear transformation part 225 performs second linear transformation at least according to the inputted parameter $\eta_1$ for the coefficients transformable to linear predictive coefficients obtained by the linear predictive analysis part 221 (step DE2).

For example, the second linear transformation part 2252 performs the second linear transformation for coefficients transformable to linear predictive coefficients corresponding to the parameter $\eta_1$ obtained by the linear predictive analysis part 221 to coefficients transformable to the linear predictive coefficients corresponding to the parameter $\eta_2$ so that the coefficients transformable to linear predictive coefficients correspond to the candidates for coefficients transformable to linear predictive coefficients stored in the code book storing part 222.

The coefficients transformable to linear predictive coefficients after the second linear transformation are outputted to the coding part 224.

When the values of the parameter $\eta_1$ and the parameter $\eta_2$ are the same, the second linear transformation part 2252 may not perform the second linear transformation.

Otherwise, for example, the second linear transformation part 2252 of the linear transformation part 225 performs the second linear transformation for inputted coefficients transformable to linear predictive coefficients so that, according to the inputted parameter $\eta_1$, a sequence of an amplitude spectral envelope corresponding to the coefficients transformable to linear predictive coefficients after the second linear transformation is flatter as the inputted parameter $\eta_1$ is smaller, and outputs the coefficients transformable to linear predictive coefficients after the transformation.

(3) Third case

In this case, the first linear transformation part 2251 of the linear transformation part 225 performs first linear transformation at least according to the parameter $\eta_3$ for the candidates for coefficients transformable to linear predictive coefficients stored in the code book storing part 222. The parameter $\eta_3$ is a positive value, and a value different from the parameter $\eta_2$ is set for the parameter $\eta_3$ in advance or inputted from the outside of the linear predictive coding apparatus.

For example, by the first linear transformation according to the parameter $\eta_3$ and the parameter $\eta_2$ corresponding to the candidates for coefficients transformable to linear predictive coefficients stored in the code book storing part 222, the first linear transformation part 2251 transforms candidates for coefficients transformable to linear predictive coefficients corresponding to the parameter $\eta_2$ read from the code book storing part 222 to candidates for coefficients transformable to linear predictive coefficients corresponding to the parameter $\eta_3$.

The candidates for coefficients transformable to linear predictive coefficients corresponding to the parameter $\eta_3$ are candidates for coefficients transformable to linear predictive coefficients optimized in order to code coefficients transformable to linear predictive coefficients corresponding to a frequency domain sample sequence for which the value of the parameter $\eta$ is $\eta_3$.

The candidates for coefficients transformable to linear predictive coefficients after the first linear transformation are outputted to the coding part 224.

When the values of the parameter $\eta_2$ and the parameter $\eta_3$ are the same, the first linear transformation part 2251 may not perform the first linear transformation.

Further, for example, the first linear transformation part 2251 of the linear transformation part 225 performs the first linear transformation for the candidates for coefficients transformable to linear predictive coefficients read from the code book storing part 222 so that an amplitude spectral envelope corresponding to the candidates for coefficients transformable to linear predictive coefficients after the first linear transformation is flatter as the parameter $\eta_3$ is smaller, and outputs the candidates for coefficients transformable to linear predictive coefficients after the transformation.

Further, in this third case, the second linear transformation part 2252 of the linear transformation part 225 performs the second linear transformation at least according to the parameter $\eta_1$ for the coefficients transformable to linear predictive coefficients obtained by the linear predictive analysis part 221.

For example, the second linear transformation part 2252 performs the second linear transformation for the coefficients transformable to linear predictive coefficients corresponding to the parameter $\eta_1$ obtained by the linear predictive analysis part 221 to coefficients transformable to linear predictive coefficients corresponding to the parameter $\eta_3$.

The candidates for coefficients transformable to linear predictive coefficients after the second linear transformation are outputted to the coding part 224.

When the values of the parameter $\eta_1$ and the parameter $\eta_3$ are the same, the second linear transformation part 2252 may not perform the second linear transformation.

Otherwise, for example, the second linear transformation part 2252 of the linear transformation part 225 performs the second linear transformation for inputted coefficients transformable to linear predictive coefficients so that, according to the inputted parameter $\eta_1$, an amplitude spectral envelope corresponding to the coefficients transformable to linear predictive coefficients after the second linear transformation is flatter as the inputted parameter $\eta_1$ is smaller, and outputs the coefficients transformable to linear predictive coefficients after the transformation.

In this way, in (3) the third case, the linear transformation part 225 performs at least one of the first linear transformation according to $\eta_3$ for the candidates for coefficients transformable to linear predictive coefficients stored in the code book storing part 222 and the second linear transformation according to $\eta_3$ for the coefficients transformable to linear predictive coefficients obtained by the linear predictive analysis part 221 (step DE2).

<Coding Part 224>

The process of the coding part 224 differs according to the configuration of the linear transformation part 225. Therefore, the process of the coding part 224 in each of (1) the first case, (2) the second case and (3) the third case of the linear transformation part 225 will be described below.

(1) First Case

When the linear transformation part 225 is in (1) the first case, the coefficients transformable to linear predictive coefficients obtained by the linear predictive analysis part 221 and the candidates for coefficients transformable to linear predictive coefficients after the first linear transformation obtained by the first linear transformation part 2251 of the linear transformation part 225 are inputted to the coding part 224.

For the coefficients transformable to linear predictive coefficients, the coding part 224 performs coding using the candidates for coefficients transformable to linear predictive coefficients after the first linear transformation to obtain a linear predictive coefficient code (step DE3).

Specifically, the coding part 224 selects a candidate that is the closest to the coefficients transformable to linear predictive coefficients, from among the plurality of candidates for coefficients transformable to linear predictive coefficients after the first linear transformation, and causes a code corresponding to the selected candidate to be a linear predictive coefficient code.

The obtained linear predictive coefficient code is outputted to the decoding apparatus.

(2) Second Case

When the linear transformation part 225 is in (2) the second case, the coefficients transformable to linear predictive coefficients obtained by the second linear transformation part 2252 of the linear transformation part 225 and the candidates for coefficients transformable to linear predictive coefficients stored in the code book storing part 222 are inputted to the coding part 224.

For the coefficients transformable to linear predictive coefficients after the second linear transformation, the coding part 224 performs coding using the candidates for coefficients transformable to linear predictive coefficients to obtain a linear predictive coefficient code (step DE3).

Specifically, the coding part 224 selects a candidate that is the closest to the coefficients transformable to linear predictive coefficients after the second linear transformation, from among the plurality of candidates for coefficients transformable to linear predictive coefficients, and causes a code corresponding to the selected candidate to be a linear predictive coefficient code.

The obtained linear predictive coefficient code is outputted to the decoding apparatus.

(3) Third Case

When the linear transformation part 225 is in (3) the third case, the coefficients transformable to linear predictive coefficients obtained by the second linear transformation part 2252 of the linear transformation part 225 and the candidates for coefficients transformable to linear predictive coefficients obtained by the first linear transformation part 2251 of the linear transformation part 225 are inputted to the coding part 224.

For the coefficients transformable to linear predictive coefficients after the second linear transformation, the coding part 224 performs coding using the candidates for coefficients transformable to linear predictive coefficients after the first linear transformation to obtain a linear predictive coefficient code (step DE3).

Specifically, the coding part 224 selects a candidate that is the closest to the coefficients transformable to linear predictive coefficients after the second linear transformation, from among the plurality of candidates for coefficients transformable to linear predictive coefficients after the first linear transformation, and causes a code corresponding to the selected candidates to be a linear predictive coefficient code.

The obtained linear predictive coefficient code is outputted to the decoding apparatus.

In this way, at the time of coding coefficients transformable to linear predictive coefficients using candidates for coefficients transformable to linear predictive coefficients, it is possible to reduce coding distortion and/or reduce the code amount of the linear predictive coefficient code by using what are obtained by performing linear transformation for at least any of the coefficients transformable to linear predictive coefficients and the candidates for coefficients transformable to linear predictive coefficients so that a parameter $\eta$ corresponding to the coefficients transformable to linear predictive coefficients and a parameter $\eta$ corresponding to the candidates for coefficients transformable to linear predictive coefficients are the same value or close values.

(Decoding)

An example of the linear predictive decoding apparatus and method of the first embodiment will be described.

Figure 6:
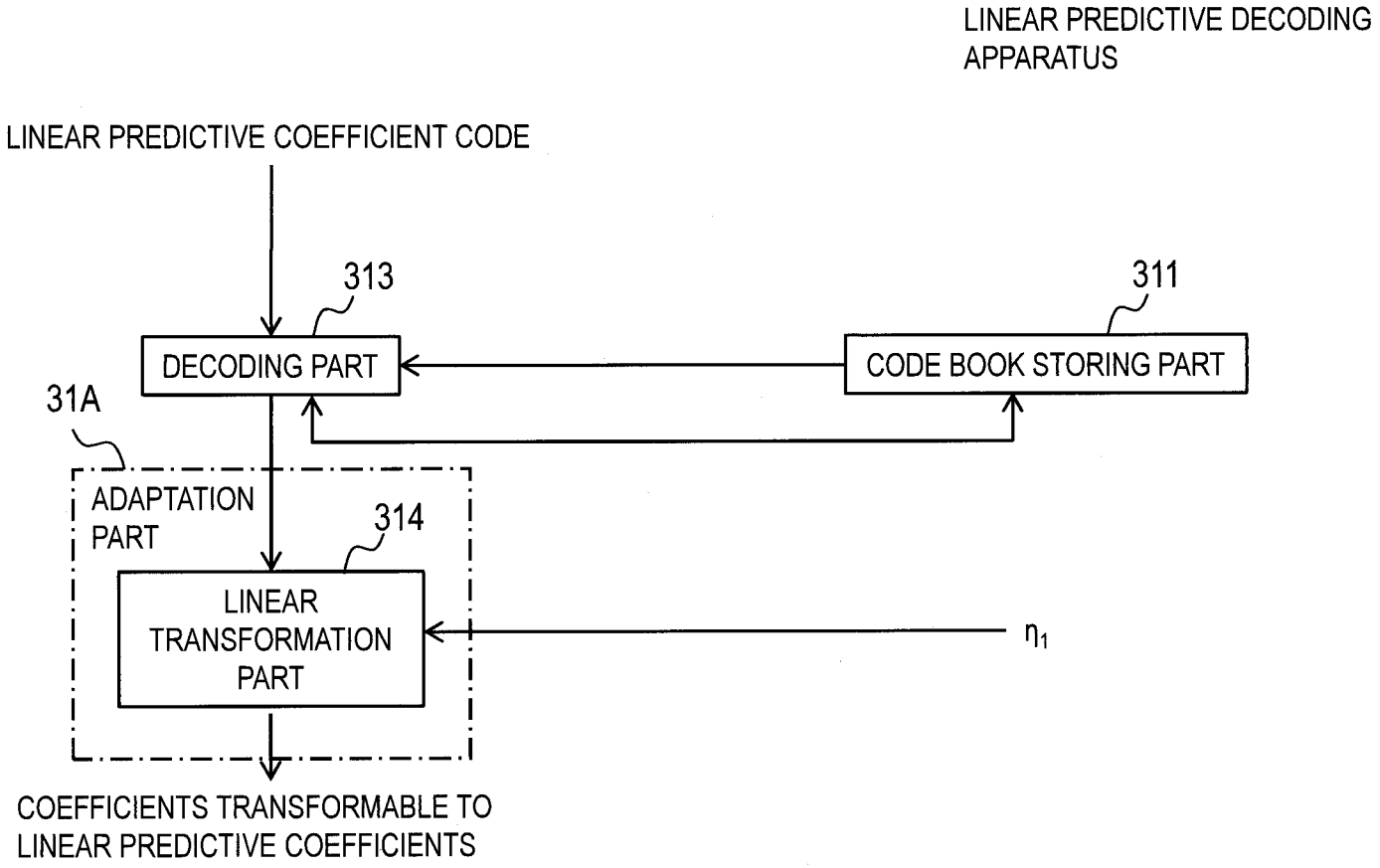
FIG. 6 is a block diagram for illustrating an example of a linear predictive decoding apparatus.
Figure 7:
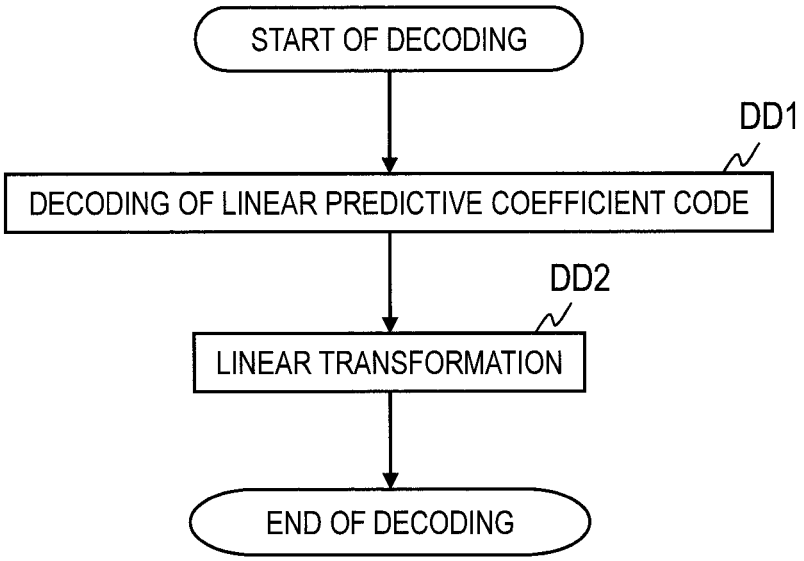
FIG. 7 is a flowchart for illustrating an example of a linear predictive decoding method.

As shown in FIG. 6, the linear predictive decoding apparatus of the first embodiment is, for example, provided with a code book storing part 311, a decoding part 313 and a linear transformation part 314. A linear predictive decoding method is realized by the parts of the linear predictive decoding apparatus performing processes illustrated in FIG. 7, respectively.

<Code Book Storing Part 311>

In the code book storing part 311, the same code book as the code book stored in the code book storing part 222 is stored. That is, a code book in which a plurality of candidates for coefficients transformable to linear predictive coefficients corresponding to the parameter $\eta_2$ are stored is stored in the code book storing part 311.

<Decoding Part 313>

The linear predictive coefficient code outputted by the linear predictive coding apparatus is inputted to the decoding part 313.

The decoding part 313 obtains a candidate for coefficients transformable to linear predictive coefficients corresponding to the inputted linear predictive coefficient code, among the plurality of candidates for coefficients transformable to linear predictive coefficients stored in the code book storing part 311, as coefficients transformable to linear predictive coefficients (step DD1).

The obtained coefficients transformable to linear predictive coefficients are outputted to the linear transformation part 314.

The obtained coefficients transformable to linear predictive coefficients correspond to any one of the plurality of candidates for coefficients transformable to linear predictive coefficients corresponding to the parameter $\eta_2$ stored in the code book storing part 311. Therefore, the coefficients transformable to linear predictive coefficients obtained by the decoding part 313 are coefficients transformable to linear predictive coefficients corresponding to the parameter $\eta_2$.

<Linear Transformation Part 314>

The coefficients transformable to linear predictive coefficients corresponding to the parameter $\eta_2$ obtained by the decoding part 313 and the parameter $\eta_1$ are inputted to the linear transformation part 314. This parameter $\eta_1$ is obtained, for example, by decoding a parameter code received from the linear predictive coding apparatus.

The linear transformation part 314 performs the linear transformation at least according to the parameter $\eta_1$ for the coefficients transformable to linear predictive coefficients corresponding to the parameter $\eta_2$ to obtain coefficients transformable to linear predictive coefficients after the linear transformation.

For example, by linear transformation according to the inputted parameter $\eta_1$ and the parameter $\eta_2$ corresponding to coefficients transformable to linear predictive coefficients, the linear transformation part 314 transforms the coefficients transformable to linear predictive coefficients corresponding to the parameter $\eta_2$ to the coefficients transformable to linear predictive coefficients corresponding to the parameter $\eta_1$.

The obtained coefficients transformable to linear predictive coefficients after the linear transformation are outputted as a decoding result by the linear predictive decoding apparatus or method.

When the values of the parameter $\eta_1$ and the parameter $\eta_2$ are the same, the linear transformation part 314 may not perform the linear transformation.

Further, the linear transformation part 314 may be configured to perform linear transformation multiple times using a parameter $\eta_4$ different from both of the parameters $\eta_1$ and $\eta_2$ at the time of performing linear transformation of the coefficients transformable to linear predictive coefficients corresponding to the parameter $\eta_2$ to obtain the coefficients transformable to linear predictive coefficients corresponding to the parameter $\eta_1$.

For example, the case of performing linear transformation twice will be described. In this case, the linear transformation part 314 performs linear transformation of the coefficients transformable to linear predictive coefficients corresponding to the parameter $\eta_2$ to obtain coefficients transformable to linear predictive coefficients corresponding to the parameter $\eta_4$. Further, the linear transformation part 314 performs linear transformation of the obtained coefficients transformable to linear predictive coefficients corresponding to the parameter $\eta_4$ to obtain coefficients transformable to linear predictive coefficients corresponding to the parameter $\eta_1$. Here, when it is assumed that the parameter $\eta_4$ is the same value as the parameter $\eta_3$ used by the linear predictive coding apparatus, the same linear transformations as the linear transformation in the third case of the linear transformation part 225 of the linear predictive coding apparatus in which candidates for coefficients transformable to linear predictive coefficients corresponding to the parameter $\eta_3$ are obtained from among the candidates for coefficients transformable to linear predictive coefficients corresponding to the parameter $\eta_2$ and the linear transformation in the third case of the linear transformation part 225 of the linear predictive coding apparatus in which coefficients transformable to linear predictive coefficients corresponding to the parameter $\eta_3$ are obtained from the coefficients transformable to linear predictive coefficients corresponding to the parameter $\eta_1$ can be used for the two linear transformations.

The linear transformation part 314 may obtain the coefficients transformable to linear predictive coefficients corresponding to the parameter by performing one linear transformation obtained by combining the linear transformation from the parameter $\eta_2$ to the parameter $\eta_3$ and the linear transformation from the parameter $\eta_3$ to the parameter $\eta_1$, for the coefficients transformable to linear predictive coefficients corresponding to the parameter $\eta_2$.

The obtained coefficients transformable to linear predictive coefficients corresponding to the parameter $\eta_1$ are outputted as a decoding result by the linear predictive decoding apparatus or method.

Further, for example, similarly to the linear transformation part 225 of the linear predictive coding apparatus, the linear transformation part 314 may perform linear transformation for the coefficients transformable to linear predictive coefficients obtained by the decoding part 313 so that an amplitude spectral envelope corresponding to the coefficients transformable to linear predictive coefficients after the linear transformation is flatter as the inputted $\eta_1$ is smaller, to obtain coefficients transformable to linear predictive coefficients after the linear transformation.

This is based on the tendency that, in general, an unsmoothed spectral envelope sequence is flatter as the parameter $\eta$ is smaller.

The coefficients transformable to linear predictive coefficients after the linear transformation obtained by the linear transformation part 314 is used to obtain an unsmoothed spectral envelope sequence, which is a sequence obtained by raising a sequence of an amplitude spectral envelope corresponding to the coefficients transformable to linear predictive coefficients obtained by the linear transformation part 314 to the power of 14.

[Linear Transformation]

Examples of linear transformations such as the first linear transformation and the second linear transformation will be described below.

Coefficients transformable to linear predictive coefficients or candidates for coefficients transformable to linear predictive coefficients before linear transformation are indicated by $\hat{\omega}[k][k=1, 2, \ldots, p]$, and coefficients transformable to linear predictive coefficients or the candidates for coefficients transformable to linear predictive coefficients after the linear transformation are indicated by $\tilde{\omega}[k][k=1, 2, \ldots, p]$. Further, it is assumed that the coefficients transformable to linear predictive coefficients before the linear transformation are LSP. At this time, the first linear transformation part 2251, the second linear transformation part 2252, an inverse linear transformation part 226 and the linear transformation part 314 perform linear transformation, for example, shown by the expression below.

[Expression 2]

$$\begin{pmatrix} \tilde{\omega}[1] \\ \tilde{\omega}[2] \\ \vdots \\ \tilde{\omega}[p] \end{pmatrix} = K \begin{pmatrix} \hat{\omega}[1] - \frac{\pi}{p+1} \\ \hat{\omega}[2] - \frac{2\pi}{p+1} \\ \vdots \\ \hat{\omega}[p] - \frac{p\pi}{p+1} \end{pmatrix} + \begin{pmatrix} \hat{\omega}[1] \\ \hat{\omega}[2] \\ \vdots \\ \hat{\omega}[p] \end{pmatrix}$$

$$K = \begin{pmatrix} x_1 & y_1 & & & & 0 \\ z_2 & x_2 & y_2 & & & \\ & z_3 & x_3 & y_3 & & \\ & & \ddots & \ddots & \ddots & \\ & & & \ddots & \ddots & \\ 0 & & & & z_p & x_p \end{pmatrix}$$

Here, it is assumed that $x_1, x_2, \ldots x_p, y_1, y_2, \ldots y_{p-1}, z_2, z_3, \ldots z_p$ are predetermined non-negative numbers; at least one of $y_1, y_2, \ldots y_{p-1}, z_2, z_3, \ldots z_p$ is a predetermined positive number; and K is a matrix in which elements other than $x_1, x_2, \ldots x_p, y_1, y_2, \ldots y_{p-1}, z_2, z_3, \ldots z_p$ are 0.

Specific values of $x_1, x_2, \ldots x_p, y_1, y_2, \ldots y_p, z_2, z_3, \ldots z_p$ are appropriately determined on the basis of the value of a parameter $\eta$ corresponding to the coefficients transformable to linear predictive coefficients or candidates for coefficients transformable to linear predictive coefficients before the linear transformation (hereinafter referred to as a parameter before linear transformation $\eta_A$) and the value of a parameter $\eta$ corresponding to the coefficients transformable to linear predictive coefficients or candidates for coefficients transformable to linear predictive coefficients after the linear transformation (hereinafter referred to as a parameter after linear transformation $\eta_B$).

Specific values of $x_1, x_2, \ldots x_p, y_1, y_2, \ldots y_{p-1}, z_2, z_3, \ldots z_p$ corresponding to a plurality of different pairs of the parameter before linear transformation $\eta_A$ and the parameter after linear transformation $N_B$ are stored in a storage part not shown in advance. At the time of performing linear transformation, the first linear transformation part 2251, the second linear transformation part 2252, the inverse linear transformation part 226 and the linear transformation part 314 can read the specific values of $x_1, x_2, \ldots x_p, y_1, y_2, z_2, z_3, \ldots z_p$ corresponding to the pairs of the parameter before linear transformation $\eta_A$ and the parameter after linear transformation $\eta_B$ for the linear transformation and perform the linear transformation by the above expression using the read values.

By the way, when the parameter $\eta_1$ is large, fluctuation of a spectral envelope calculated using coefficients transformable to linear predictive coefficients tends to be large. Therefore, it is desirable to perform coding and decoding using candidates for coefficients transformable to linear predictive coefficients the order of which is high.

On the contrary, when the parameter $\eta_1$ is small, fluctuation of a spectral envelope calculated using coefficients transformable to linear predictive coefficients tends to be small. Therefore, even if coding and decoding are performed using candidates for coefficients transformable to linear predictive coefficients the order of which is low, quantization distortion is small, and, therefore, accuracy of the coding and decoding is not so bad.

Therefore, the first linear transformation part 2251 of the linear transformation part 225 may perform the first linear transformation so that the order of the candidates for coefficients transformable to linear predictive coefficients after the first linear transformation is lower as the parameter $\eta_1$ is smaller.

Similarly, the linear transformation part 314 may perform linear transformation so that the order of the coefficients transformable to linear predictive coefficients after linear transformation is lower as the parameter $\eta_1$ is smaller.

Thus, linear transformation may be performed so that the order of coefficients transformable to linear predictive coefficients or candidates for coefficients transformable to linear predictive coefficients before linear transformation and the order of the coefficients transformable to linear predictive coefficients or candidates for coefficients transformable to linear predictive coefficients after the linear transformation are different from each other.

After performing linear transformation in which the order before the linear transformation is the same as the order after the linear transformation, the first linear transformation part 2251 may decrease the order of candidates for coefficients transformable to linear predictive coefficients after the linear transformation. Further, after decreasing the order of candidates for coefficients transformable to linear predictive coefficients after linear transformation, the first linear transformation part 2251 may perform linear transformation in which the order before the linear transformation is the same as the order after the linear transformation.

Similarly, after performing the linear transformation in which the order before the linear transformation is the same as the order after the linear transformation, the linear transformation part 314 may decrease the order of the coefficients transformable to linear predictive coefficients after the linear transformation. Further, after decreasing the order of coefficients transformable to linear predictive coefficients after linear transformation, the linear transformation part 314 may perform the linear transformation in which the order before the linear transformation is the same as the order after the linear transformation.

Further, when the parameter $\eta_1$ is small, the first linear transformation part 2251 may decrease the number of the plurality of candidates for coefficients transformable to linear predictive coefficients after linear transformation as the parameter $\eta_1$ is smaller by integrating a plurality of candidates for coefficients transformable to linear predictive coefficients after the linear transformation.

Second Embodiment of Linear Predictive Coding Apparatus, Linear Predictive Decoding Apparatus and Methods Therefor (Coding)

An example of a linear predictive coding apparatus and method of a second embodiment will be described.

Figure 21:
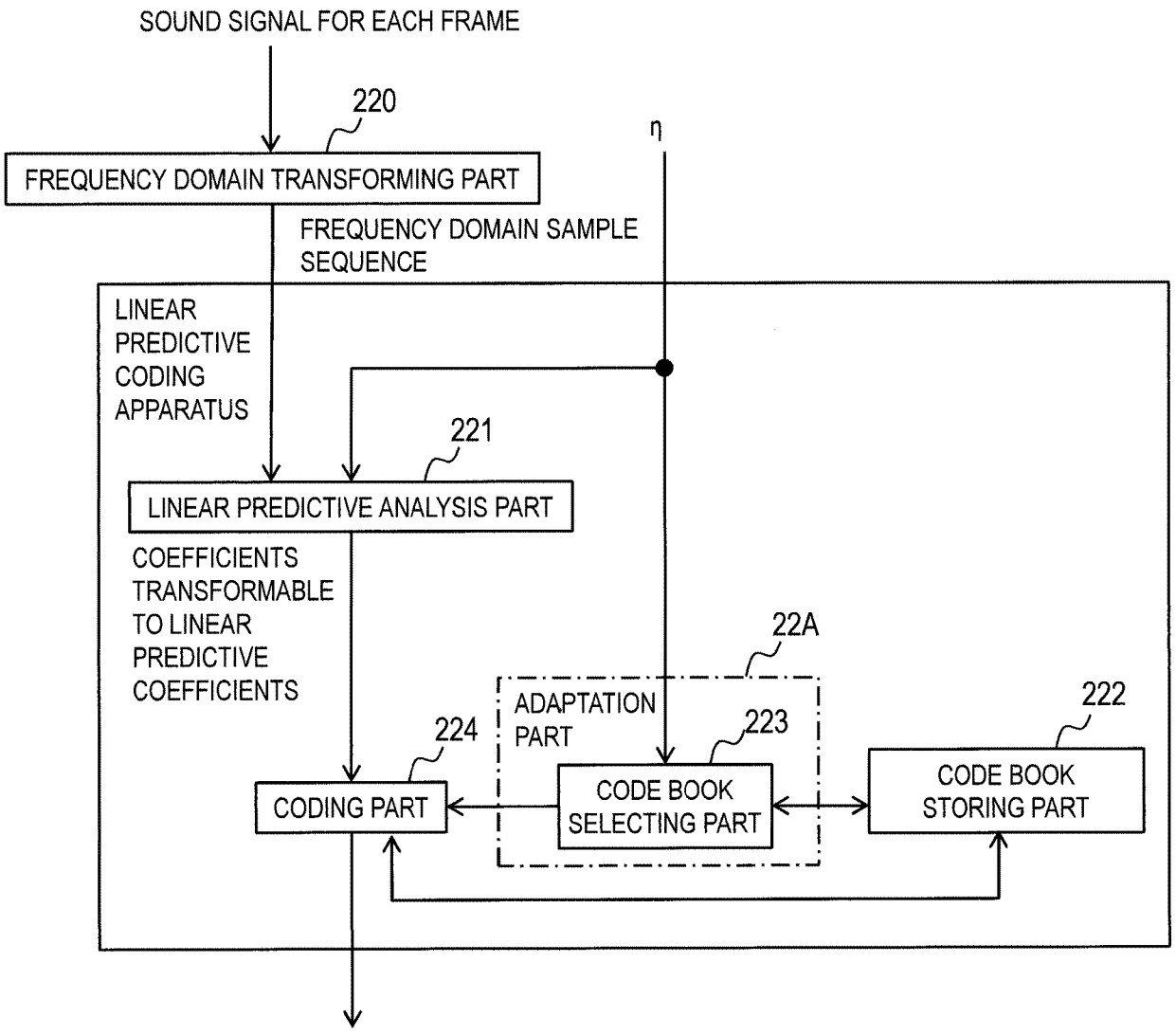
FIG. 21 is a block diagram for illustrating an example of the linear predictive coding apparatus.
Figure 22:
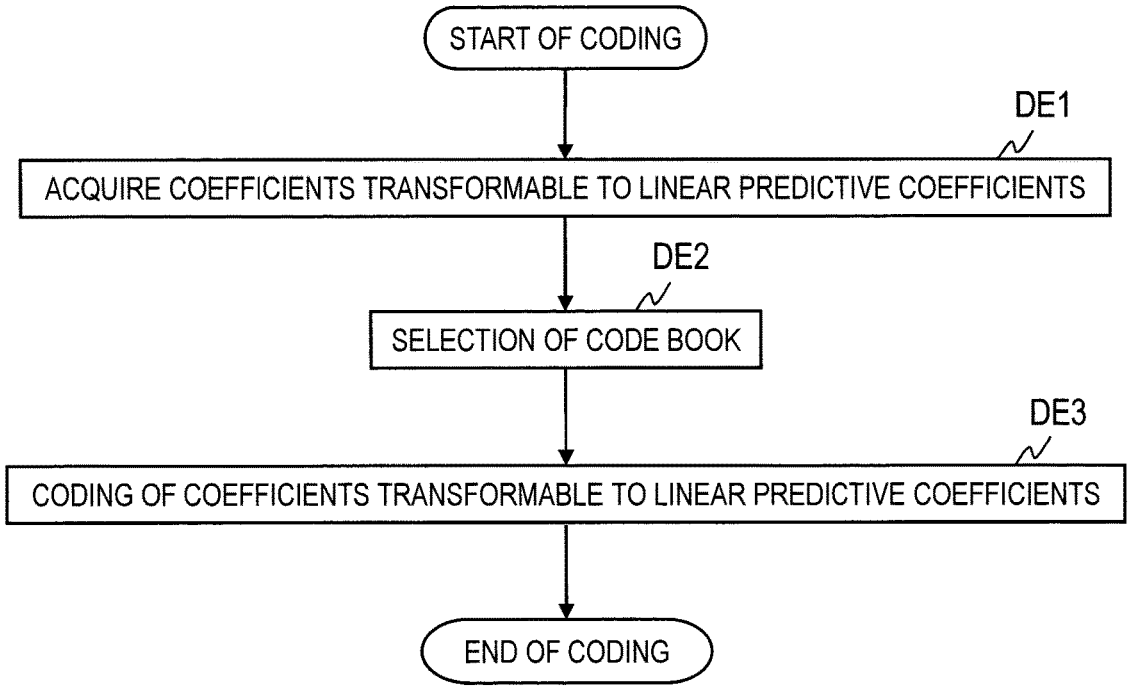
FIG. 22 is a flowchart for illustrating an example of the linear predictive coding method.

As shown in FIG. 21, the linear predictive coding apparatus of the second embodiment is, for example, provided with the linear predictive analysis part 221, the code book storing part 222, a code book selecting part 223 and the coding part 224. Though the frequency domain transforming part 220 is provided outside the linear predictive coding apparatus in the example of FIG. 21, the linear predictive coding apparatus may be further provided with the frequency domain transforming part 220. A linear predictive coding method is realized by the parts of the linear predictive coding apparatus performing processes illustrated in FIG. 22, respectively.

In the second embodiment, the "parameter $\eta_1$" is referred to as the "parameter $\eta$".

<Frequency Domain Transforming Part 220>

A time domain sound signal, which is a time-series signal, is inputted to the frequency domain transforming part 220.

The frequency domain transforming part 41 transforms the inputted time domain sound signal to an MDCT coefficient sequence X(0), X(1), . . . , X(N−1) at N points in a frequency domain for each frame with a predetermined time length. Here, N is a positive integer.

The obtained MDCT coefficient sequence X(0), X(1), . . . , X(N−1) is outputted to the linear predictive analysis part 221.

It is assumed that subsequent processes are performed for each frame unless otherwise stated.

In this way, the frequency domain transforming part 220 determines a frequency domain sample sequence, which is, for example, an MDCT coefficient sequence, corresponding to the time-series signal.

<Linear Predictive Analysis Part 221>

The frequency domain sample sequence, which is, for example, an MDCT coefficient sequence X(0), X(1), . . . , X(N−1), and a parameter η corresponding to the frequency domain sample sequence are inputted to the linear predictive analysis part 221.

The parameter η is a positive integer. The parameter η is determined, for example, by a parameter determining part 27 or 27' to be described later. The parameter η is a shape parameter that defines probability distribution to which coding targets of arithmetic coding belong, in such a coding system for performing arithmetic coding of quantized values of coefficients in a frequency domain, utilizing a linear prediction envelope as is used in the 3GPP EVS (Enhanced Voice Services) standard. The parameter η can be an indicator indicating characteristics of a time-series signal.

The linear predictive analysis part 221 performs linear predictive analysis using ~R(0), ~R(1), . . . , ~R(N−1) that is explicitly defined by the following expression (A7) using the MDCT coefficient sequence X(0), X(1), . . . , X(N−1) and η and generates coefficients transformable to linear predictive coefficients (step DE1).

[Expression 3]

$$\tilde{R}(k) = \sum_{n=0}^{N-1} |X(n)|^{\eta} \exp\left(-j\frac{2\pi kn}{N}\right),\ k = 0, 1, \ldots, N-1 \tag{A7}$$

The generated coefficients transformable to linear predictive coefficients are outputted to the coding part 224.

Specifically, by performing operation corresponding to inverse Fourier transform regarding the η-th power of absolute values of the MDCT coefficient sequence X(0), X(1), . . . , X(N−1) as a power spectrum, that is, the operation of the expression (A7) first, the linear predictive analysis part 22 determines a pseudo correlation function signal sequence ~R(0), ~R(1), . . . , ~R(N−1), which is a time domain signal sequence corresponding to the η-th power of the absolute values of the MDCT coefficient sequence X(0), X(1), . . . , X(N−1). Then, the linear predictive analysis part 221 performs linear predictive analysis using the determined pseudo correlation function signal sequence ~R(0), ~R(1), . . . , ~R(N−1) and generates coefficients transformable to linear predictive coefficients.

In this way, the linear predictive analysis part 221 performs linear predictive analysis using a pseudo correlation function signal sequence obtained by performing inverse Fourier transform regarding the η-th power of absolute values of a frequency domain sample sequence corresponding to a time-series signal as a power spectrum, η being a positive number, and obtains the coefficients transformable to linear predictive coefficients.

The coefficients transformable to linear predictive coefficients are, for example, LSP, PARCOR coefficients, ISP and the like. The coefficients transformable to linear predictive coefficients may be linear predictive coefficients themselves.

It is assumed that p is a predetermined positive number, and the order of the coefficients transformable to linear predictive coefficients is the p-th order.

<Code Book Storing Part 222>

A plurality of code books are stored in the code book storing part 222.

Hereinafter, a pair of a candidate for coefficients transformable to linear predictive coefficients and a code corresponding to the candidate for coefficients transformable to linear predictive coefficients will be referred to as a candidate/code pair. A plurality of candidate/code pairs are stored in each code book. In other words, when I indicates a predetermined number equal to or larger than 2, and $N_i$ is a predetermined number equal to or larger than 2 that is determined according to i, $N_i$ candidate/code pairs are stored in each code book i (i=1, 2, . . . I). A predetermined number of bits are assigned to each of codes corresponding to the candidates for coefficients transformable to linear predictive coefficients. Each code is expressed with the assigned predetermined number of bits.

Since the order of coefficients transformable to linear predictive coefficients is p, each of the candidates for coefficients transformable to linear predictive coefficients is configured with p values.

The plurality of code books stored in the code book storing part 222 differ depending on the code book selection method of the code book selecting part 223. Therefore, an example of the plurality of code books stored in the code book storing part 222 will be described together with an example of the code book selecting part 223 to be described later.

<Code Book Selecting Part 223>

A parameter η is inputted to the code book selecting part 223. The code book selecting part 223 selects a code book from among the plurality of code books stored in the code book storing part 222 according to the inputted η (step DE2). Information about the selected code book is outputted to the coding part 224.

An example of the plurality of code books stored in the code book storing part 222 and an example of a criterion for selection of a code book by the code book selecting part 223 will be described below.

(1) First Method

In a first method, a plurality of code books that are different in the number of candidates for coefficients transformable to linear predictive coefficients are stored in the code book storing part 222. Further, the code book selecting part 223 selects a code book with a larger number of candidates for coefficients transformable to linear predictive coefficients, from among the plurality of code books stored in the code book storing part 222 as the parameter η is larger.

When the parameter η is large, the range that coefficients transformable to linear predictive coefficients can take tends to be wide. Therefore, the number of candidates for the coefficients transformable to linear predictive coefficients required to express the coefficients transformable to linear predictive coefficients becomes large. Therefore, when the parameter η is large, it is desirable to perform coding and decoding using a code book with a large number of candidates for coefficients transformable to linear predictive coefficients.

On the contrary, when the parameter η is small, the range that coefficients transformable to linear predictive coefficients can take tends to be narrow. Therefore, it is possible to express the coefficients transformable to linear predictive coefficients with a small number of candidates for the coefficients transformable to linear predictive coefficients. Therefore, when the parameter is small, quantization distortion is small even if coding and decoding are performed using a code book with a small number of candidates for coefficients transformable to linear predictive coefficients, and accuracy of the coding and decoding is not so bad.

Therefore, in the first method, the code book selecting part 223 selects a code book with a larger number of candidates for coefficients transformable to linear predictive coefficients, from among the plurality of code books stored in the code book storing part 222 as the parameter η is larger.

A judgment about the magnitude of the parameter η, in other words, a selection of an appropriate code book can be made on the basis of a threshold. For example, it is assumed that the number of candidates for coefficients transformable to linear predictive coefficients in a first code book is smaller than the number of candidates for coefficients transformable to linear predictive coefficients in a second code book. In this case, one threshold for the parameter η is set in advance. When an inputted parameter η is smaller than the threshold, it is judged that the parameter η is small, and the first code book is selected. When the inputted parameter η is equal to or larger than the threshold, it is judged that the parameter η is large, and the second code book is selected. When the number of code books is equal to or larger than three, a code book can be similarly selected using the number of thresholds corresponding to a value obtained by subtracting one from the number of code books.

The code book may have a multilayer structure, and up to which layer the code book is to be used may be determined according to the parameter η. For example, description will be made on an example in which p=16 is assumed, and coefficients transformable to 16th order linear predictive coefficients are coded with a two-layer code book. It is assumed that 10 quantization bits and 5 quantization bits are assigned to the first and second layers of this code book, respectively. Thereby, it is assumed that pairs of a 16-dimension vector, which is a candidate for coefficients transformable to linear predictive coefficients, and a code corresponding to the candidate, the number of which is $2^{10}=1024$, are stored in the first layer, and pairs of a 16-dimension vector, which is a candidate for coefficients transformable to linear predictive coefficients, and a code corresponding to the candidate, the number of which is $2^5=32$, are stored in the second layer.

In this case, it is assumed that the first and second layers are used when the parameter η is large, and only the first layer is used when the parameter η is small. A judgment about whether the parameter η is large or small can be made on the basis of a threshold similarly to the above.

When the parameter η is large, a candidate that is the closest to inputted coefficients transformable to linear predictive coefficients among the candidates for coefficients transformable to linear predictive coefficients and a corresponding code in the first layer are selected first. Next, the value of the selected candidate for coefficients transformable to linear predictive coefficients is subtracted from the inputted coefficients transformable to linear predictive coefficients, and a candidate that is the closest to the subtraction value among the candidates for coefficients transformable to linear predictive coefficients and a corresponding code in the second layer are selected. In this case, the two codes selected in the first and second layers become a linear predictive coefficient code. That is, the linear predictive coefficient code is expressed with 15 bits. Further, the sum of the candidates for coefficients transformable to linear predictive coefficients selected in the first and second layers becomes a result of quantization of the inputted coefficients transformable to linear predictive coefficients.

When the parameter η is small, a candidate that is the closest to the inputted coefficients transformable to linear predictive coefficients among the candidates for coefficients transformable to linear predictive coefficients and a corresponding code in the first layer are selected. In this case, the code selected in the first layer becomes a linear predictive coefficient code. That is, the linear predictive coefficient code is expressed with 10 bits. Further, the candidate for coefficients transformable to linear predictive coefficients selected in the first layer becomes a result of quantization of the inputted coefficients transformable to linear predictive coefficients.

When the code book configured with the first layer and the code book configured with the first and second layers are thought to be different code books, this example can be also said to be an example of (1) the first method.

In a case where the number of candidate/code pairs in one code book is variable, in other words, in a case where a candidate/code pair search range in one code book is variable, like the example of the code book having a multilayer structure, the candidate/code pair search range may be narrowed more as the parameter η is smaller. When sets of candidate/code pairs with different search ranges are thought to be different code books, this example can be also said to be an example of (1) the first method.

(2) Second Method

In the second method, a plurality of code books that are different in the degree of flatness of an unsmoothed spectral envelope sequence, which is a sequence obtained by raising a sequence of an amplitude spectral envelope corresponding to candidates for coefficients transformable to linear predictive coefficients stored in each code book to the power of 1/η, are stored in the code book storing part 222. Further, from among the plurality of code books stored in the code book storing part 222, the code book selecting part 223 selects such a code book that an unsmoothed spectral envelope sequence, which is a sequence obtained by raising a sequence of an amplitude spectral envelope corresponding to candidates for coefficients transformable to linear predictive coefficients stored in the code book to the power of 1/η, is flatter as η is smaller.

In general, the unsmoothed spectral envelope sequence tends to be flatter and coefficients transformable to linear predictive coefficients take more similar values, as the parameter η is smaller. For example, when coefficients transformable to linear predictive coefficients are LSP, the coefficients transformable to linear predictive coefficients, which are LSP parameters, tend to come closer to values obtained by equal division between 0 and π as the parameter η is smaller.

An example of values of LSP parameters when the parameter η takes each value is shown in FIG. 5. The horizontal axis in FIG. 5 indicates the parameter η, and the vertical axis indicates the LSP parameters. From FIG. 5, it is seen that the LSP parameters tend to come closer to the values obtained by equal division between 0 and π as the parameter η is smaller.

When coefficients transformable to linear predictive coefficients are ISP parameters, there is also a similar tendency. That is, when the coefficients transformable to linear predictive coefficients are ISP parameters, the coefficients transformable to linear predictive coefficients, which are ISP parameters, tend to come closer to the values obtained by equal division between 0 and $\pi$ as the parameter $\eta$ is smaller.

When coefficients transformable to linear predictive coefficients are PARCOR coefficients, all of the values of the coefficients transformable to linear predictive coefficients tend to be smaller as the parameter $\eta$ is smaller.

The second method is intended to cause quantization performance to be improved by performing coding and decoding using candidates for coefficients transformable to linear predictive coefficients corresponding to the case where an unsmoothed spectral envelope sequence is flatter as the parameter $\eta$ is smaller, utilizing of the above tendencies.

When it is assumed that coefficients transformable to linear predictive coefficients are LSP or PARCOR coefficients, candidates for coefficients transformable to linear predictive coefficients in a code books i (i=1, 2, . . . , I) are expressed as $\hat{\omega}_{11}[1], \hat{\omega}_{11}[2], \ldots, \hat{\omega}_{11}[p](n=1, 2, \ldots, N_i)$. Further, coefficients transformable to linear predictive coefficients corresponding to a case where the unsmoothed spectral envelope is the flattest are expressed as $\omega^F[1], \omega^F[2], \ldots, \omega^F[p]$.

In this case, the second method is realized, for example, by, on the assumption that a plurality of code books i (i=1, 2, . . . , I) that are different in the value of $S_i^1$ below are stored in the code book storing part 222, the code book selecting part 223 selecting a code book i for which the value of $S_i^1$ below is smaller as $\eta$ is smaller.

$$S_i^1=(1/pN_i)\Sigma_{n=1}^{Ni}\Sigma_{k=1}^{P}|\hat{\omega}_n[k]-\omega^F[k]|$$

In the second method also, selection of an appropriate code book may be performed on the basis of a threshold. For example, it is assumed that an unsmoothed spectral envelope sequence, which is a sequence obtained by raising a sequence of an amplitude spectral envelope corresponding to candidates for coefficients transformable to linear predictive coefficients in the first code book to the power of $1/\eta$, is flatter than an unsmoothed spectral envelope sequence, which is a sequence obtained by raising a sequence of an amplitude spectral envelope corresponding to candidates for coefficients transformable to linear predictive coefficients in the second code book to the power of $1/\eta$. In this case, one threshold for the parameter $\eta$ is set in advance. When an inputted parameter $\eta$ is smaller than the threshold, it is judged that the parameter $\eta$ is small, and the first code book is selected. When the inputted parameter $\eta$ is equal to or larger than the threshold, it is judged that the parameter $\eta$ is large, and the second code book is selected. When the number of code books is equal to or larger than three, a code book can be similarly selected using the same number of thresholds as a value obtained by subtracting one from the number of code books.

(3) Third Method

In a third method, a plurality of code books that are different in the interval between candidates for coefficients transformable to linear predictive coefficients are stored in the code book storing part 222. Further, from among the plurality of code books stored in the code book storing part 222, the code book selecting part 223 selects a code book with a narrower interval between candidates for coefficients transformable to linear predictive coefficients as $\eta$ is smaller.

As the interval between candidates for coefficients transformable to linear predictive coefficients, anything is possible if it is an indicator indicating the width of the interval between candidates for coefficients transformable to linear predictive coefficients comprised in the code book. For example, the interval between candidates for coefficients transformable to linear predictive coefficients may be an average value of distances between one candidate for coefficients transformable to linear predictive coefficients and another candidate for coefficients transformable to linear predictive coefficients, comprised in the code book or may be a maximum value, minimum value or median of the value.

As described in the first method, when the parameter $\eta$ is large, fluctuation of coefficients transformable to linear predictive coefficients tends to be large. Therefore, it is desirable to perform coding and decoding using a code book with a wider interval between candidates for coefficients transformable to linear predictive coefficients.

On the contrary, when the parameter $\eta$ is small, fluctuation of coefficients transformable to linear predictive coefficients tends to be small.

Therefore, even if coding and decoding are performed using a code book with a narrower interval between candidates for coefficients transformable to linear predictive coefficients, quantization distortion is small, and, therefore, accuracy of the coding and decoding is not so bad.

The third method utilizes this tendency.

Candidates for coefficients transformable to linear predictive coefficients in the code book i (i=1, 2, . . . , I) are expressed as $$\hat{\omega}_n[1], \hat{}[2], \ldots \hat{\omega}_n[p](n=1,2, \ldots ,N_i).$$

In this case, the third method is realized, for example, by, on the assumption that a plurality of code books i (i=1, 2, . . . , I) that are different in the value of $S_i^2$ below are stored in the code book storing part 222, the code book selecting part 223 selecting a code book i for which the value of $S_i^2$ below is smaller as $\eta$ is smaller.

$$S_i^2=(1/N_i)\Sigma_{n=1}^{Ni-1}(\Sigma_{k=1}^{P}(\hat{\omega}_n[k]-\hat{}_{n+1}[k])^2)^{1/2}$$

As in this example, the interval between candidates for coefficients transformable to linear predictive coefficients may be an average value of distances between two adjoining candidates for coefficients transformable to linear predictive coefficients comprised in the code book.

In the third method also, selection of an appropriate code book may be performed on the basis of a threshold. For example, it is assumed that the interval between candidates for coefficients transformable to linear predictive coefficients in the first code book is narrower than the interval between candidates for coefficients transformable to linear predictive coefficients in the second code book. In this case, one threshold for the parameter $\eta$ is set in advance. When an inputted parameter $\eta$ is smaller than the threshold, it is judged that the parameter $\eta$ is small, and the first code book is selected. When the inputted parameter $\eta$ is equal to or larger than the threshold, it is judged that the parameter $\eta$ is large, and the second code book is selected. When the number of code books is equal to or larger than three, a code book can be similarly selected using the same number of thresholds as a value obtained by subtracting one from the number of code books.

<Coding Part 224>

The coefficients transformable to linear predictive coefficients and obtained by the linear predictive analysis part 221 and information about the selected code book obtained by the code book selecting part 223 are inputted to the coding part 224.

Using the selected code book, the coding part 224 codes the coefficients transformable to linear predictive coefficients to obtain a linear predictive coefficient code (step DE3). The obtained linear predictive coefficient code is outputted to the decoding apparatus.

(Decoding)

An example of a linear predictive decoding apparatus and method of the second embodiment will be described.

Figure 23:
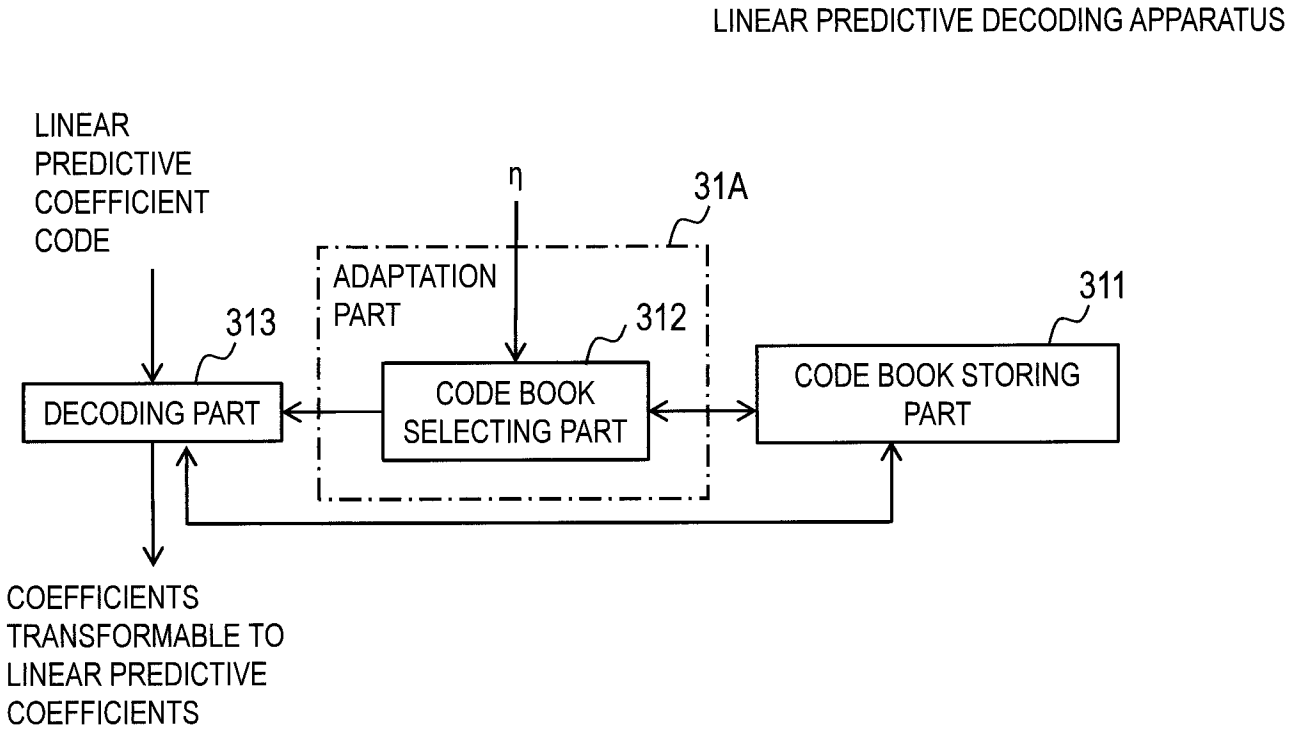
FIG. 23 is a block diagram for illustrating an example of the linear predictive decoding apparatus.
Figure 24:
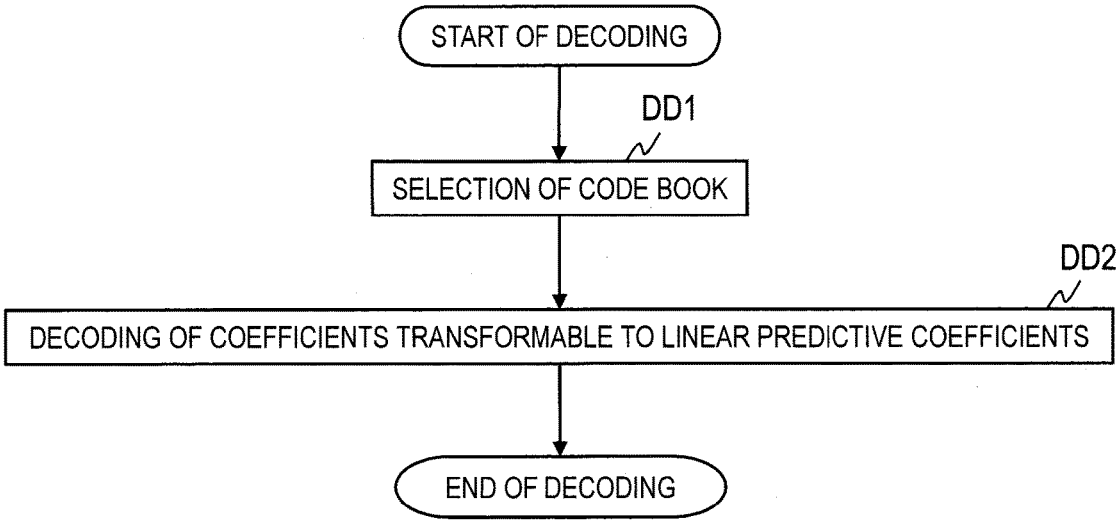
FIG. 24 is a flowchart for illustrating an example of the linear predictive decoding method.

As shown in FIG. 23, the linear predictive decoding apparatus of the second embodiment is, for example, provided with the code book storing part 311, a code book selecting part 312 and the decoding part 313. A linear predictive decoding method is realized by the parts of the linear predictive decoding apparatus performing processes illustrated in FIG. 24, respectively.

In the second embodiment, the "parameter $\eta_1$" is referred to as the "parameter $\eta$".

<Code Book Storing Part 311>

A plurality of code books are stored in the code book storing part 311.

Hereinafter, a pair of a candidate for coefficients transformable to linear predictive coefficients and a code corresponding to the candidate for coefficients transformable to linear predictive coefficients will be referred to as a candidate/code pair. A plurality of candidate/code pairs are stored in each code book. In other words, when I indicates a predetermined number equal to or more than 2, and $N_i$ is a predetermined number equal to or larger than 2 that is determined according to i, $N_i$ candidate/code pairs are stored in the code book i (i=1, 2, . . . I). A predetermined number of bits are assigned to each of codes corresponding to the candidates for coefficients transformable to linear predictive coefficients. Each code is expressed with the assigned predetermined number of bits.

When it is assumed that p is a predetermined positive number, and the order of coefficients transformable to linear predictive coefficients is p, candidates for each of the coefficients transformable to linear predictive coefficients is configured with p values.

The plurality of code books stored in the code book storing part 311 differ depending on the code book selection method of the code book selecting part 312. Therefore, an example of the plurality of code books stored in the code book storing part 311 will be described together with an example of the code book selecting part 312 to be described later.

In the code book storing part 311, the same code books as the plurality of code books stored in the code book storing part 222 are stored.

<Code Book Selecting Part 312>

A parameter is $\eta$ inputted to the code book selecting part 312. The parameter $\eta$ is obtained by decoding a parameter code. The number of parameters $\eta$ may be the same number set in advance in the linear predictive coding apparatus and the linear predictive decoding apparatus.

The code book selecting part 312 selects a code book from among the plurality of code books stored in the code book storing part 311 according to the inputted $\eta$ (step DD1). Information about the selected code book is outputted to the decoding part 313.

It is assumed that, in the code book storing part 311, the same code books as the plurality of code books stored in the code book storing part 222 are stored. Further, it is assumed that the same selection criterion as the criterion for selection of a code book by the code book selecting part 223 of the linear predictive coding apparatus is set for the code book selecting part 312 in advance. Thereby, a code book with the same content as the code book selected on the coding side is selected on the decoding side also.

As for the code book selection criterion, since description has been made on the coding side, repeated description will be omitted here.

<Decoding Part 313>

The linear predictive coefficient code outputted by the linear predictive coding apparatus and information about the selected code book obtained by the code book selecting part 312 are inputted to the decoding part 313. Further, the decoding part 313 reads a code book identified by the information about the selected code book from the code book storing part 311.

Using the selected code book, the decoding part 313 decodes the linear predictive coefficient code to obtain the coefficients transformable to linear predictive coefficients (step DD2).

The coefficients transformable to linear predictive coefficients are used to obtain an unsmoothed spectral envelope sequence, which is a sequence obtained by raising a sequence of an amplitude spectral envelope corresponding to the coefficients transformable to linear predictive coefficients to the power of $1/\eta$.

[Modification of Linear Predictive Coding Apparatus, Linear Predictive Decoding Apparatus and Methods Therefor]

If an adaptation part 22A is configured with at least one of the code book selecting part 223 and the linear transformation part 225 as shown by a long dashed short dashed line in FIGS. 1 to 3, 21 and FIGS. 25 to 27, it can be said that the adaptation part 22A has adapted at least either of a code book stored in the code book storing part 222 and coefficients transformable to linear predictive coefficients generated by the linear predictive analysis part 221, on the basis of $\eta_1$ inputted. In other words, it can be said that the adaptation part 22A adapts the values of $\eta$ for a plurality of candidates for coefficients transformable to linear predictive coefficients stored in the code book stored in the code book storing part 222 and the coefficients transformable to linear predictive coefficients obtained by the linear predictive analysis part 221. It can be also said that, for example, the adaptation part 22A transforms at least one of the coefficients transformable to linear predictive coefficients such that, in comparison with "a difference between the value of a parameter $\eta$ corresponding to the code book stored in the code book storing part 222, that is, the plurality of candidates for coefficients transformable to linear predictive coefficients and the value of a parameter $\eta$ corresponding to the coefficients transformable to linear predictive coefficients generated by the linear predictive analysis part 221" before adaptation, a difference between the values of two parameters $\eta$ after the adaptation is smaller. It can be also said that the adaptation part 22A performs adaptation so that the values of the two parameters $\eta$ are almost the same value after the adaptation. The process of the first linear transformation part 2251 of the linear transformation part 225 described in the first embodiment and the process of the code book selecting part 223 described in the second embodiment are examples of adaptation of a code book stored in the code book storing part 222. The process of the second linear transformation part 2252 of the linear transformation part 225 described in the second embodiment is an example of adaptation of coefficients transformable to linear predictive coefficients generated by the linear predictive analysis part 221.

In this case, it can be said that the coding part 224 performs coding using at least one of the code books and coefficients transformable to linear predictive coefficients adapted by the adaptation part 22A. In other words, it can be said that the coding part 224 codes the coefficients transformable to linear predictive coefficients by the linear predictive analysis part 221 or the coefficients transformable to linear predictive coefficients adapted by the adaptation part 22A, using a code book selected by the code book selecting part 223 or the code book adapted by the adaptation part 22A. Furthermore, in other words, it can be said that the coding part 224 obtains a linear predictive coefficient code corresponding to coefficients transformable to linear predictive coefficients obtained by the linear predictive analysis part 221, using the plurality of candidates for coefficients transformable to linear predictive coefficients and coefficients transformable to linear predictive coefficients for which the value of $\eta$ has been adapted.

It can be said that the adaptation part 22A in (1) the first case of the first embodiment is provided with the linear transformation part 225 that performs first linear transformation according to $\eta_1$ for candidates for coefficients transformable to linear predictive coefficients stored in the code book storing part 222 and obtains a plurality of candidates for coefficients transformable to linear predictive coefficients after the first linear transformation. In this case, it can be said that the coding part 224 obtains a linear predictive coefficient code corresponding to coefficients transformable to linear predictive coefficients obtained by the linear predictive analysis part 221, using the coefficients transformable to linear predictive coefficients obtained by the linear predictive analysis part 221 and the plurality of candidates for coefficients transformable to linear predictive coefficients after the first linear transformation obtained by the adaptation part 22A.

It can be said that the adaptation part 22A in (2) the second case of the first embodiment is provided with the linear transformation part 225 that performs second linear transformation according to for coefficients transformable to linear predictive coefficients obtained by the linear predictive analysis part 221 and obtains coefficients transformable to linear predictive coefficients after the second linear transformation. In this case, it can be said that the coding part 224 obtains a linear predictive coefficient code corresponding to the coefficients transformable to linear predictive coefficients obtained by the linear predictive analysis part 221 using the coefficients transformable to linear predictive coefficients after the second linear transformation obtained by the adaptation part 22A and the plurality of candidates for coefficients transformable to linear predictive coefficients stored in a code book.

It can be said that, on the assumption that a code book corresponding to $\eta_2$ is stored in the code book storing part 222, the adaptation part 22A of (3) the third case of the first embodiment performs first linear transformation according to $\eta_3$ for a plurality of candidates for coefficients transformable to linear predictive coefficients stored in the code book storing part 222 to obtain a plurality of candidates for coefficients transformable to linear predictive coefficients after the first linear transformation, and performs second linear transformation according to $\eta_3$ for the coefficients transformable to linear predictive coefficients obtained by the linear predictive analysis part 221 to obtain coefficients transformable to linear predictive coefficients after the second linear transformation. In this case, it can be said that the coding part 224 obtains a linear predictive coefficient code corresponding to the coefficients transformable to linear predictive coefficients obtained by the linear predictive analysis part 221, using the coefficients transformable to linear predictive coefficients after the second linear transformation obtained by the adaptation part 22A and the plurality of candidates for coefficients transformable to linear predictive coefficients after the first linear transformation obtained by the adaptation part 22A.

Figure 25:
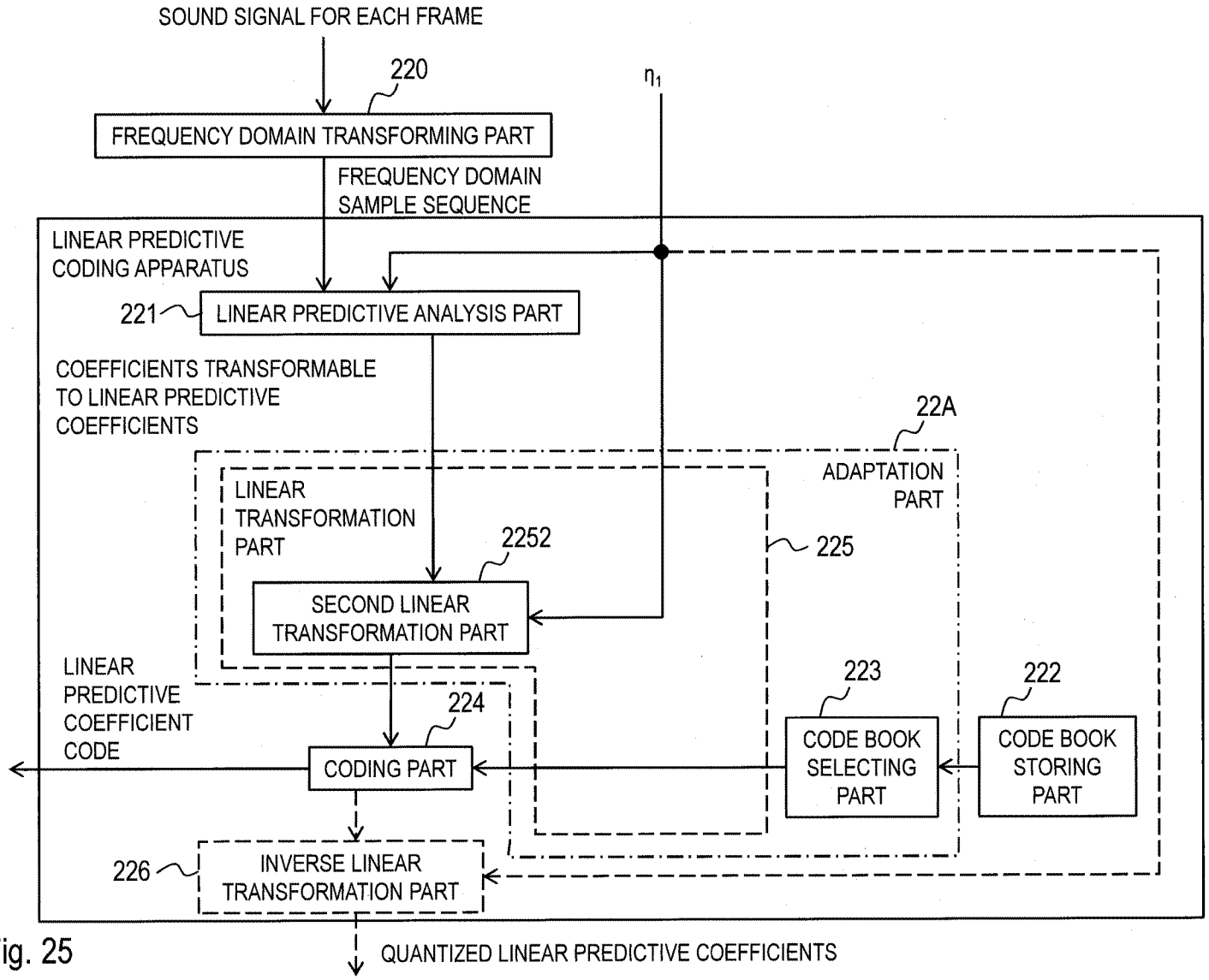
FIG. 25 is a block diagram for illustrating an example of the linear predictive coding apparatus.

The adaptation part 22A may perform adaptation of a code book, for example, by the code book selecting part 223 and the second linear transformation part 2252 shown in FIG. 25. For example, when it is assumed that a parameter $\eta_2$ is a predetermined parameter $\eta$, the code book selecting part 223 selects a code book from among the plurality of code books stored in the code book storing part 222 according to the parameter $\eta_2$. Then, the second linear transformation part 2252 performs second linear transformation according to $\eta_2$, for the coefficients transformable to linear predictive coefficients obtained by the linear predictive analysis part 221. In this case, for coefficients transformable to linear predictive coefficients after the second linear transformation, the coding part 224 performs coding using the selected code book to obtain a linear predictive coefficient code.

Figure 26:
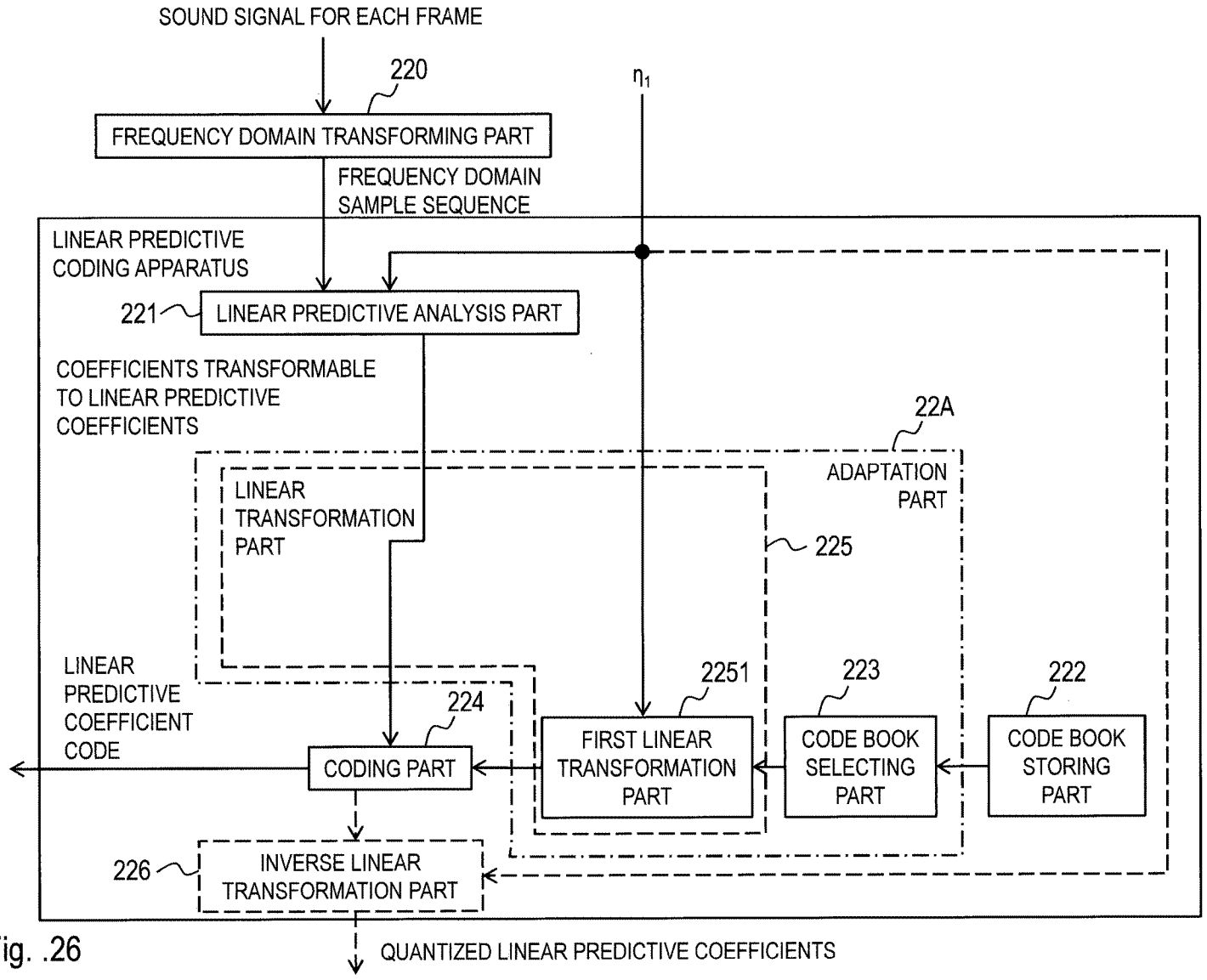
FIG. 26 is a block diagram for illustrating an example of the linear predictive coding apparatus.

The adaptation part 22A may perform adaptation of a code book, for example, by the code book selecting part 223 and the first linear transformation part 2251 shown in FIG. 26. For example, when it is assumed that a parameter $\eta_2$ is a predetermined parameter $\eta$, the code book selecting part 223 selects a code book from among the plurality of code books stored in the code book storing part 222 according to the parameter $\eta_2$. Then, the first linear transformation part 2251 performs first linear transformation according to $\eta_1$, for a plurality of candidates for coefficients transformable to linear predictive coefficients stored in the selected code book. In this case, for the coefficients transformable to linear predictive coefficients obtained by the linear predictive analysis part 221, the coding part 224 performs coding using candidates for coefficients transformable to linear predictive coefficients after the first linear transformation to obtain a linear predictive coefficient code.

Figure 27:
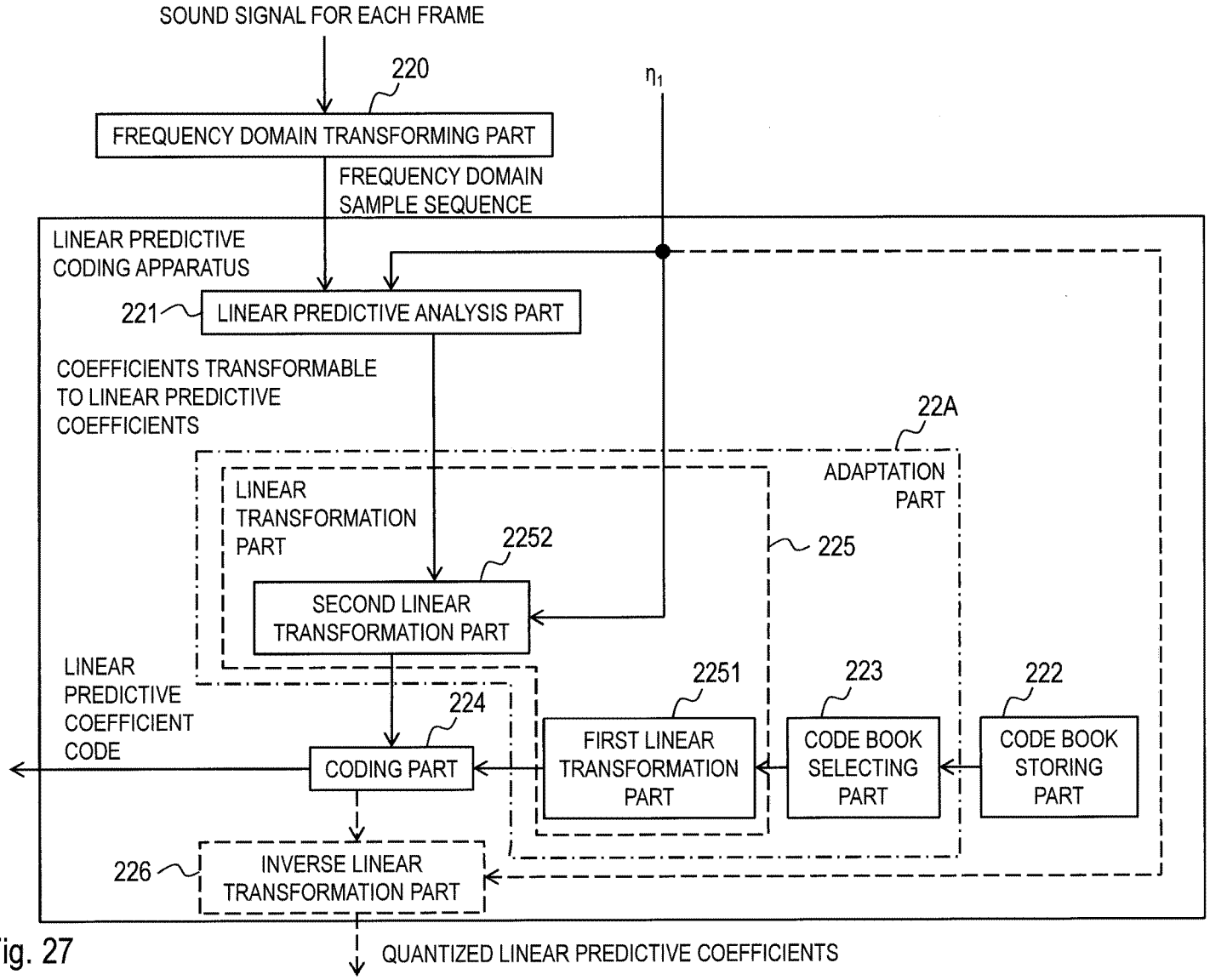
FIG. 27 is a block diagram for illustrating an example of the linear predictive coding apparatus.

The adaptation part 22A may perform adaptation of a code book, for example, by the code book selecting part 223, the first linear transformation part 2251 and the second linear transformation part 2252 shown in FIG. 27. For example, when it is assumed that the parameters $\eta_2$ and $\eta_3$ are predetermined parameters $\eta$, the code book selecting part 223 selects a code book from among the plurality of code books stored in the code book storing part 222 according to the parameter $\eta_3$. Then, the first linear transformation part 2251 performs first linear transformation according to $\eta_2$, for a plurality of candidates for coefficients transformable to linear predictive coefficients stored in the selected code book. Then, the second linear transformation part 2252 performs second linear transformation according to $\eta_2$, for the coefficients transformable to linear predictive coefficients obtained by the linear predictive analysis part 221. In this case, the coding part 224 codes coefficients transformable to linear predictive coefficients after the second linear transformation using the candidates for coefficients transformable to linear predictive coefficients after the first linear transformation to obtain a linear predictive coefficient code.

Figure 28:
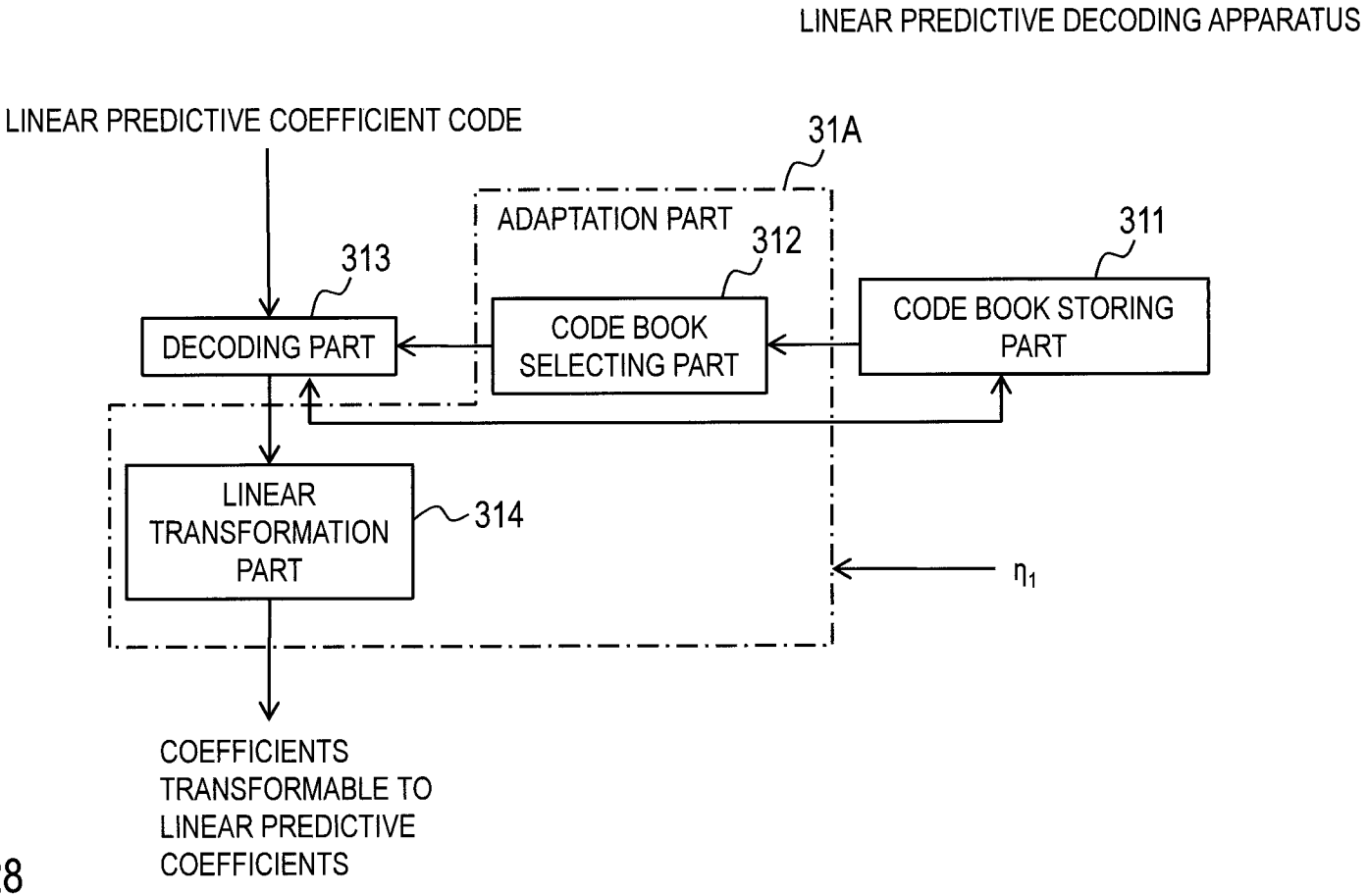
FIG. 28 is a block diagram for illustrating an example of the linear predictive decoding apparatus.

If an adaptation part 31A is configured with at least one of the code book selecting part 312 and the linear transformation part 314, and the decoding part 313 as shown by a long dashed short dashed line in FIGS. 6, 23 and 28, it can be said that the adaptation part 31A adapts at least either of a code book stored in the code book storing part 311 and a candidate for coefficients transformable to linear predictive coefficients corresponding to an inputted linear predictive coefficient code among a plurality of candidates for coefficients transformable to linear predictive coefficients stored in the code book, on the basis of inputted $\eta_1$, the being a positive number.

The adaptation part 31A may perform the adaptation process, for example, in both of the code book selecting part 312 and the linear transformation part 314 shown in FIG. 28. For example, when it is assumed that a parameter $\eta_2$ is a positive number, the code book selecting part 312 selects a code book from among a plurality of code books stored in the code book storing part 311 according to the parameter $\eta_2$. Then, the linear transformation part 314 performs linear transformation according to $\eta_1$, which is a predetermined positive number, for the coefficients transformable to linear predictive coefficients obtained by the decoding part 313 to obtain coefficients transformable to linear predictive coefficients.

[Coding Apparatus, Decoding Apparatus and Methods Therefor]

An example of a coding apparatus, a decoding apparatus and methods therefor, for which a linear predicting coding apparatus, a linear predictive decoding apparatus and methods therefor are used, will be described below.

First Embodiment of Coding Apparatus, Decoding Apparatus and Methods Therefor (Coding)

Figure 8:
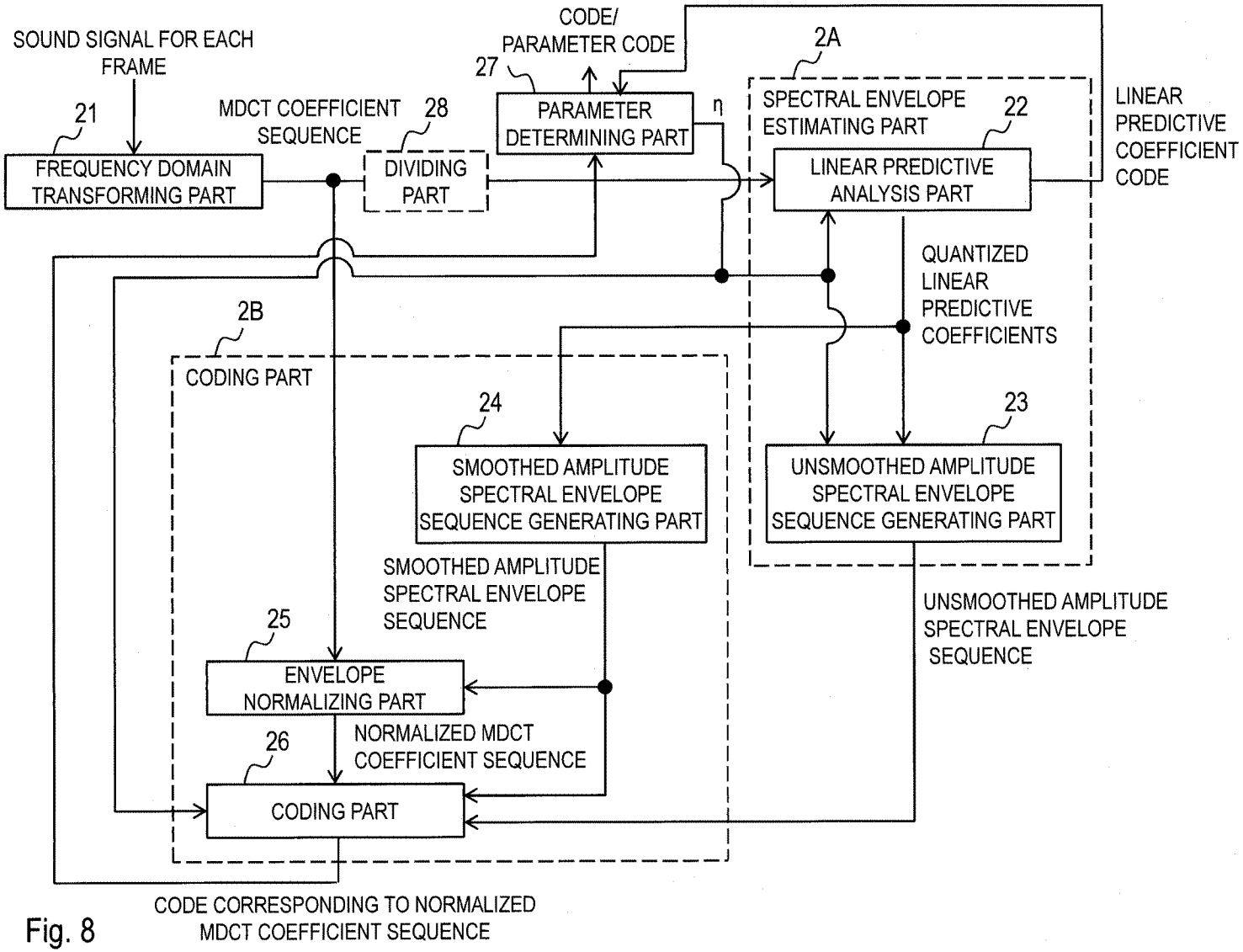
FIG. 8 is a block diagram for illustrating an example of a coding apparatus.
Figure 9:
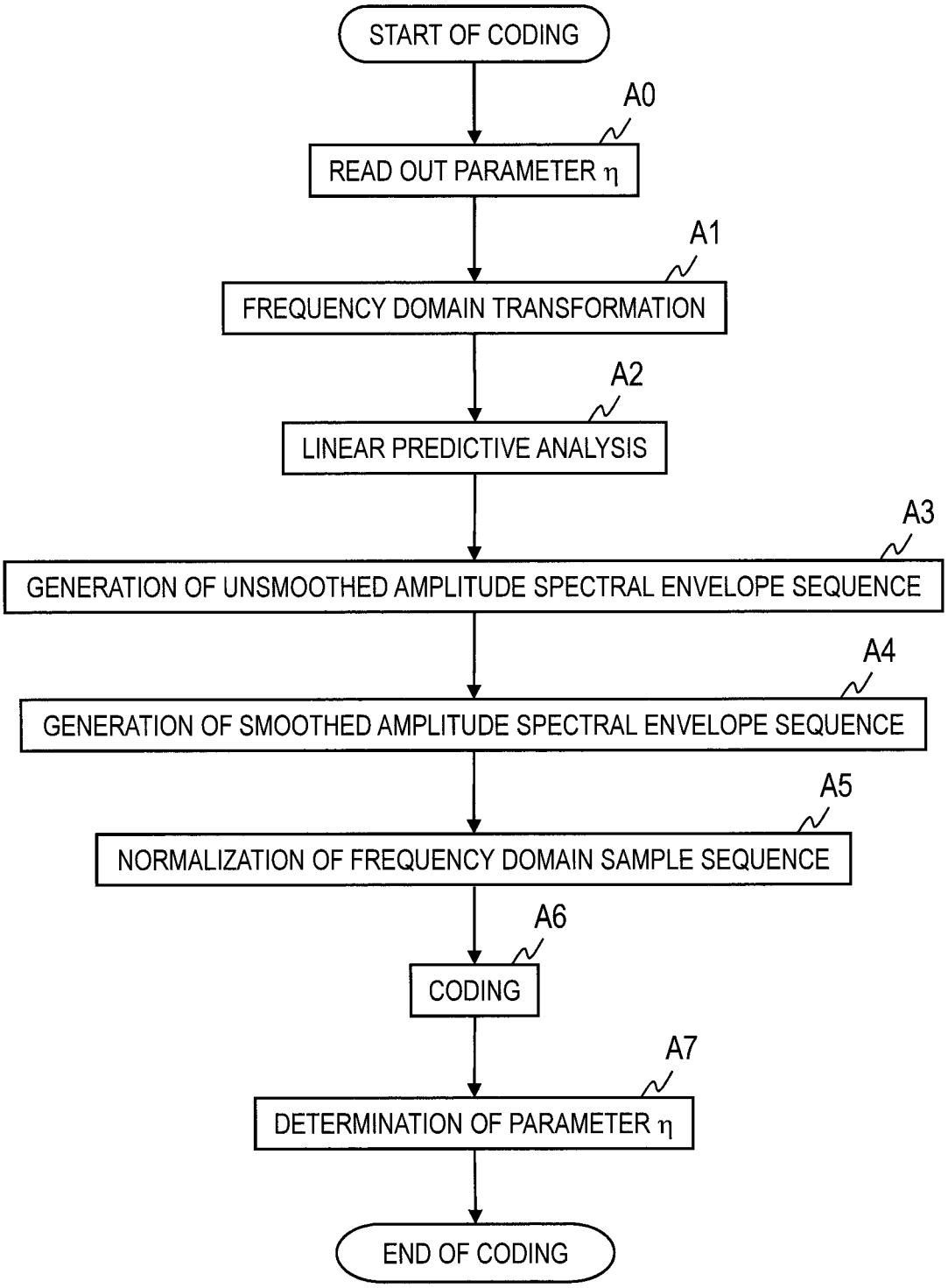
FIG. 9 is a flowchart for illustrating an example of a coding method.

A configuration example of a coding apparatus of a first embodiment is shown in FIG. 8. As shown in FIG. 8, the coding apparatus of the first embodiment is, for example, provided with a frequency domain transforming part 21, a linear predictive analysis part 22, an unsmoothed amplitude spectral envelope sequence generating part 23, a smoothed amplitude spectral envelope sequence generating part 24, an envelope normalizing part 25, a coding part 26 and a parameter determining part 27. An example of each process of a coding method of the first embodiment realized by this coding apparatus is shown in FIG. 9.

Each part in FIG. 8 will be described below.

<Parameter Determining Part 27>

In the first embodiment, any of a plurality of parameters $\eta$ can be selected for each predetermined time interval by the parameter determining part 27.

It is assumed that the plurality of parameters $\eta$ are stored in the parameter determining part 27 as candidates for the parameter $\eta$. The parameter determining part 27 sequentially reads out one parameter $\eta$ among the plurality of parameters and outputs the parameter $\eta$ to the linear predictive analysis part 22, the unsmoothed amplitude spectral envelope sequence generating part 23 and the coding part 26 (step A0).

The frequency domain transforming part 21, the linear predictive analysis part 22, the unsmoothed amplitude spectral envelope sequence generating part 23, the smoothed amplitude spectral envelope sequence generating part 24, the envelope normalizing part 25 and the coding part 26 perform, for example, processes from step A1 to step A6 described below on the basis of each of parameters $\eta$ sequentially read out by the parameter determining part 27 to generate a code for a frequency domain sample sequence corresponding to a time-series signal in the same predetermined time interval. In general, there may be a case where, when a predetermined parameter $\eta$ is given, two or more codes are obtained for a frequency domain sample sequence corresponding to a time-series signal in the same predetermined time interval. In this case, a code for the frequency domain sample sequence corresponding to the time-series signal in the same predetermined time interval is an integration of the obtained two or more codes. In this example, the code is a combination of a linear predictive coefficient code, a gain code and an integer signal code. Thereby, a code for each parameter $\eta$, for a frequency domain sample sequence corresponding to the time-series signal in the same predetermined time interval is obtained.

After the process of step A6, the parameter determining part 27 selects one code from among the codes obtained for the parameters $\eta$, respectively, for the frequency domain sample sequence corresponding to the time-series signal in the same predetermined time interval, and decides a parameter $\eta$ corresponding to the selected code (step A7). The determined parameter $\eta$ becomes a parameter $\eta$ for the frequency domain sample sequence corresponding to the time-series signal in the same predetermined time interval. Then, the parameter determining part 27 outputs the selected code and a code indicating the determined parameter $\eta$ to the decoding apparatus. Details of the process of step A7 by the parameter determining part 27 will be described later.

Hereinafter, it is assumed that one parameter $\eta_1$ has been read out by the parameter determining part 27, and a process is performed for the read out one parameter $\eta_1$.

<Frequency Domain Transforming Part 21>

A sound signal, which is a time domain time-series signal, is inputted to the frequency domain transforming part 21. An example of the sound signal is a voice digital signal or an acoustic digital signal.

The frequency domain transforming part 21 transforms the inputted time domain sound signal to an MDCT coefficient sequence X(0), X(1), . . . , X(N−1) at N points in a frequency domain for each frame with a predetermined time length (step A1). Here, N is a positive integer.

The obtained MDCT coefficient sequence X(0), X(1), . . . , X(N−1) is outputted to the linear predictive analysis part 22 and the envelope normalizing part 25.

It is assumed that subsequent processes are performed for each frame unless otherwise stated.

In this way, the frequency domain transforming part 21 determines a frequency domain sample sequence, which is, for example, an MDCT coefficient sequence, corresponding to the sound signal.

<Linear Predictive Analysis Part 22>

The MDCT coefficient sequence X(0), X(1), . . . , X(N−1) obtained by the frequency domain transforming part 21 is inputted to the linear predictive analysis part 22.

The linear predictive analysis part 22 is the linear predictive coding apparatus in any of FIGS. 1 to 3 and FIG. 21 described in [Linear predictive coding apparatus, linear predictive decoding apparatus and methods therefor]. In [Coding apparatus, decoding apparatus and methods therefor] and FIG. 8, the linear predictive coding apparatus in any of FIGS. 1 to 3 and FIG. 21 described in [Linear predictive coding apparatus, linear predictive decoding apparatus and methods therefor] will be referred to as "the linear predictive analysis part 22". The linear predictive analysis part 22 may be the linear predictive coding apparatus in any of FIGS. 25 to 27.

The linear predictive analysis part 22 performs linear predictive analysis using a pseudo correlation function signal sequence obtained by performing inverse Fourier transform regarding the $\eta_1$-th power of absolute values of a frequency domain sample sequence, which is, for example, an MDCT coefficient sequence, as a power spectrum, by a process similar to the process described in [Linear predictive coding apparatus, linear predictive decoding apparatus and methods therefor] to obtain coefficients transformable to linear predictive coefficients, and codes the obtained coefficients transformable to linear predictive coefficients to obtain a linear predictive coefficient code.

The obtained linear predictive coefficient code is outputted to the parameter determining part 27 and the decoding apparatus.

Further, when the linear transformation part 225 of the linear predictive coding apparatus is in (1) the first case, coefficients transformable to linear predictive coefficients corresponding to the parameter $\eta_1$, corresponding to the linear predictive coefficient code obtained by the coding part 224 are outputted to the unsmoothed amplitude spectral envelope sequence generating part 23 and the smoothed amplitude spectral envelope sequence generating part 24 as quantized linear predictive coefficients $\hat{\beta}_1, \hat{\beta}_2, \ldots, \hat{\beta}_p$.

When the linear transformation part 225 of the linear predictive coding apparatus is in (2) the second case, coefficients transformable to linear predictive coefficients corresponding to the parameter $\eta_2$, corresponding to the linear predictive coefficient code obtained by the coding part 224 are inputted to the inverse linear transformation part 226 shown by a broken line in FIG. 2. The inverse linear transformation part 226 performs linear transformation reverse to the second linear transformation performed by the second linear transformation part 2252, for the coefficients transformable to linear predictive coefficients corresponding to the parameter $\eta_2$, corresponding to the linear predictive coefficient code to obtain coefficients transformable to linear predictive coefficients corresponding to the parameter $\eta_1$. The coefficients transformable to linear predictive coefficients corresponding to the parameter $\eta_1$ are outputted to the unsmoothed amplitude spectral envelope sequence generating part 23 and the smoothed amplitude spectral envelope sequence generating part 24 as the quantized linear predictive coefficients $\hat{\beta}_1, \hat{\beta}_2, \ldots, \hat{\beta}_p$. When the values of the parameter $\eta_1$ and the parameter $\eta_{12}$ are the same, the inverse linear transformation part 226 may not perform the linear transformation.

When the linear transformation part 225 of the linear predictive coding apparatus is in (3) the third case, coefficients transformable to linear predictive coefficients corresponding to the parameter $\eta_3$, corresponding to the linear predictive coefficient code obtained by the coding part 224 are inputted to the inverse linear transformation part 226 shown by a broken line in FIG. 3. The inverse linear transformation part 226 performs linear transformation reverse to second linear transformation performed by the second linear transformation part 2252, for the coefficients transformable to linear predictive coefficients corresponding to the parameter $\eta_3$, corresponding to the linear predictive coefficient code to obtain coefficients transformable to linear predictive coefficients corresponding to the parameter $\eta_1$. The coefficients transformable to linear predictive coefficients corresponding to the parameter $\eta_1$ are outputted to the unsmoothed amplitude spectral envelope sequence generating part 23 and the smoothed amplitude spectral envelope sequence generating part 24 as the quantized linear predictive coefficients $\hat{\beta}_1, \hat{\beta}_2, \ldots, \hat{\beta}_p$. When the values of the parameter $\eta_1$ and the parameter $\eta_3$ are the same, the inverse linear transformation part 226 may not perform the linear transformation.

During the linear predictive analysis process, predictive residual energy $\sigma^2$ is calculated. In this case, the calculated predictive residual energy $\sigma^2$ is outputted to a variance parameter determining part 268 of the coding part 26.

<Unsmoothed Amplitude Spectral Envelope Sequence Generating Part 23>

The quantized linear predictive coefficients $\hat{\beta}_1, \hat{\beta}_2, \ldots, \hat{\beta}_p$ generated by the linear predictive analysis part 22 are inputted to the unsmoothed amplitude spectral envelope sequence generating part 23.

The unsmoothed amplitude spectral envelope sequence generating part 23 generates an unsmoothed amplitude spectral envelope sequence $\hat{H}(0), \hat{H}(1), \ldots, \hat{H}(N-1)$, which is a sequence of an amplitude spectral envelope corresponding to the quantized linear predictive coefficients $\hat{\beta}_1, \hat{\beta}_2, \ldots, \hat{\beta}_p$ (step A3).

The generated unsmoothed amplitude spectral envelope sequence $\hat{H}(0), \hat{H}(1), \ldots, \hat{H}(N-1)$ is outputted to the coding part 26.

The unsmoothed amplitude spectral envelope sequence generating part 23 generates an unsmoothed amplitude spectral envelope sequence $\hat{H}(0), \hat{H}(1), \ldots, \hat{H}(N-1)$ explicitly defined by an expression (A2) as the unsmoothed amplitude spectral envelope sequence $\hat{H}(0), \hat{H}(1), \ldots, \hat{H}(N-1)$ using the quantized linear predictive coefficients $\hat{\beta}_1, \hat{\beta}_2, \ldots, \hat{\beta}_p$.

[Expression 4]

$$\hat{H}(k) = \left( \frac{1}{2\pi} \frac{1}{\left| 1 + \sum_{n=1}^{p} \hat{\beta}_n \exp(-j2\pi kn/N) \right|^2} \right)^{1/\eta} \tag{A2}$$

In this way, the unsmoothed amplitude spectral envelope sequence generating part 23 performs estimation of a spectral envelope by obtaining an unsmoothed spectral envelope sequence, which is a sequence obtained by raising a sequence of an amplitude spectral envelope corresponding to the coefficients transformable to linear predictive coefficients generated by the linear predictive analysis part 22 to the power of $1/\eta_1$. Here, when it is assumed that c is an arbitrary number, a sequence obtained by raising a sequence configured by a plurality of values to the power of c means a sequence configured by values obtained by raising the plurality of values to the power of c, respectively. For example, a sequence obtained by raising a sequence of an amplitude spectral envelope to the power of $1/\eta_1$ means a sequence configured by values obtained by raising coefficients of the amplitude spectral envelope to the power of $1/\eta_1$, respectively.

The process of raising to the power of $1/\eta_1$ by the unsmoothed amplitude spectral envelope sequence generating part 23 is due to the process performed by the linear predictive analysis part 22 in which the $\eta_1$-th power of absolute values of a frequency domain sample sequence are regarded as a power spectrum. That is, the process of raising to the power of $1/\eta_1$ by the unsmoothed amplitude spectral envelope sequence generating part 23 is performed in order to return the values raised to the power of $\eta_1$ by the process performed by the linear predictive analysis part 22 in which the $\eta_1$-th power of absolute values of a frequency domain sample sequence are regarded as a power spectrum, to the original values.

<Smoothed Amplitude Spectral Envelope Sequence Generating Part 24>

The quantized linear predictive coefficients $\hat{\beta}_1, \hat{}_2, \ldots, \hat{}_p$ generated by the linear predictive analysis part 22 are inputted to the smoothed amplitude spectral envelope sequence generating part 24.

The smoothed amplitude spectral envelope sequence generating part 24 generates a smoothed amplitude spectral envelope sequence $\hat{H}\gamma(0), \hat{H}\gamma(1), \ldots, \hat{H}\gamma(N-1)$, which is a sequence obtained by reducing amplitude unevenness of a sequence of an amplitude spectral envelope corresponding to the quantized linear predictive coefficients $\hat{\beta}_1, \hat{\beta}_2, \ldots, \hat{\beta}_p$ (step A4).

The generated smoothed amplitude spectral envelope sequence $\hat{H}\gamma(0), \hat{H}\gamma(1), \ldots, \hat{H}\gamma(N-1)$ is outputted to the envelope normalizing part 25 and the coding part 26.

The smoothed amplitude spectral envelope sequence generating part 24 generates a smoothed amplitude spectral envelope sequence $\hat{H}\gamma(0), \hat{H}\gamma(1), \ldots, \hat{H}\gamma(N-1)$ explicitly defined by an expression (A3) as the smoothed amplitude spectral envelope sequence $\hat{H}\gamma(0), \hat{H}\gamma(1), \ldots, \hat{H}\gamma(N-1)$ using the quantized linear predictive coefficients $\hat{\beta}_1, \hat{\beta}_2, \ldots, \hat{\beta}_p$ and a correction coefficient $\gamma$.

[Expression 5]

$$\hat{H}_\gamma(k) = \left( \frac{1}{2\pi} \frac{1}{\left| 1 + \sum_{n=1}^{p} \hat{\beta}_n \gamma^n \exp(-j2\pi kn/N) \right|^2} \right)^{1/\eta} \tag{A3}$$

Here, the correction coefficient $\gamma$ is a constant smaller than 1 specified in advance and is a coefficient that reduces amplitude unevenness of the unsmoothed amplitude spectral envelope sequence $\hat{H}(0), \hat{H}(1), \ldots, \hat{H}(N-1)$, in other words, a coefficient that smooths the unsmoothed amplitude spectral envelope sequence $\hat{H}(0), \hat{H}(1), \ldots, \hat{H}(N-1)$.

<Envelope Normalizing Part 25>

The MDCT coefficient sequence $X(0), X(1), \ldots, X(N-1)$ obtained by the frequency domain transforming part 21 and the smoothed amplitude spectral envelope sequence $\hat{H}\gamma(0), \hat{H}\gamma(1), \ldots, \hat{H}\gamma(N-1)$ generated by the smoothed amplitude spectral envelope generating part 24 are inputted to the envelope normalizing part 25.

The envelope normalizing part 25 generates a normalized MDCT coefficient sequence $X_N(0), X_N(1), \ldots, X_N(N-1)$ by normalizing each coefficient of the MDCT coefficient sequence $X(0), X(1), \ldots, X(N-1)$ by a corresponding value of the smoothed amplitude spectral envelope sequence $\hat{H}\gamma(0), \hat{H}\gamma(1), \ldots, \hat{H}\gamma(N-1)$ (step A5).

The generated normalized MDCT coefficient sequence is outputted to the coding part 26.

The envelope normalizing part 25 generates each coefficient $X_N(k)$ of the normalized MDCT coefficient sequence $X_N(0), X_N(1), \ldots, X_N(N-1)$ by dividing each coefficient $X(k)$ of the MDCT coefficient sequence $X(0), X(1), \ldots, X(N-1)$ by the smoothed amplitude spectral envelope sequence $\hat{H}\gamma(0), \hat{H}\gamma(1), \ldots, \hat{H}\gamma(N-1)$, for example, on the assumption of $k=0, 1, \ldots, N-1$. That is, $X_N(k)=X(k)/\hat{H}\gamma(k)$ is satisfied on the assumption of $k=0, 1, \ldots, N-1$.

<Coding Part 26>

The normalized MDCT coefficient sequence $X_N(0), X_N(1), \ldots, X_N(N-1)$ generated by the envelope normalizing part 25, the unsmoothed amplitude spectral envelope sequence $\hat{H}(0), \hat{H}(1), \ldots, \hat{H}(N-1)$ generated by the unsmoothed amplitude spectral envelope sequence generating part 23, the smoothed amplitude spectral envelope sequence $\hat{H}\gamma(0), \hat{H}\gamma(1), \ldots, \hat{H}\gamma(N-1)$ generated by the smoothed amplitude spectral envelope generating part 24 and the predictive residual energy $\sigma^2$ calculated by the linear predictive analysis part 22 are inputted to the coding part 26.

Figure 12:
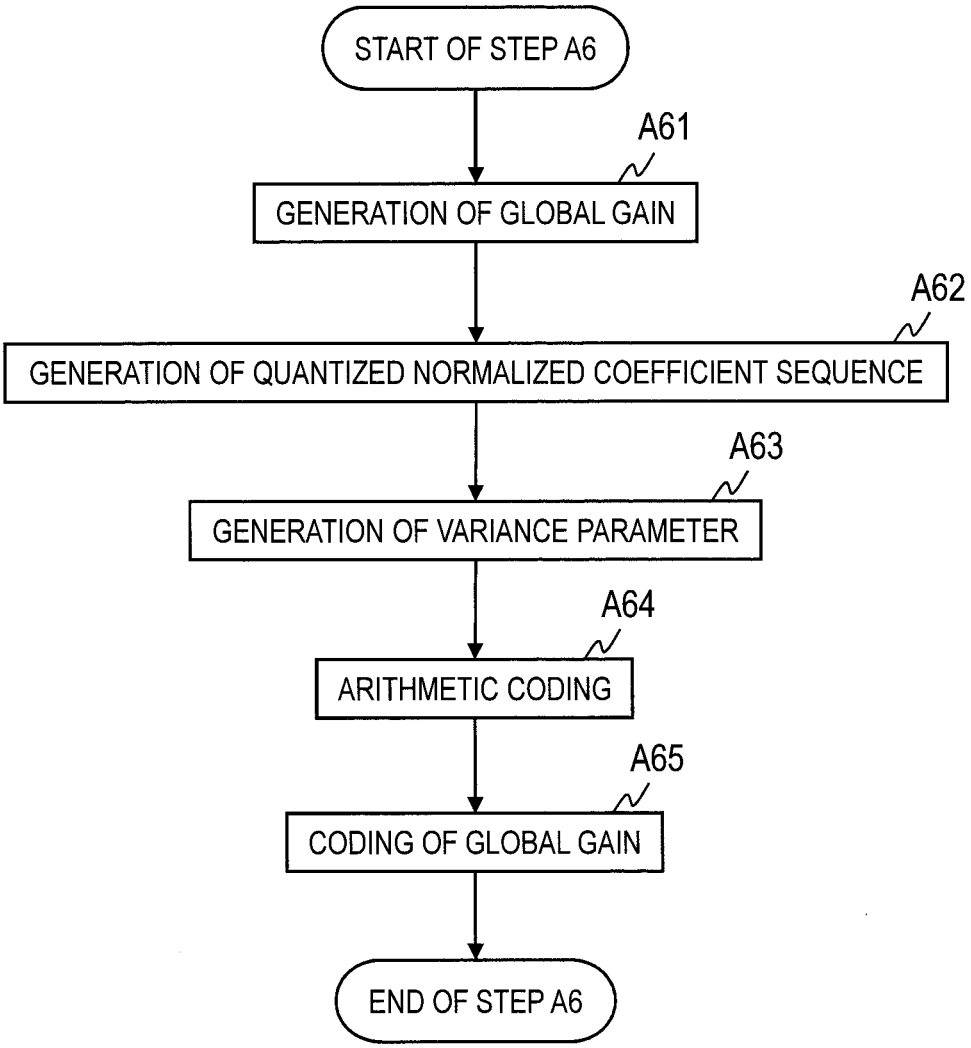
FIG. 12 is a flowchart for illustrating an example of a process of the coding part.

The coding part 26 performs coding, for example, by performing processes of steps A61 to A65 shown in FIG. 12 (step A6).

The coding part 26 determines a global gain g corresponding to the normalized MDCT coefficient sequence $X_N(0), X_N(1), \ldots, X_N(N-1)$ (step A61), determines a quantized normalized coefficient sequence $X_Q(0), X_Q(1), \ldots, X_Q(N-1)$, which is a sequence of integer values obtained by quantizing a result of dividing each coefficient of the normalized MDCT coefficient sequence $X_N(0), X_N(1), \ldots, X_N(N-1)$ by the global gain g (step A62), determines variance parameters $\varphi(0), \varphi(1), \ldots \varphi(N-1)$ corresponding to coefficients of the quantized normalized coefficient sequence $X_Q(0), X_Q(1), \ldots, X_Q(N-1)$, respectively, from the global gain g, the unsmoothed amplitude spectral envelope sequence $\hat{H}(0), \hat{H}(1), \ldots, \hat{H}(N-1)$, the smoothed amplitude spectral envelope sequence $\hat{H}\gamma(0), \hat{H}\gamma(1), \ldots, \hat{H}\gamma(N-1)$ and the average residual energy $\sigma^2$ by an expression (A1) (step A63), performs arithmetic coding of the quantized normalized coefficient sequence $X_Q(0), X_Q(1), \ldots, X_Q(N-1)$ using the variance parameters $\varphi(0), \varphi(1), \ldots \varphi(N-1)$ to obtain an integer signal code (step A64) and obtains a gain code corresponding to the global gain g (step A65).

[Expression 6]

$$\phi(k) = \eta^{1/\eta} B(\eta) \hat{H}_N(k) \frac{\sigma^{2/\eta}}{g} \tag{A1}$$

Here, a normalized amplitude spectral envelope sequence $\hat{H}_N(0), \hat{H}_N(1), \ldots, \hat{H}_N$ in the above expression (A1) is what is obtained by dividing each value of the unsmoothed amplitude spectral envelope sequence $\hat{H}(0), \hat{H}(1), \ldots, \hat{H}(N-1)$ by a corresponding value of the smoothed amplitude spectral envelope sequence $\hat{H}\gamma(0), \hat{H}\gamma(1), \ldots, \hat{H}\gamma(N-1)$, that is, what is determined by the following expression (A8).

[Expression 7]

$$\hat{H}_N(k) = \frac{\hat{H}(k)}{\hat{H}_\gamma(k)}, k = 0, 1, \ldots, N-1 \tag{A8}$$

The generated integer signal code and gain code are outputted to the parameter determining part 27 as codes corresponding to the normalized MDCT coefficient sequence.

The coding part 26 realizes a function of determining such a global gain g that the number of bits of the integer signal code is equal to or smaller than the number of allocated bits B, which is the number of bits allocated in advance, and is as large as possible, and generating a gain code corresponding to the determined global gain g and an integer signal code corresponding to the determined global gain g by the above steps A61 to A65.

Among steps A61 to A65 performed by the coding part 26, it is step A63 that comprises a characteristic process. As for the coding process itself that is for obtaining the code corresponding to the normalized MDCT coefficient sequence by coding each of the global gain g and the quantized normalized coefficient sequence $X_Q(0)$, $X_Q(1)$, . . . , $X_Q(N-1)$, various publicly-known techniques including the technique described in Non-patent literature 1 exist. Two specific examples of the coding process performed by the coding part 26 will be described below.

Specific Example 1 of Coding Process Performed by Coding Part 26

As a specific example 1 of the coding process performed by the coding part 26, an example that does not comprise a loop process will be described.

Figure 10:
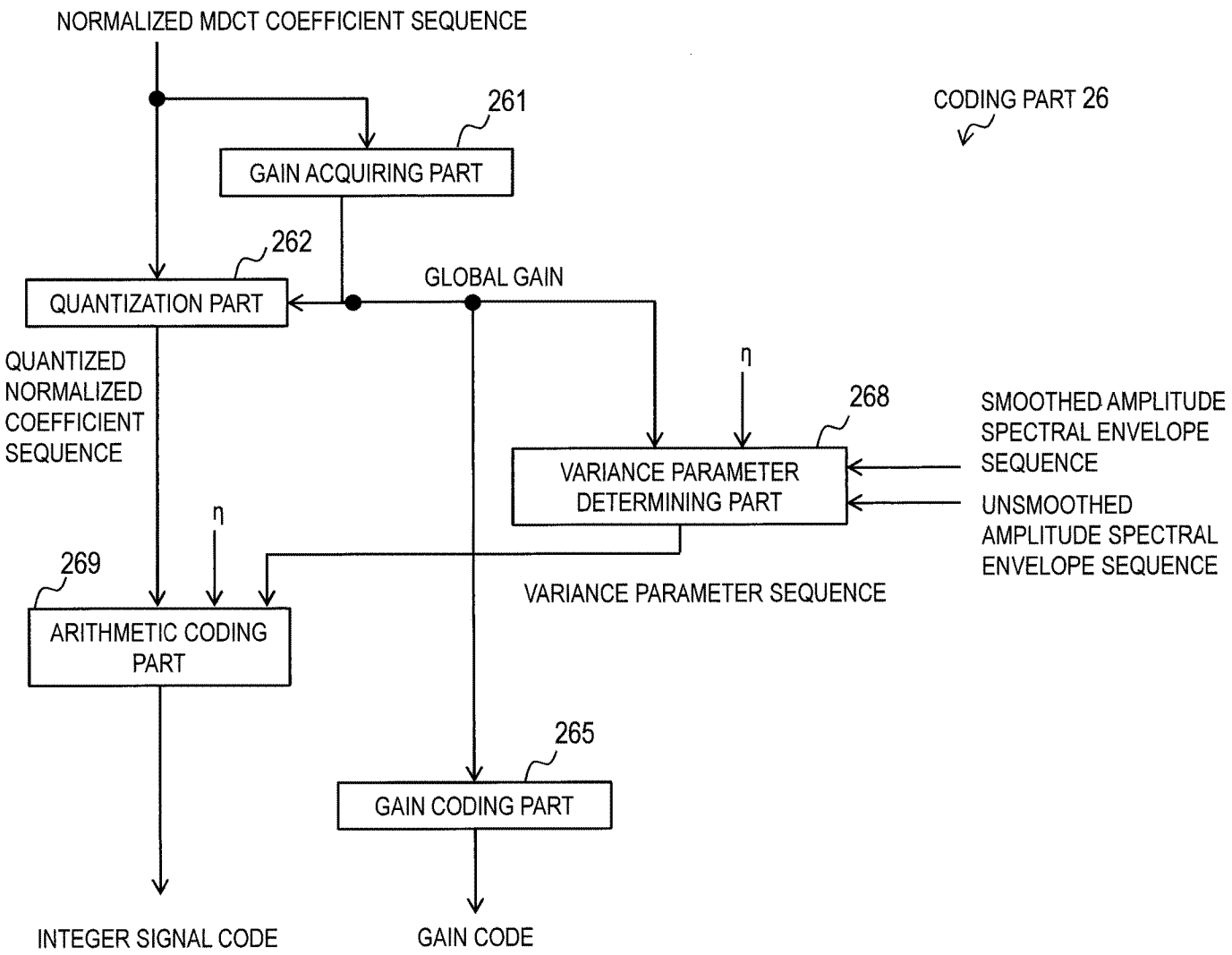
FIG. 10 is a block diagram for illustrating an example of a coding part.

A configuration example of the coding part 26 of the specific example 1 is shown in FIG. 10. As shown in FIG. 10, the coding part 26 of the specific example 1 is, for example, provided with a gain acquiring part 261, a quantization part 262, a variance parameter determining part 268, an arithmetic coding part 269 and a gain coding part 265. Each part in FIG. 10 will be described below.

<Gain Acquiring Part 261>

The normalized MDCT coefficient sequence $X_N(0)$, $X_N(1)$, . . . , $X_N(N-1)$ generated by the envelope normalizing part 25 is inputted to the gain acquiring part 261.

The gain acquiring part 261 decides and outputs such a global gain g that the number of bits of an integer signal code is equal to or smaller than the number of allocated bits B, which is the number of bits allocated in advance, and is as large as possible, from the normalized MDCT coefficient sequence $X_N(0)$, $X_N(1)$, . . . , $X_N(N-1)$ (step S261). For example, the gain acquiring part 261 acquires and outputs a value of multiplication of a square root of the total of energy of the normalized MDCT coefficient sequence $X_N(0)$, $X_N(1)$, . . . , $X_N(N-1)$ by a constant that is in negative correlation with the number of allocated bits B as the global gain g. Otherwise, the gain acquiring part 261 may tabulate relationships among the total of energy of the normalized MDCT coefficient sequence $X_N(0)$, $X_N(1)$, . . . , $X_N(N-1)$, the number of allocated bits B and the global gain g in advance, and obtain and output a global gain g by referring to the table.

In this way, the gain acquiring part 261 obtains a gain for performing division of all samples of a normalized frequency domain sample sequence that is, for example, a normalized MDCT coefficient sequence.

The obtained global gain g is outputted to the quantization part 262 and the variance parameter determining part 268.

<Quantization Part 262>

The normalized MDCT coefficient sequence $X_N(0)$, $X_N(1)$, . . . , $X_N(N-1)$ generated by the envelope normalizing part 25 and the global gain g obtained by the gain acquiring part 261 are inputted to the quantization part 262.

The quantization part 262 obtains and outputs a quantized normalized coefficient sequence $X_Q(0)$, $X_Q(1)$, . . . , $X_Q(N-1)$, which is a sequence of an integer part of a result of dividing each coefficient of the normalized MDCT coefficient sequence $X_N(0)$, $X_N(1)$, . . . , $X_N(N-1)$ by the global gain g (step S262).

In this way, the quantization part 262 determines a quantized normalized coefficient sequence by dividing each sample of a normalized frequency domain sample sequence that is, for example, a normalized MDCT coefficient sequence by a gain and quantizing the result.

The obtained quantized normalized coefficient sequence $X_Q(0)$, $X_Q(1)$, . . . , $X_Q(N-1)$ is outputted to the arithmetic coding part 269.

<Variance Parameter Determining Part 268>

The parameter $\eta_1$ read out by the parameter determining part 27, the global gain g obtained by the gain acquiring part 261, the unsmoothed amplitude spectral envelope sequence $\hat{H}(0)$, $\hat{H}(1)$, . . . , $\hat{H}(N-1)$ generated by the unsmoothed amplitude spectral envelope sequence generating part 23, the smoothed amplitude spectral envelope sequence $\hat{H}\gamma(0)$, $\hat{H}\gamma(1)$, . . . , $\hat{H}\gamma(N-1)$ generated by the smoothed amplitude spectral envelope generating part 24, and the predictive residual energy $\sigma^2$ obtained by the linear predictive analysis part 22 are inputted to the variance parameter determining part 268.

The variance parameter determining part 268 obtains and outputs each variance parameter of a variance parameter sequence $\varphi(0)$, $\varphi(1)$, . . . , $\varphi(N-1)$ from the global gain g, the unsmoothed amplitude spectral envelope sequence $\hat{H}(0)$, $\hat{H}(1)$, . . . , $\hat{H}(N-1)$, the smoothed amplitude spectral envelope sequence $\hat{H}\gamma(0)$, $\hat{H}\gamma(1)$, . . . , $\hat{H}\gamma(N-1)$ and the predictive residual energy $\sigma^2$ by the above expressions (A1) and (A8) (step S268).

The obtained variance parameter sequence $\varphi(0)$, $\varphi(1)$, . . . , $\varphi(N-1)$ is outputted to the arithmetic coding part 269.

<Arithmetic Coding Part 269>

The parameter $\eta_1$ read out by the parameter determining part 27, the quantized normalized coefficient sequence $X_Q(0)$, $X_Q(1)$, . . . , $X_Q(N-1)$ obtained by the quantization part 262 and the variance parameter sequence $\varphi(0)$, $\varphi(1)$, . . . , $\varphi(N-1)$ obtained by the variance parameter determining part 268 are inputted to the arithmetic coding part 269.

The arithmetic coding part 269 performs arithmetic coding of the quantized normalized coefficient sequence $X_Q(0)$, $X_Q(1)$, . . . , $X_Q(N-1)$ using variance parameters of the variance parameter sequence $\varphi(0)$, $\varphi(1)$, . . . , $\varphi(N-1)$ as variance parameters corresponding to coefficients of the quantized normalized coefficient sequence $X_Q(0)$, $X_Q(1)$, . . . , $X_Q(N-1)$, respectively, to obtain and output an integer signal code (step S269).

At the time of performing arithmetic coding, the arithmetic coding part 269 configures such an arithmetic code that each coefficient of the quantized normalized coefficient sequence $X_Q(0)$, $X_Q(1)$, . . . , $X_Q(N-1)$ becomes optimal when being in accordance with generalized Gaussian distribution $f_{GG}(X|\varphi(k), \eta_1)$ and performs coding with the arithmetic code based on this configuration. As a result, an expected value of bit allocation to each coefficient of the quantized normalized coefficient sequence $X_Q(0)$, $X_Q(1)$, . . . , $X_Q(N-1)$ is determined with the variance parameter sequence $\varphi(0)$, $\varphi(1)$, . . . , $\varphi(N-1)$.

The obtained integer signal code are outputted to the parameter determining part 27.

Arithmetic coding may be performed over a plurality of coefficients in the quantized normalized coefficient sequence $X_Q(0)$, $X_Q(1)$, . . . , $X_Q(N-1)$. In this case, since each variance parameter of the variance parameter sequence $\varphi(0)$, $\varphi(1)$, . . . , $\varphi(N-1)$ is based on the unsmoothed amplitude spectral envelope sequence $\hat{H}(0)$, $\hat{H}(1)$, . . . , $\hat{H}(N-1)$ as seen from the expressions (A1) and (A8), it can be said that the arithmetic coding part 269 performs such coding that bit allocation substantially changes on the basis of an estimated spectral envelope (an unsmoothed amplitude spectral envelope).

<Gain Coding Part 265>

The global gain g obtained by the gain acquiring part 261 is inputted to the gain coding part 265.

The gain coding part 265 codes the global gain g to obtain and output a gain code (step S265).

The generated integer signal code and gain code are outputted to the parameter determining part 27 as codes corresponding to the normalized MDCT coefficient sequence.

Steps S261, S262, S268, S269 and S265 of the present specific example 1 correspond to the above steps A61, A62, A63, A64 and A65, respectively.

Specific Example 2 of Coding Process Performed by Coding Part 269

As a specific example 2 of the coding process performed by the coding part 26, an example that comprises a loop process will be described.

Figure 11:
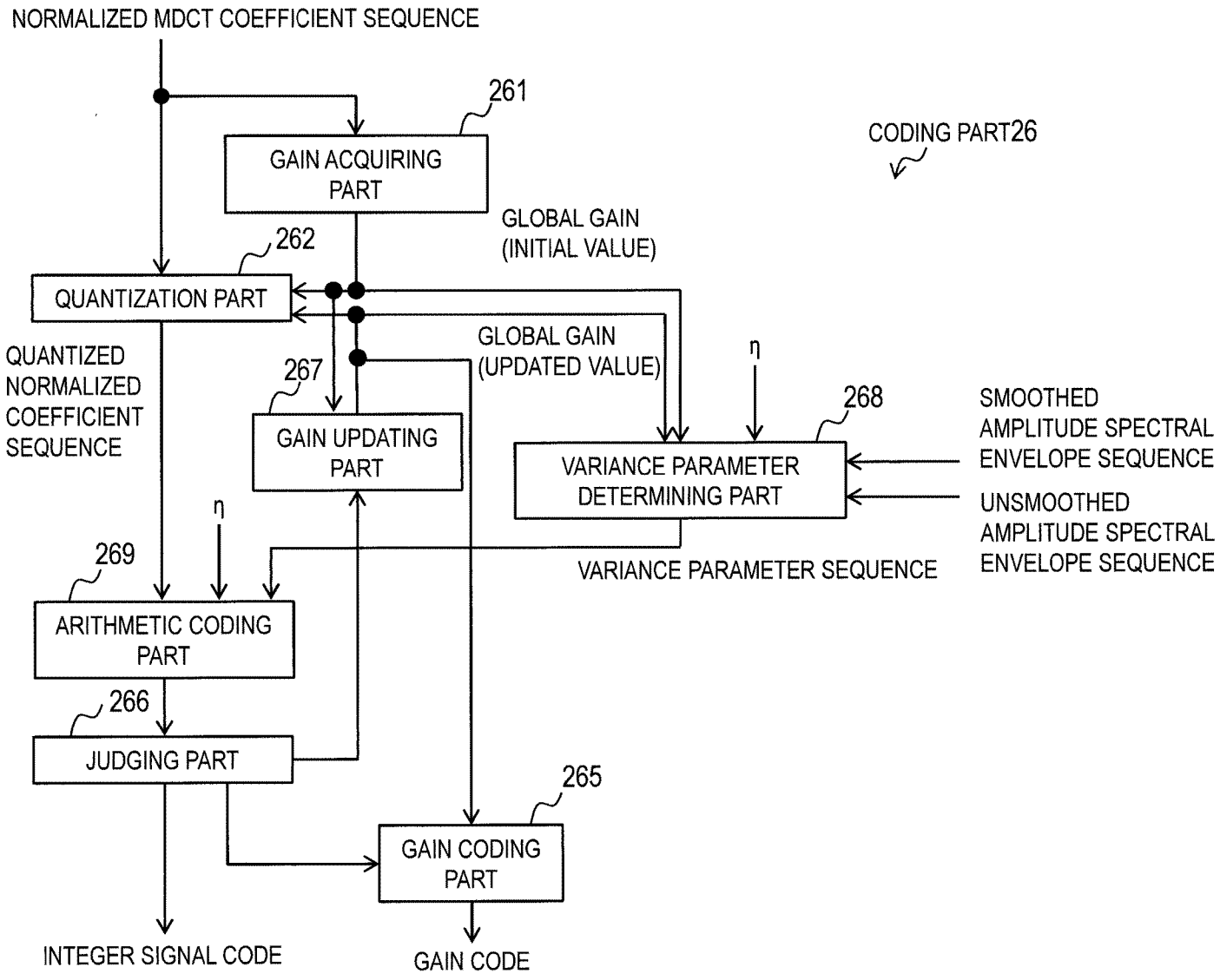
FIG. 11 is a block diagram for illustrating an example of the coding part.

A configuration example of the coding part 26 of the specific example 2 is shown in FIG. 11. As shown in FIG. 11, the coding part 26 of the specific example 2 is, for example, provided with the gain acquiring part 261, the quantization part 262, the variance parameter determining part 268, the arithmetic coding part 269, the gain coding part 265, a judging part 266, and a gain updating part 267. Each part in FIG. 11 will be described below.

<Gain Acquiring Part 261>

The normalized MDCT coefficient sequence $X_N(0)$, $X_N(1), \ldots, X_N(N-1)$ generated by the envelope normalizing part 25 is inputted to the gain acquiring part 261.

The gain acquiring part 261 decides and outputs such a global gain g that the number of bits of an integer signal code is equal to or smaller than the number of allocated bits B, which is the number of bits allocated in advance, and is as large as possible, from the normalized MDCT coefficient sequence $X_N(0)$, $X_N(1), \ldots, X_N(N-1)$ (step S261). For example, the gain acquiring part 261 acquires and outputs a value of multiplication of a square root of the total of energy of the normalized MDCT coefficient sequence $X_N(0)$, $X_N(1), \ldots, X_N(N-1)$ by a constant that is in negative correlation with the number of allocated bits B as the global gain g.

The obtained global gain g is outputted to the quantization part 262 and the variance parameter determining part 268.

The global gain g obtained by the gain acquiring part 261 becomes an initial value of a global gain used by the quantization part 262 and the variance parameter determining part 268.

<Quantization Part 262>

The normalized MDCT coefficient sequence $X_N(0)$, $X_N(1), \ldots, X_N(N-1)$ generated by the envelope normalizing part 25 and the global gain g obtained by the gain acquiring part 261 or the gain updating part 267 are inputted to the quantization part 262.

The quantization part 262 obtains and outputs a quantized normalized coefficient sequence $X_Q(0), X_Q(1), \ldots, X_Q(N-1)$, which is a sequence of an integer part of a result of dividing each coefficient of the normalized MDCT coefficient sequence $X_N(0), X_N(1), \ldots, X_N(N-1)$ by the global gain g (step S262).

Here, a global gain g used when the quantization part 262 is executed for the first time is the global gain g obtained by the gain acquiring part 261, that is, the initial value of the global gain. Further, a global gain g used when the quantization part 262 is executed at and after the second time is the global gain g obtained by the gain updating part 267, that is, an updated value of the global gain.

The obtained quantized normalized coefficient sequence $X_Q(0), X_Q(1), \ldots, X_Q(N-1)$ is outputted to the arithmetic coding part 269.

<Variance Parameter Determining Part 268>

The parameter $\eta_1$ read out by the parameter determining part 27, the global gain g obtained by the gain acquiring part 261 or the gain updating part 267, the unsmoothed amplitude spectral envelope sequence $\hat{H}(0), \hat{H}(1), \ldots, \hat{H}(N-1)$ generated by the unsmoothed amplitude spectral envelope sequence generating part 23, the smoothed amplitude spectral envelope sequence $\hat{H}\gamma(0), \hat{H}\gamma(1), \ldots, \hat{H}\gamma(N-1)$ generated by the smoothed amplitude spectral envelope generating part 24, and the predictive residual energy $\sigma^2$ obtained by the linear predictive analysis part 22 are inputted to the variance parameter determining part 268.

The variance parameter determining part 268 obtains and outputs each variance parameter of a variance parameter sequence $\varphi(0), \varphi(1), \ldots, \varphi(N-1)$ from the global gain g, the unsmoothed amplitude spectral envelope sequence $\hat{H}(0), \hat{H}(1), \ldots, \hat{H}(N-1)$, the smoothed amplitude spectral envelope sequence $\hat{H}\gamma(0), \hat{H}\gamma(1), \ldots, \hat{H}\gamma(N-1)$ and the predictive residual energy $\sigma^2$ by the above expressions (A1) and (A8) (step S268).

Here, a global gain g used when the variance parameter determining part 268 is executed for the first time is the global gain g obtained by the gain acquiring part 261, that is, the initial value of the global gain. Further, a global gain g used when the variance parameter determining part 268 is executed at and after the second time is the global gain g obtained by the gain updating part 267, that is, an updated value of the global gain.

The obtained variance parameter sequence $\varphi(0), \varphi(1), \ldots, \varphi(N-1)$ is outputted to the arithmetic coding part 269.

<Arithmetic Coding Part 269>

The parameter $\eta_1$ read out by the parameter determining part 27, the quantized normalized coefficient sequence $X_Q(0), X_Q(1), \ldots, X_Q(N-1)$ obtained by the quantization part 262 and the variance parameter sequence $\varphi(0), \varphi(1), \ldots, \varphi(N-1)$ obtained by the variance parameter determining part 268 are inputted to the arithmetic coding part 269.

The arithmetic coding part 269 performs arithmetic coding of the quantized normalized coefficient sequence $X_Q(0)$, $X_Q(1), \ldots, X_Q(N-1)$ using variance parameters of the variance parameter sequence $\varphi(0), \varphi(1), \ldots, \varphi(N-1)$ as variance parameters corresponding to coefficients of the quantized normalized coefficient sequence $X_Q(0)$, $X_Q(1), \ldots, X_Q(N-1)$, respectively, to obtain and output an integer signal code and the number of consumed bits C, which is the number of bits of the integer signal code (step S269).

At the time of performing arithmetic coding, the arithmetic coding part 269 performs such bit allocation that each coefficient of the quantized normalized coefficient sequence $X_Q(0), X_Q(1), \ldots, X_Q(N-1)$ becomes optimal when being in accordance with the generalized Gaussian distribution $f_{GG}(X|\varphi(k), \eta_1)$ by arithmetic coding, and performs coding with an arithmetic code based on the performed bit allocation.

The obtained integer signal code and the number of consumed bits C are outputted to the judging part 266.

Arithmetic coding may be performed over a plurality of coefficients in the quantized normalized coefficient sequence $X_Q(0), X_Q(1), \ldots, X_Q(N-1)$. In this case, since each variance parameter of the variance parameter sequence $\varphi(0)$, $\varphi(1)$, . . . , $\varphi(N-1)$ is based on the unsmoothed amplitude spectral envelope sequence $\hat{H}(0)$, $\hat{H}(1)$, . . . , $\hat{H}(N-1)$ as seen from the expressions (A1) and (A8), it can be said that the arithmetic coding part 269 performs such coding that bit allocation substantially changes on the basis of an estimated spectral envelope (an unsmoothed amplitude spectral envelope).

<Judging Part 266>

The integer signal code obtained by the arithmetic coding part 269 is inputted to the judging part 266.

When the number of times of updating the gain is a predetermined number of times, the judging part 266 outputs the integer signal code as well as outputting an instruction signal to code the global gain g obtained by the gain updating part 267 to the gain coding part 265. When the number of times of updating the gain is smaller than the predetermined number of times, the judging part 266 outputs the number of consumed bits C measured by the arithmetic coding part 264 to the gain updating part 267 (step S266).

<Gain Updating Part 267>

The number of consumed bits C measured by the arithmetic coding part 264 is inputted to the gain updating part 267.

When the number of consumed bits C is larger than the number of allocated bits B, the gain updating part 267 updates the value of the global gain g to be a larger value and outputs the value. When the number of consumed bits C is smaller than the number of allocated bits B, the gain updating part 267 updates the value of the global gain g to be a smaller value and outputs the updated value of the global gain g (step S267).

The updated global gain g obtained by the gain updating part 267 is outputted to the quantization part 262 and the gain coding part 265.

<Gain Coding Part 265>

An output instruction from the judging part 266 and the global gain g obtained by the gain updating part 267 are inputted to the gain coding part 265.

The gain coding part 265 codes the global gain g to obtain and output a gain code in accordance with an instruction signal (step 265).

The integer signal code outputted by the judging part 266 and the gain code outputted by the gain coding part 265 are outputted to the parameter determining part 27 as codes corresponding to the normalized MDCT coefficient sequence.

That is, in the present specific example 2, step S267 performed last corresponds to the above step A61, and steps S262, S263, S264 and S265 correspond to the above steps A62, A63, A64, and A65, respectively.

The specific example 2 of the coding process performed by the coding part 26 is described in more detail in International Publication No. WO02014/054556 and the like.

[Modification of Coding Part 26]

The coding part 26 may perform such coding that bit allocation is changed on the basis of an estimated spectral envelope (an unsmoothed amplitude spectral envelope), for example, by performing the following process.

The coding part 26 determines a global gain g corresponding to the normalized MDCT coefficient sequence $X_N(0)$, $X_N(1)$, . . . , $X_N(N-1)$ first, and determines a quantized normalized coefficient sequence $X_Q(0)$, $X_Q(1)$, . . . , $X_Q(N-1)$, which is a sequence of integer values obtained by quantizing a result of dividing each coefficient of the nonnalized MDCT coefficient sequence $X_N(0)$, $X_N(1)$, . . . , $X_N(N-1)$ by the global gain g.

As for quantized bits corresponding to each coefficient of this quantized normalized coefficient sequence $X_Q(0)$, $X_Q(1)$, . . . , $X_Q(N-1)$, it is possible to, on the assumption that distribution of $X_Q(k)$ is uniform within a certain range, decide the range on the basis of estimated values of an envelope. Though it is also possible to code estimated values of an envelope for each of a plurality of samples, the coding part 26 can decide the range of $X_Q(k)$ using values $\hat{H}_N(k)$ of a normalized amplitude spectral envelope sequence based on linear prediction, for example, as shown by the following expression (A9).

[Expression 8]

$$\phi(k) = \frac{\hat{H}(k)}{\hat{H}_\gamma(k)} = \hat{H}_N(k),\ (k = 0, \ldots, N-1) \tag{A9}$$

In order to minimize a square error of $X_Q(k)$ at the time of quantizing $X_Q(k)$ for a certain k, it is possible to set the number of bits b(k) to be allocated, under the restriction of the following expression:

$$B = \Sigma_{j=0}^{j=N-1} \varphi(j) \quad \text{[Expression 9]}$$

The number of bits b(k) to be allocated can be represented by the following expression (A10):

[Expression 10]

$$b(k) = \frac{B}{N} + \frac{1}{2}\log_2(\phi(k)^2) - \frac{1}{2}\sum_{j=0}^{j=N-1} \log_2(\phi(j)^2), \quad (k = 0, \ldots, N-1) \tag{A10}$$

Here, B is a positive integer specified in advance. At this time, the coding part 26 may perform a process for readjustment of b(k) by performing rounding off so that b(k) becomes an integer, setting b(k)=0 when b(k) is smaller than 0, and so on.

Further, it is also possible for the coding part 26 to decide the number of allocated bits not for allocation for each sample but for allocation for a plurality of collected samples and, as for quantization, perform not scalar quantization for each sample but quantization for each vector of a plurality of collected samples.

When the number of quantized bits b(k) of $X_Q(k)$ of a sample k is given as described above, and coding is performed for each sample, $X_Q(k)$ can take $2^{b(k)}$ kinds of integers from $-2^{b(k)-1}$ to $2^{b(k)-1}$. The coding part 26 codes each sample with b(k) bits to obtain an integer signal code.

The generated integer signal code is outputted to the decoding apparatus. For example, the generated b(k)-bit integer signal code corresponding to $X_Q(k)$ is sequentially outputted to the decoding apparatus, with k=0 first.

If $X_Q(k)$ exceeds the range from $-2^{b(k)-1}$ to $2^{b(k)-1}$ described above, it is replaced with a maximum value or a minimum value.

When g is too small, quantization distortion is caused by the replacement. When g is too large, a quantization error increases, and it is not possible to effectively utilize information because the range that $X_Q(k)$ can take is too small in comparison with b(k). Therefore, optimization of g may be performed.

The coding part 26 codes the global gain g to obtain and output a gain code.

The coding part 26 may perform coding other than arithmetic coding as done in this modification of the coding part 26.

<Parameter Determining Part 27>

The code generated for each parameter $\eta_1$, for the frequency domain sample sequence corresponding to the time-series signal in the same predetermined time interval by the processes from step A1 to step A6 (in this example, a linear predictive coefficient code, a gain code and an integer signal code) is inputted to the parameter determining part 27.

The parameter determining part 27 selects one code from among codes obtained for the parameters $\eta_1$, respectively, for the frequency domain sample sequence corresponding to the time-series signal in the same predetermined time interval, and decides a parameter $\eta_1$ corresponding to the selected code (step A7). The determined parameter $\eta$ becomes a parameter $\eta$ for the frequency domain sample sequence corresponding to the time-series signal in the same predetermined time interval. Then, the parameter determining part 27 outputs the selected code and a parameter code indicating the determined parameter $\eta$ to the decoding apparatus. Selection of a code is performed on the basis of at least one of the code amount of the code and coding distortion corresponding to the code. For example, a code with the smallest code amount or a code with the smallest coding distortion is selected.

Here, the coding distortion refers to an error between a frequency domain sample sequence obtained from an input signal and a frequency domain sample sequence obtained by locally decoding a generated code. The coding apparatus may be provided with a coding distortion calculating part for calculating the coding distortion. This coding distortion calculating part is provided with a decoding part that performs a similar process as a decoding apparatus to be described below, and this decoding part locally decodes the generated code. After that, the coding distortion calculating part calculates an error between a frequency domain sample sequence obtained from an input signal and a frequency domain sample sequence obtained by the local decoding and causes the result to be coding distortion.

(Decoding)

Figure 13:
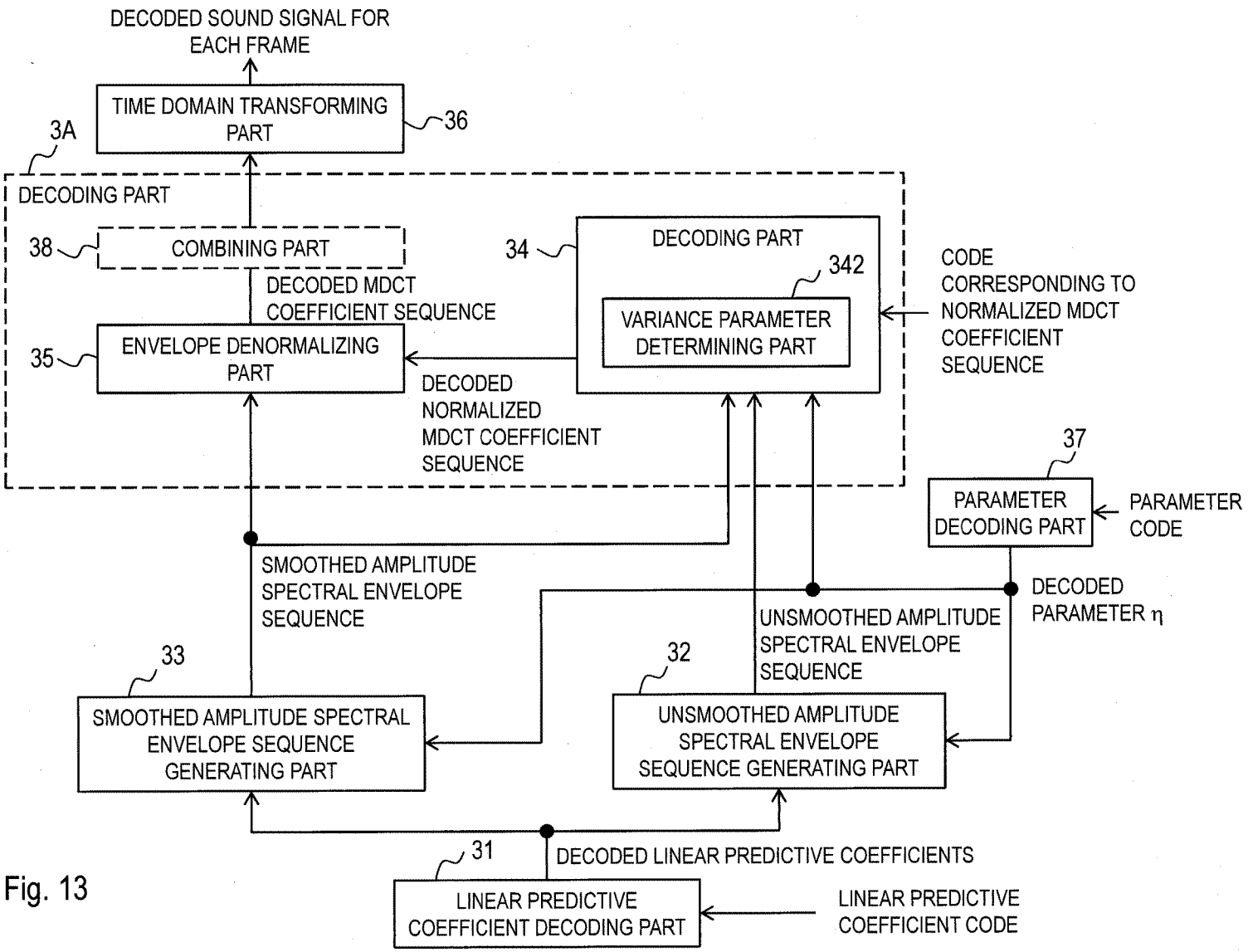
FIG. 13 is a block diagram for illustrating an example of a decoding apparatus.
Figure 14:
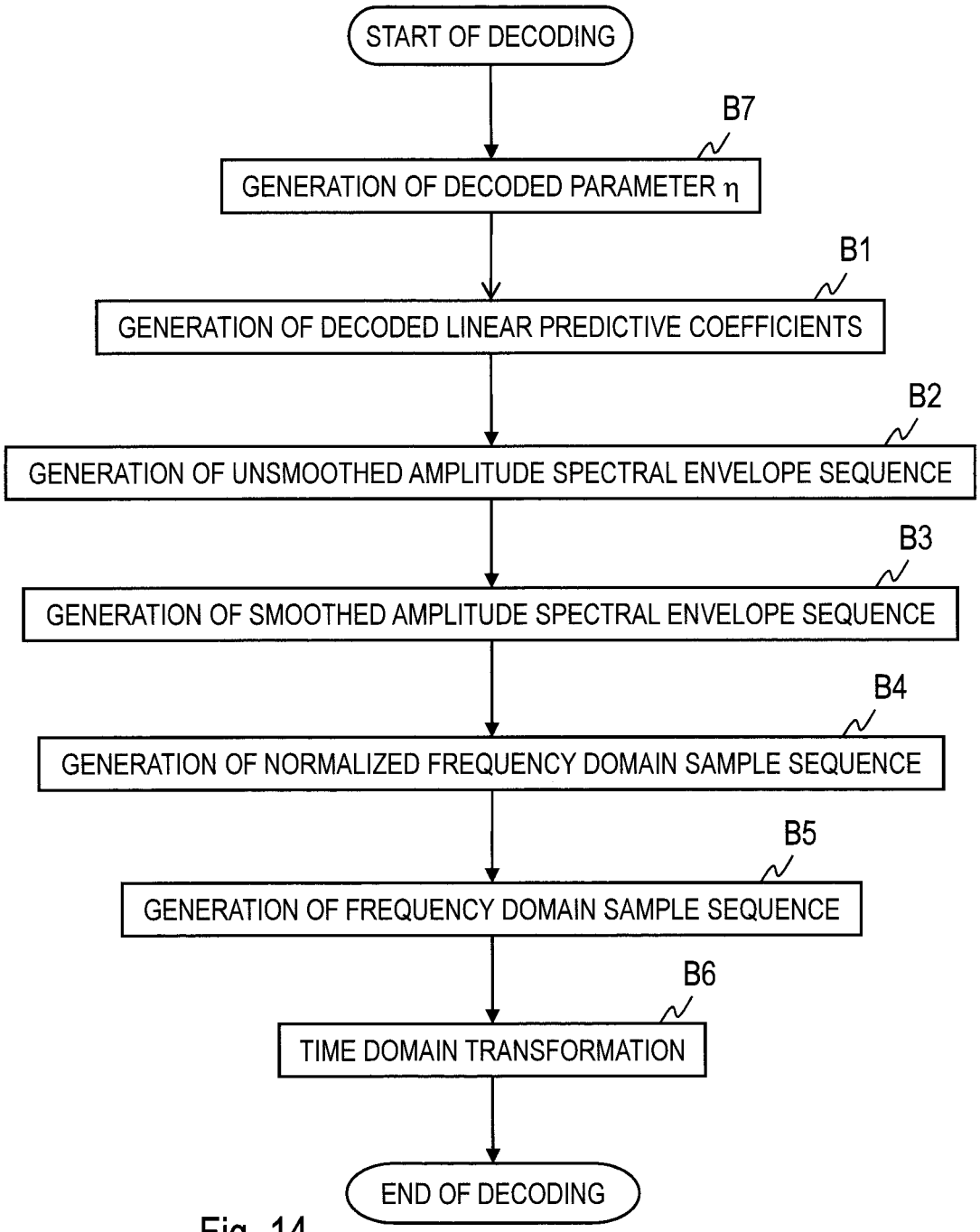
FIG. 14 is a flowchart for illustrating an example of a decoding method.

A configuration example of the decoding apparatus corresponding to the coding apparatus is shown in FIG. 13. As shown in FIG. 13, the decoding apparatus of the first embodiment is, for example, provided with a linear predictive coefficient decoding part 31, an unsmoothed amplitude spectral envelope sequence generating part 32, a smoothed amplitude spectral envelope sequence generating part 33, a decoding part 34, an envelope denormalizing part 35, a time domain transforming part 36 and a parameter decoding part 37. An example of each process of a decoding method of the first embodiment realized by this decoding apparatus is shown in FIG. 14.

At least a parameter code, a code corresponding to a normalized MDCT coefficient sequence and a linear predictive coefficient code outputted by the coding apparatus are inputted to the decoding apparatus.

Each part in FIG. 13 will be described below.

<Parameter Decoding Part 37>

The parameter code outputted by the coding apparatus is inputted to the parameter decoding part 37.

The parameter decoding part 37 determines a decoded parameter $\eta$ by decoding the parameter code step B7 in FIG. 14). The determined decoded parameter $\eta$ is outputted to the linear predictive coefficient decoding part 31, the unsmoothed amplitude spectral envelope sequence generating part 32, the smoothed amplitude spectral envelope sequence generating part 33 and the decoding part 34. A plurality of decoded parameters are stored in the parameter decoding part 37 as candidates. The parameter decoding part $\eta$ determines a candidate for a decoded parameter $\eta$ corresponding to the parameter code as a decoded parameter $\eta$. The plurality of decoded parameters $\eta$ stored in the parameter decoding part 37 are the same as the plurality of parameters $\eta$ stored in the parameter determining part 27 of the coding apparatus.

<Linear Predictive Coefficient Decoding Part 31>

The linear predictive coefficient code outputted by the coding apparatus and the decoded parameter $\eta$ obtained by the parameter decoding part 37 are inputted to the linear predictive coefficient decoding part 31.

The linear predictive coefficient decoding part 31 is the linear predictive decoding apparatus described above using FIGS. 6 and 21 described in [Linear predictive coding apparatus, linear predictive decoding apparatus and methods therefor]. In [Coding apparatus, decoding apparatus and methods therefor] and FIG. 13, the linear predictive coding apparatus in FIG. 6 and FIG. 21 described in [Linear predictive coding apparatus, linear predictive decoding apparatus and methods therefor] will be referred to as "the linear predictive coefficient decoding part 31". The linear predictive coefficient decoding part 31 may be the linear predictive decoding apparatus in FIG. 28.

By decoding the inputted linear predictive coefficient code by a process similar to the process described in [Linear predictive coding apparatus, linear predictive decoding apparatus and methods therefor] in which a decoded parameter $\eta$ is a parameter $\eta_1$, the linear predictive coefficient decoding part 31 obtains decoded linear predictive coefficients $\hat{\beta}_1, \hat{\beta}_2, \ldots, \hat{\beta}_p$ that are decoded coefficients transformable to linear predictive coefficients (step B1).

The obtained decoded linear predictive coefficients $\hat{\beta}_1, \hat{\beta}\beta_2, \ldots, \hat{\beta}_p$ are outputted to the unsmoothed amplitude spectral envelope sequence generating part 32 and the smoothed amplitude spectral envelope sequence generating part 33.

<Unsmoothed Amplitude Spectral Envelope Sequence Generating Part 32>

The decoded parameter $\eta$ determined by the parameter decoding part 37 and the decoded linear predictive coefficients $\hat{\beta}_1, \hat{\beta}_2, \ldots, \hat{\beta}_p$ obtained by the linear predictive coefficient decoding part 31 are inputted to the unsmoothed amplitude spectral envelope sequence generating part 32.

The unsmoothed amplitude spectral envelope sequence generating part 32 generates an unsmoothed amplitude spectral envelope sequence $\hat{H}(0), \hat{H}(1), \ldots, \hat{H}(N-1)$, which is a sequence of an amplitude spectral envelope corresponding to the decoded linear predictive coefficients $\hat{\beta}_1, \hat{\beta}_2, \ldots, \hat{\beta}_p$ by the above expression (A2) (step B2).

The generated unsmoothed amplitude spectral envelope sequence $\hat{H}(0), \hat{H}(1), \ldots, \hat{H}(N-1)$ is outputted to the decoding part 34.

In this way, the unsmoothed amplitude spectral envelope sequence generating part 32 obtains an unsmoothed spectral envelope sequence, which is a sequence obtained by raising a sequence of an amplitude spectral envelope corresponding to coefficients transformable to the linear predictive coefficients generated by the linear predictive coefficient decoding part 31 to the power of $1/\eta$.

<Smoothed Amplitude Spectral Envelope Sequence Generating Part 33>

The decoded parameter $\eta$ determined by the parameter decoding part 37 and the decoded linear predictive coefficients $\hat{\beta}_1, \hat{\beta}_2, \ldots, \hat{\beta}_p$ obtained by the linear predictive coefficient decoding part 31 are inputted to the smoothed amplitude spectral envelope sequence generating part 33.

The smoothed amplitude spectral envelope sequence generating part 33 generates a smoothed amplitude spectral envelope sequence $\hat{H}\gamma(0), \hat{H}\gamma(1), \ldots, \hat{H}\gamma(N-1)$, which is a sequence obtained by reducing amplitude unevenness of a sequence of an amplitude spectral envelope corresponding to the decoded linear predictive coefficients $\hat{\beta}_1, \hat{\beta}_2, \ldots, \hat{\beta}_p$, by the above expression A(3) (step B3).

The generated smoothed amplitude spectral envelope sequence $\hat{H}\gamma(0), \hat{H}\gamma(1), \ldots, \hat{H}\gamma(N-1)$ is outputted to the decoding part 34 and the envelope denormalizing part 35.

<Decoding Part 34>

The decoded parameter $\eta$ determined by the parameter decoding part 37, the code corresponding to the normalized MDCT coefficient sequence outputted by the coding apparatus, the unsmoothed amplitude spectral envelope sequence $\hat{H}(0), \hat{H}(1), \ldots, \hat{H}(N-1)$ generated by the unsmoothed amplitude spectral envelope sequence generating part 32 and the smoothed amplitude spectral envelope sequence $\hat{H}\gamma(0), \hat{H}\gamma(1), \ldots, \hat{H}\gamma(N-1)$ generated by the smoothed amplitude spectral envelope generating part 33 are inputted to the decoding part 34.

The decoding part 34 is provided with a variance parameter determining part 342.

Figure 15:
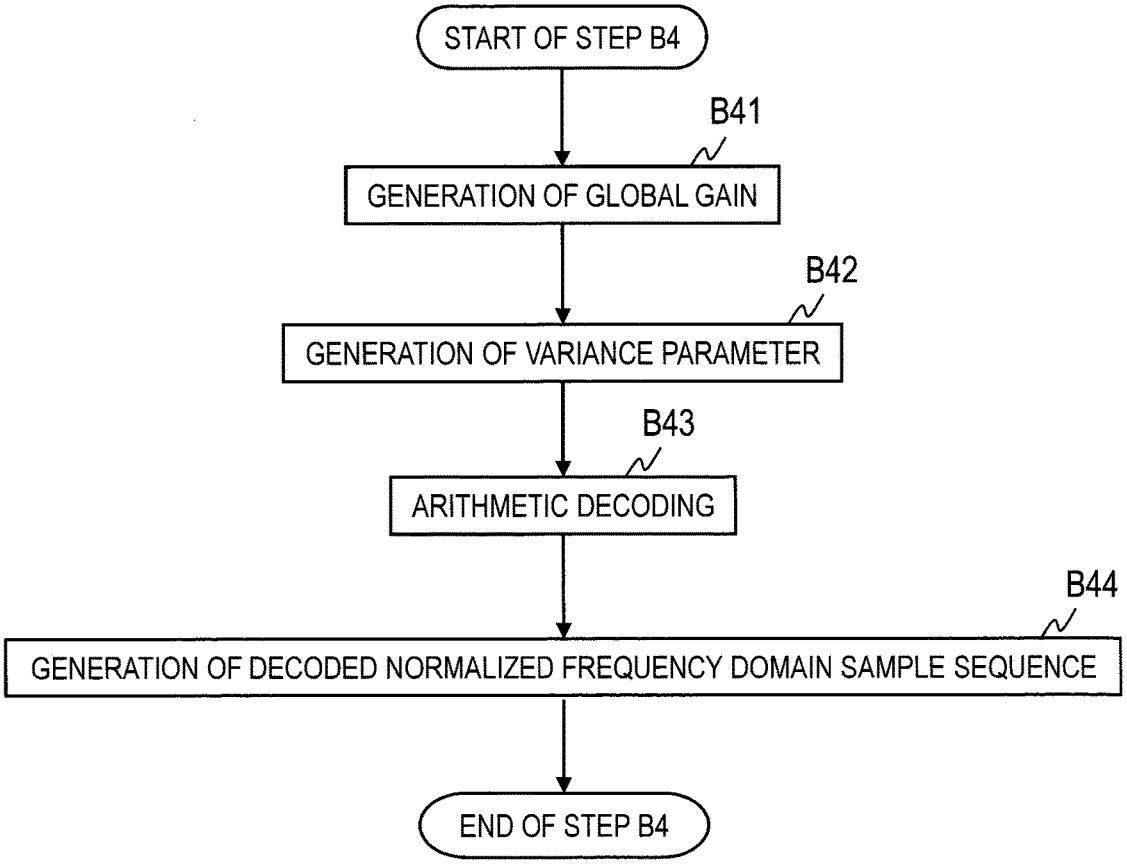
FIG. 15 is a flowchart for illustrating an example of a process of a decoding part.

The decoding part 34 performs decoding, for example, by performing processes of steps B41 to B44 shown in FIG. 15 (step B4). That is, for each frame, the decoding part 34 decodes a gain code comprised in the code corresponding to the inputted normalized MDCT coefficient sequence to obtain a global gain g (step B41). The variance parameter determining part 342 of the decoding part 34 determines each variance parameter of a variance parameter sequence $\varphi(0), \varphi(1), \ldots, \varphi(N-1)$) from the global gain g, the unsmoothed amplitude spectral envelope sequence $\hat{H}(0), \hat{H}(1), \ldots, \hat{H}(N-1)$, the smoothed amplitude spectral envelope sequence $\hat{H}\gamma(0), \hat{H}\gamma(1), \ldots, \hat{H}\gamma(N-1)$ and the parameter $\eta$ by the above expression (A1) (step B42). The decoding part 34 obtains a decoded normalized coefficient sequence $\hat{X}_Q(0), \hat{X}_Q(1), \ldots, \hat{X}_Q(N-1)$ by performing arithmetic decoding of an integer signal code comprised in the code corresponding to the normalized MDCT coefficient sequence in accordance with an arithmetic decoding configuration corresponding to each variance parameter of the variance parameter sequence $\varphi(0), \varphi(1), \ldots, \varphi(N-1)$ (step B43), and generates a decoded normalized MDCT coefficient sequence $\hat{X}_N(0), \hat{X}_N(1), \ldots, \hat{X}_N(N-1)$ by multiplying each coefficient of the decoded normalized coefficient sequence $\hat{X}_Q(0), \hat{X}_Q(1), \ldots, \hat{X}_Q(N-1)$ by the global gain g (step B44). Thus, the decoding part 34 may decode an inputted integer signal code in accordance with bit allocation that substantially changes on the basis of an unsmoothed spectral envelope sequence.

When coding is performed by the process described in [Modification of coding part 26], the decoding part 34 performs, for example, the following process. For each frame, the decoding part 34 decodes a gain code comprised in a code corresponding to an inputted normalized MDCT coefficient sequence to obtain a global gain g. The variance parameter determining part 342 of the decoding part 34 determines each variance parameter of a variance parameter sequence $\varphi(0), \varphi(1), \ldots, \varphi(N-1)$ from an unsmoothed amplitude spectral envelope sequence $\hat{H}(0), \hat{H}(1), \ldots, \hat{H}(N-1)$ and a smoothed amplitude spectral envelope sequence $\hat{H}\gamma(0), \hat{H}\gamma(1), \ldots, \hat{H}\gamma(N-1)$ by the above expression (A9). The decoding part 34 can determine b(k) by the expression (A10) on the basis of each variance parameter $\varphi(k)$ of the variance parameter sequence $\varphi(0), \varphi(1), \ldots, \varphi(N-1)$. The decoding part 34 obtains a decoded normalized coefficient sequence $\hat{X}_Q(0), \hat{X}_Q(1), \ldots, \hat{X}_Q(N-1)$ by sequentially decoding values of $\hat{X}_Q(k)$ with the number of bits b(k), and generates a decoded normalized MDCT coefficient sequence $\hat{X}_N(0), \hat{X}_N(1), \ldots, \hat{X}_N(N-1)$ by multiplying each coefficient of the decoded normalized coefficient sequence $\hat{X}_Q(0), \hat{X}_Q(1), \ldots, \hat{X}_Q(N-1)$ by the global gain g. Thus, the decoding part 34 may decode an inputted integer signal code in accordance with bit allocation that changes on the basis of an unsmoothed spectral envelope sequence.

The generated decoded normalized MDCT coefficient sequence $\hat{X}_N(0), \hat{X}_N(1), \ldots, \hat{X}_N(N-1)$ is outputted to the envelope denormalizing part 35.

<Envelope Denormalizing Part 35>

The smoothed amplitude spectral envelope sequence $\hat{H}\gamma(0), \hat{H}\gamma(1), \ldots, \hat{H}\gamma(N-1)$ generated by the smoothed amplitude spectral envelope generating part 33 and the decoded normalized MDCT coefficient sequence $\hat{X}_N(0), \hat{X}_N(1), \ldots, \hat{X}_N(N-1)$ generated by the decoding part 34 are inputted to the envelope denormalizing part 35.

The envelope denormalizing part 35 generates a decoded MDCT coefficient sequence $\hat{X}(0), \hat{X}(1), \ldots, \hat{X}(N-1)$ by denormalizing the decoded normalized MDCT coefficient sequence $\hat{X}_N(0), \hat{X}_N(1), \ldots, \hat{X}_N(N-1)$ using the smoothed amplitude spectral envelope sequence $\hat{H}\gamma(0), \hat{H}\gamma(1), \ldots, \hat{H}\gamma(N-1)$ (step B5).

The generated decoded MDCT coefficient sequence $\hat{X}(0), \hat{X}(1), \ldots, \hat{X}(N-1)$ is outputted to the time domain transforming part 36.

For example, the envelope denormalizing part 35 generates the decoded MDCT coefficient sequence $\hat{X}(0), \hat{X}(1), \ldots, \hat{X}(N-1)$ by multiplying coefficients $\hat{X}_N(k)$ of the decoded normalized MDCT coefficient sequence $\hat{X}_N(0), \hat{X}_N(1), \ldots, \hat{X}_N(N-1)$ $b_\gamma$ envelope values $\hat{H}\gamma(k)$ of the smoothed amplitude spectral envelope sequence $\hat{H}\gamma(0), \hat{H}\gamma(1), \ldots, \hat{H}\gamma(N-1)$, respectively, on the assumption of $k=0, 1, \ldots, N-1$. That is, $\hat{X}(k)=\hat{X}_N(k)\times\hat{H}\gamma(k)$ is satisfied on the assumption of $k=0, 1, \ldots, N-1$.

<Time Domain Transforming Part 36>

The decoded MDCT coefficient sequence $\hat{X}(0), \hat{X}(1), \ldots, \hat{X}(N-1)$ generated by the envelope denormalizing part 35 is inputted to the time domain transforming part 36.

For each frame, the time domain transforming part 36 transforms the decoded MDCT coefficient sequence $\hat{X}(0), \hat{X}(1), \ldots, \hat{X}(N-1)$ obtained by the envelope denormalizing part 35 to a time domain and obtains a sound signal (a decoded sound signal) for each frame (step B6).

In this way, the decoding apparatus obtains a time-series signal by decoding in the frequency domain.

Second Embodiment of Coding Apparatus, Decoding Apparatus and Methods Therefor The coding apparatus and method of the first embodiment is such that coding is performed to generate a code for each of a plurality of parameters $\eta$, an optimum code is selected from among the codes generated for the parameters $\eta$, respectively, and the selected code and a parameter code corresponding to the selected code are outputted.

In comparison, the coding apparatus and method of the second embodiment is such that a parameter $\eta$ is determined by the parameter determining part 27 first, and coding is performed on the basis of the determined parameter $\eta$ to generate and output a code. In the second embodiment, the parameter $\eta$ can be changed for each predetermined time interval by the parameter determining part 27. Here, that the parameter $\eta$ can be changed for each predetermined time interval means that the parameter $\eta$ can also change when the predetermined time interval changes, and it is assumed that the value of the parameter $\eta$ does not change in the same time interval.

Hereinafter, description will be made mainly on parts different from the first embodiment. For parts similar to the first embodiment, repeated description will be omitted.

(Coding)

Figure 16:
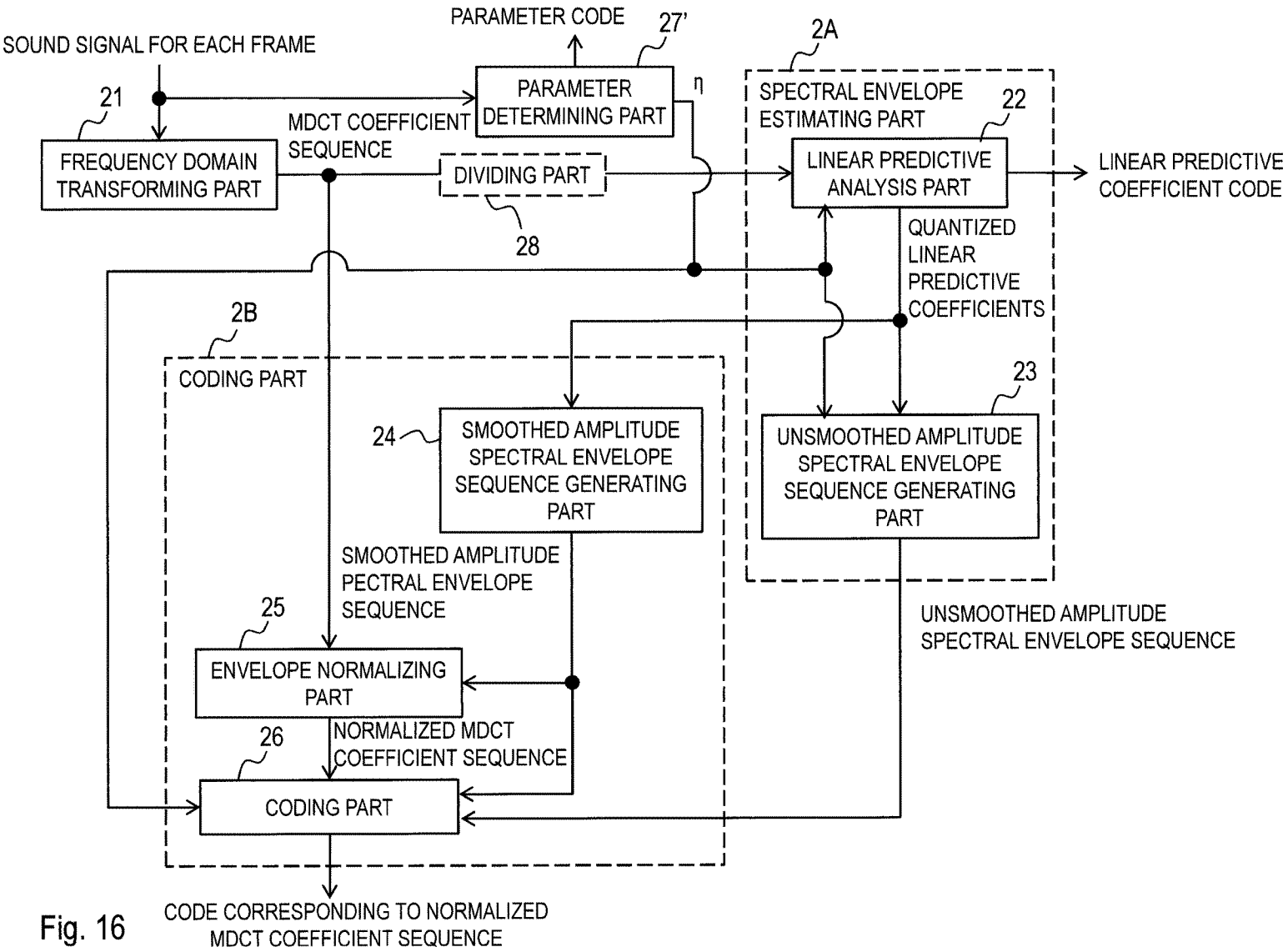
FIG. 16 is a block diagram for illustrating an example of the coding apparatus.
Figure 17:
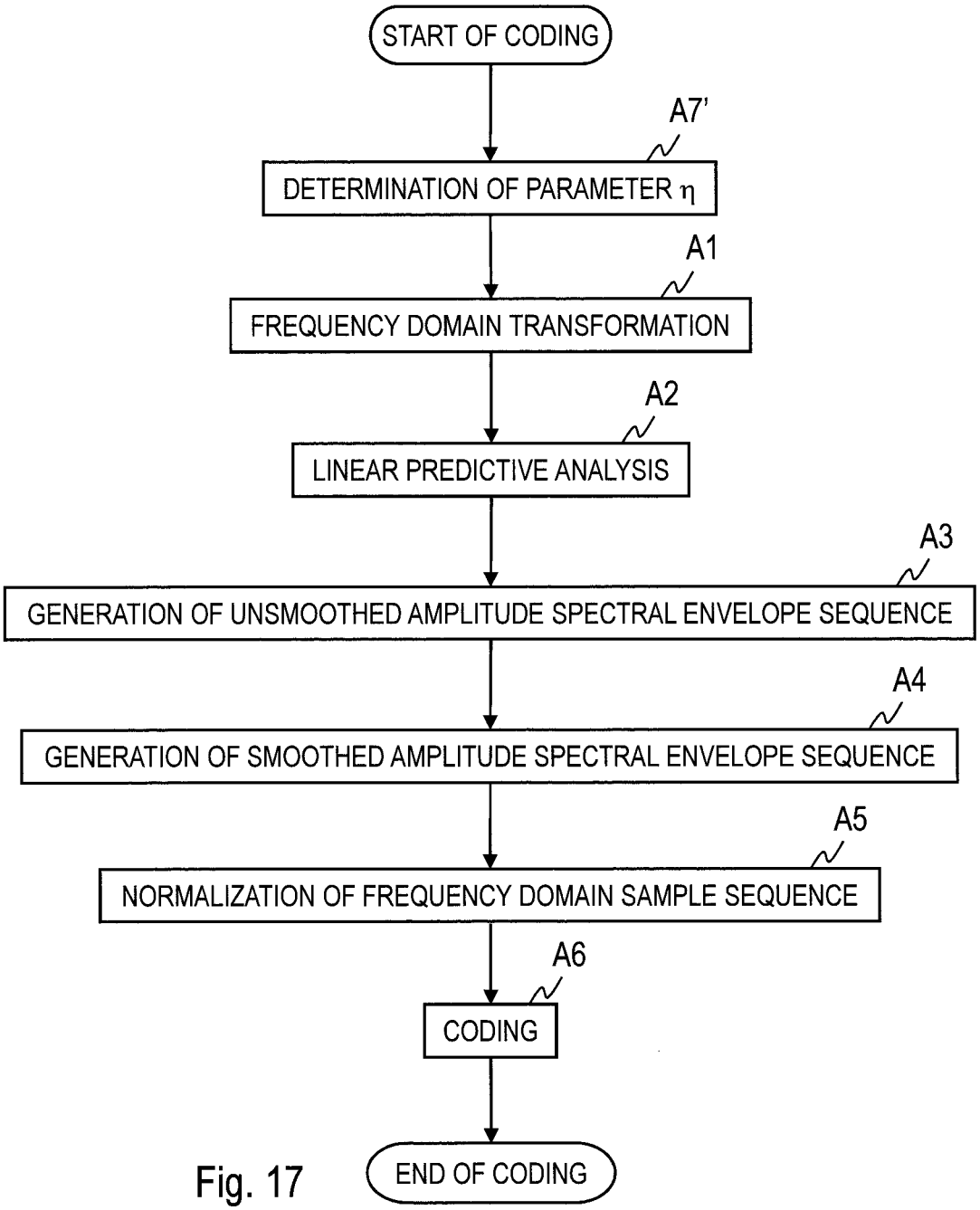
FIG. 17 is a flowchart for illustrating an example of the coding method.

A configuration example of a coding apparatus of the second embodiment is shown in FIG. 16. As shown in FIG. 16, the coding apparatus is, for example, provided with the frequency domain transforming part 21, the linear predictive analysis part 22, the unsmoothed amplitude spectral envelope sequence generating part 23, the smoothed amplitude spectral envelope sequence generating part 24, the envelope normalizing part 25, the coding part 26 and the parameter determining part 27'. An example of each process of a coding method realized by this coding apparatus is shown in FIG. 17.

Each part in FIG. 16 will be described below.

<Parameter Determining Part 27'>

A time domain sound signal, which is a time-series signal, is inputted to the parameter determining part 27'. An example of the sound signal is a voice digital signal or an acoustic digital signal.

The parameter determining part 27' decides a parameter $\eta$ on the basis of the inputted time-series signal by a process to be described later (step A7'). Hereinafter, the parameter $\eta$ determined by the parameter determining part 27' will be referred to as a parameter $\eta_1$.

Then, $\eta_1$ determined by the parameter determining part 27' is outputted to the linear predictive analysis part 22, the unsmoothed amplitude spectral envelope sequence generating part 23, the smoothed amplitude spectral envelope sequence generating part 24 and the coding part 26.

Further, the parameter determining part 27' generates a parameter code by coding the determined $\eta_1$. The generated parameter code is transmitted to the decoding apparatus.

Details of the parameter determining part 27' will be described later.

The frequency domain transforming part 21, the linear predictive analysis part 22, the unsmoothed amplitude spectral envelope sequence generating part 23, the smoothed amplitude spectral envelope sequence generating part 24, the envelope normalizing part 25 and the coding part 26 generate a code on the basis of the parameter $\eta_1$ determined by the parameter determining part 27' by a process similar to that of the first embodiment (from step A1 to step A6). In this example, the code is a combination of a linear predictive coefficient code, a gain code and an integer signal code. The generated code is transmitted to the decoding apparatus.

Figure 18:
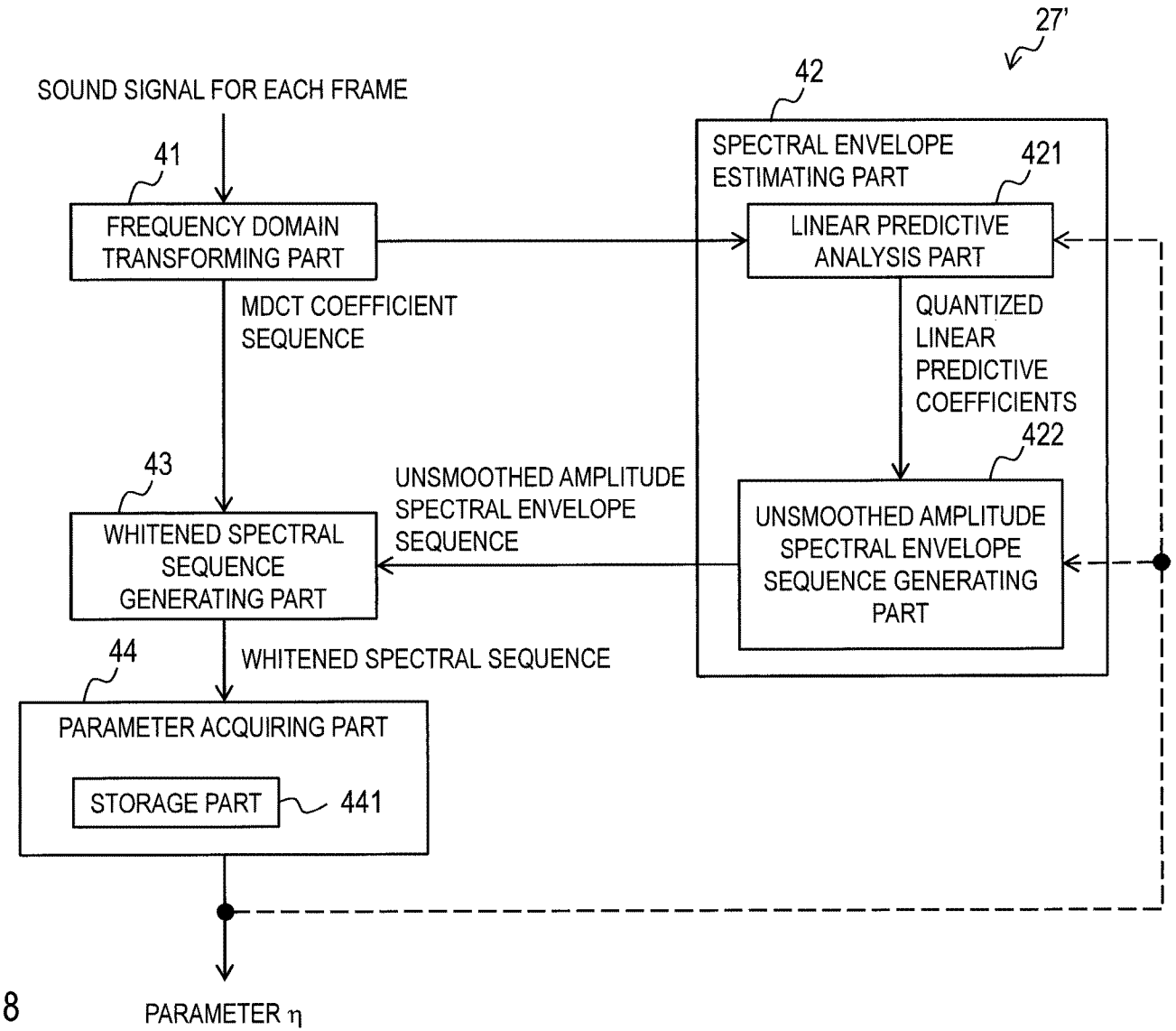
FIG. 18 is a block diagram for illustrating an example of a parameter determination device.
Figure 19:
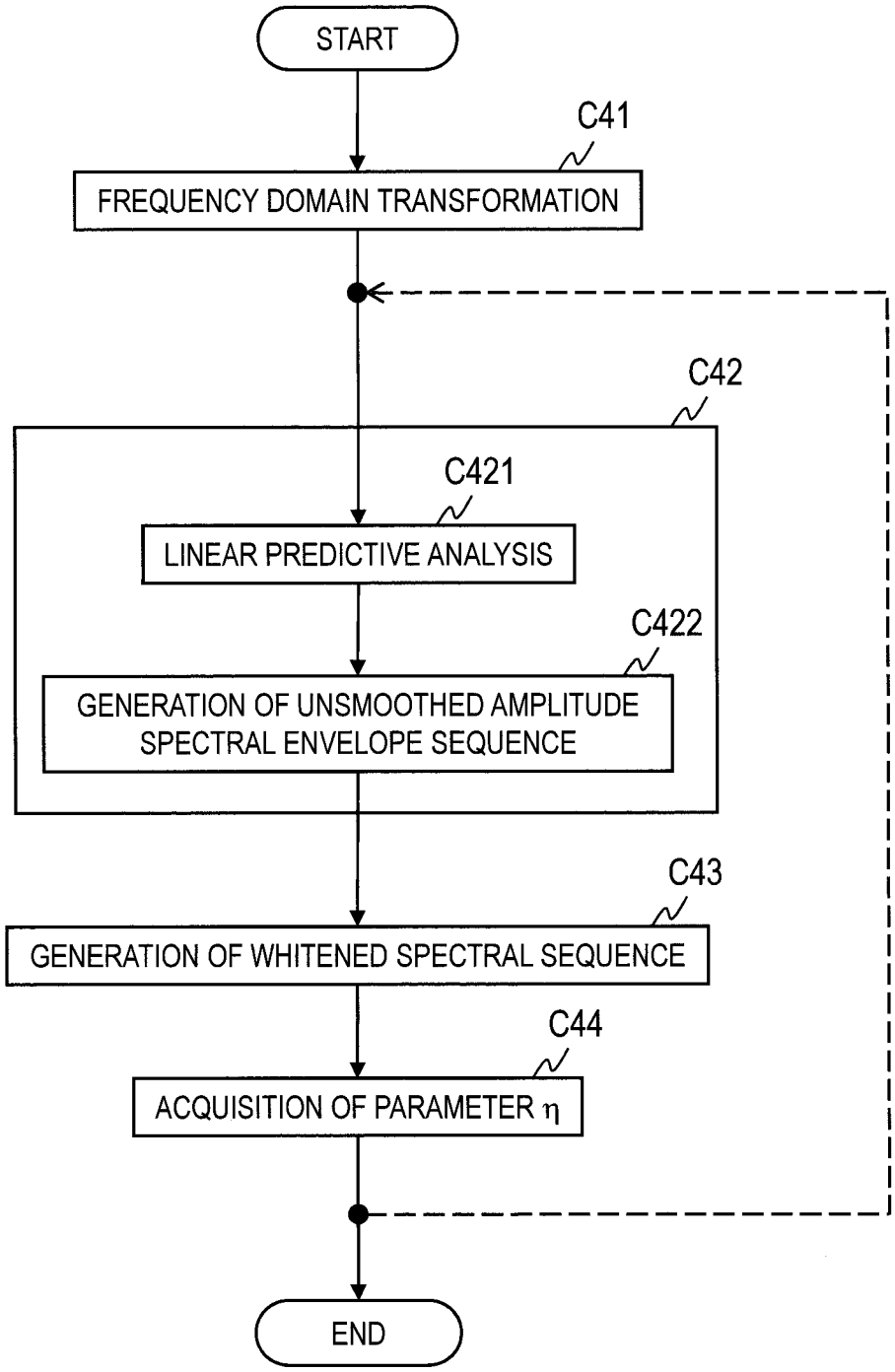
FIG. 19 is a flowchart for illustrating an example of a parameter determination method.

A configuration example of the parameter determining part 27' is shown in FIG. 18. As shown in FIG. 18, the parameter determining part 27' is, for example, provided with the frequency domain transforming part 41, a spectral envelope estimating part 42, a whitened spectral sequence generating part 43 and a parameter acquiring part 44. The spectral envelope estimating part 42 is, for example, provided with a linear predictive analysis part 421 and an unsmoothed amplitude spectral envelope sequence generating part 422. For example, each process of a parameter determination method realized by this parameter determining part 27' is shown in FIG. 19.

Each part in FIG. 18 will be described below.

<Frequency Domain Transforming Part 41>

A time domain sound signal, which is a time-series signal, is inputted to the frequency domain transforming part 41. An example of the sound signal is a voice digital signal or an acoustic digital signal.

The frequency domain transforming part 41 transforms the inputted time domain sound signal to an MDCT coefficient sequence X(0), X(1), . . . , X(N−1) at N points in a frequency domain for each frame with a predetermined time length. Here, N is a positive integer.

The obtained MDCT coefficient sequence X(0), X(1), . . . , X(N−1) is outputted to the spectral envelope estimating part 42 and the whitened spectral sequence generating part 43.

It is assumed that subsequent processes are performed for each frame unless otherwise stated.

In this way, the frequency domain transforming part 41 determines a frequency domain sample sequence, which is, for example, an MDCT coefficient sequence, corresponding to the sound signal (step C41).

<Spectral Envelope Estimating Part 42>

The MDCT coefficient sequence X(0), X(1), . . . , X(N−1) obtained by the frequency domain transforming part 21 is inputted to the spectral envelope estimating part 42.

The spectral envelope estimating part 42 performs estimation of a spectral envelope using the $\eta_0$-th power of absolute values of the frequency domain sample sequence corresponding to the time-series signal as a power spectrum, on the basis of a parameter $\eta_0$ specified in a predetermined method (step C42).

The estimated spectral envelope is outputted to the whitened spectral sequence generating part 43.

The spectral envelope estimating part 42 performs the estimation of the spectral envelope, for example, by generating an unsmoothed amplitude spectral envelope sequence by processes of the linear predictive analysis part 421 and the unsmoothed amplitude spectral envelope sequence generating part 422 described below.

It is assumed that the parameter $\eta_0$ is specified in a predetermined method. For example, it is assumed that $\eta_0$ is a predetermined number larger than 0. For example, $\eta_0=1$ is assumed. Further, determined for a frame before a frame for which the parameter $\eta$ is to be determined currently may be used. The frame before the frame for which the parameter $\eta$ is to be determined currently (hereinafter referred to as a current frame) is, for example, a frame before the current frame and in the vicinity of the current frame. The frame in the vicinity of the current frame is, for example, a frame immediately before the current frame.

<Linear Predictive Analysis Part 421>

The MDCT coefficient sequence X(0), X(1), . . . , X(N−1) obtained by the frequency domain transforming part 41 is inputted to the linear predictive analysis part 421.

The linear predictive analysis part 421 generates linear predictive coefficients $\beta_1, \beta_2, \ldots, \beta_p$ for which linear predictive analysis has been performed using ~R(0), ~R(1), . . . , ~R(N−1) explicitly defined by the following expression (C1), using the MDCT coefficient sequence X(0), X(1), . . . , X(N−1), and codes the generated linear predictive coefficients $\beta_1, \beta_2, \ldots, \beta_p$ to generate a linear predictive coefficient code and quantized linear predictive coefficients $\hat{\beta}_1, \hat{\beta}_2, \ldots, \hat{\beta}_p$, which are quantized linear predictive coefficients corresponding to the linear predictive coefficient code.

[Expression 11]

$$\tilde{R}(k) = \sum_{n=0}^{N-1} |X(n)|^{\eta_0} \exp\left(-j\frac{2\pi kn}{N}\right), k = 0, 1, \ldots, N-1 \quad \text{(C1)}$$

The generated quantized linear predictive coefficients $\hat{\beta}_1, \hat{\beta}_2, \ldots, \hat{\beta}_p$ are outputted to the unsmoothed amplitude spectral envelope sequence generating part 422.

Specifically, by performing operation corresponding to inverse Fourier transform regarding the $\eta_0$-th power of absolute values of the MDCT coefficient sequence X(0), X(1), . . . , X(N−1) as a power spectrum, that is, the operation of the expression (C1) first, the linear predictive analysis part 421 determines a pseudo correlation function signal sequence $\tilde{R}(0), \tilde{R}(1), \ldots, \tilde{R}(N-1)$, which is a time domain signal sequence corresponding to the $\eta_0$-th power of the absolute values of the MDCT coefficient sequence X(0), X(1), . . . , X(N−1). Then, the linear predictive analysis part 421 performs linear predictive analysis using the determined pseudo correlation function signal sequence $\tilde{R}(0), \tilde{R}(1), \ldots, \tilde{R}(N-1)$ to generate linear predictive coefficients $\hat{\beta}_1, \hat{\beta}_2, \ldots, \hat{\beta}_p$. Then, by coding the generated linear predictive coefficients $\hat{\beta}_1, \hat{\beta}_2, \ldots, \hat{\beta}_p$, the linear predictive analysis part 421 obtains the linear predictive coefficient code and the quantized linear predictive coefficients $\hat{\beta}_1, \hat{\beta}_2, \ldots, \hat{\beta}_p$ corresponding the linear predictive coefficient code.

The linear predictive coefficients $\hat{\beta}_1, \hat{\beta}_2, \ldots, \hat{\beta}_p$ are linear predictive coefficients corresponding to a time domain signal when the $\eta_0$-th power of the absolute values of the MDCT coefficient sequence X(0), X(1), . . . , X(N−1) are regarded as a power spectrum.

Generation of the linear predictive coefficient code by the linear predictive analysis part 421 is performed, for example, by a conventional coding technique. The conventional coding technique is, for example, a coding technique in which a code corresponding to linear predictive coefficients themselves is caused to be a linear predictive coefficient code, a coding technique in which linear predictive coefficients are transformed to LSP parameters, and a code corresponding to the LSP parameters is caused to be a linear predictive coefficient code, a coding technique in which linear predictive coefficients are transformed to PARCOR coefficients, and a code corresponding to the PARCOR coefficients is caused to be a linear predictive coefficient code, or the like.

In this way, the linear predictive analysis part 421 performs linear predictive analysis using a pseudo correlation function signal sequence obtained by performing inverse Fourier transform regarding the $\eta_0$-th power of absolute values of a frequency domain sample sequence, which is, for example, an MDCT coefficient sequence, as a power spectrum, and generates coefficients transformable to linear predictive coefficients (step C421).

The linear predictive analysis part 421 may obtain a linear predictive coefficient code by the method described in the section of [Linear predictive coding apparatus, linear predictive decoding apparatus and methods therefor] and cause coefficients transformable to linear predictive coefficients corresponding to the obtained linear predictive coefficient code to be the quantized linear predictive coefficients $\hat{\beta}_1, \hat{\beta}_2, \ldots, \hat{\beta}_p$.

<Unsmoothed Amplitude Spectral Envelope Sequence Generating Part 422>

The quantized linear predictive coefficients $\hat{\beta}_1, \hat{\beta}_2, \ldots, \hat{\beta}_p$ generated by the linear predictive analysis part 421 are inputted to the unsmoothed amplitude spectral envelope sequence generating part 422.

The unsmoothed amplitude spectral envelope sequence generating part 422 generates an unsmoothed amplitude spectral envelope sequence $\hat{H}(0), \hat{H}(1), \ldots, \hat{H}(N-1)$, which is a sequence of an amplitude spectral envelope corresponding to the quantized linear predictive coefficients $\hat{\beta}_1, \hat{\beta}_2, \ldots, \hat{\beta}_p$.

The generated unsmoothed amplitude spectral envelope sequence $\hat{H}(0), \hat{H}(1), \ldots, \hat{H}(N-1)$ is outputted to the whitened spectral sequence generating part 43.

The unsmoothed amplitude spectral envelope sequence generating part 422 generates an unsmoothed amplitude spectral envelope sequence $\hat{H}(0), \hat{H}(1), \ldots, \hat{H}(N-1)$ explicitly defined by the following expression (C2) as the unsmoothed amplitude spectral envelope sequence $\hat{H}(0), \hat{H}(1), \ldots, \hat{H}(N-1)$ using the quantized linear predictive coefficients $\hat{\beta}_1, \hat{\beta}_2, \ldots, \hat{\beta}_p$.

[Expression 12]

$$\hat{H}(k) = \left(\frac{1}{2\pi}\frac{1}{\left|1 + \sum_{n=1}^{p} \hat{\beta}_n \exp(-j2\pi kn/N)\right|^2}\right)^{1/\eta_0} \quad \text{(C2)}$$

In this way, the unsmoothed amplitude spectral envelope sequence generating part 422 performs estimation of a spectral envelope by obtaining an unsmoothed spectral envelope sequence, which is a sequence obtained by raising a sequence of an amplitude spectral envelope corresponding to a pseudo correlation function signal sequence to the power of $^1/\eta_0$, on the basis of coefficients transformable to linear predictive coefficients generated by the linear predictive analysis part 421 (step C422).

<Whitened Spectral Sequence Generating Part 43>

The MDCT coefficient sequence X(0), X(1), . . . , X(N−1) obtained by the frequency domain transforming part 41 and the unsmoothed amplitude spectral envelope sequence $\hat{H}(0), \hat{H}(1), \ldots, \hat{H}(N-1)$ generated by the unsmoothed amplitude spectral envelope sequence generating part 422 are inputted to the whitened spectral sequence generating part 43.

The whitened spectral sequence generating part 43 generates a whitened spectral sequence $X_W(0), X_W(1), \ldots, X_W(N-1)$ by dividing each coefficient of the MDCT coefficient sequence X(0), X(1), . . . , X(N−1) by a corresponding value of the unsmoothed amplitude spectral envelope sequence $\hat{H}(0), \hat{H}(1), \ldots, \hat{H}(N-1)$.

The generated whitened spectral sequence $X_W(0), X_W(1), \ldots, X_W(N-1)$ is outputted to the parameter acquiring part 44.

The whitened spectral sequence generating part 43 generates each value $X_W(k)$ of the whitened spectral sequence $X_W(0), X_W(1), \ldots, X_W(N-1)$, for example, by dividing each coefficient X(k) of the MDCT coefficient sequence X(0), X(1), . . . , X(N−1) by a corresponding value $\hat{H}(k)$ of the unsmoothed amplitude spectral envelope sequence $\hat{H}(0), \hat{H}(1), \ldots, \hat{H}(N-1)$ on the assumption of k=0, 1, . . . , N−1. That is, $X_W(k)=X(k)/\hat{H}(k)$ is satisfied on the assumption of k=0, 1, . . . , N−1.

In this way, the whitened spectral sequence generating part 43 obtains a whitened spectral sequence that is a sequence obtained by dividing a frequency domain sample sequence that is, for example, an MDCT coefficient sequence by a spectral envelope that is, for example, an unsmoothed amplitude spectral envelope sequence (step C43).

<Parameter Acquiring Part 44>

The whitened spectral sequence $X_w(0), X_w(1), \ldots, X_w(N-1)$ generated by the whitened spectral sequence generating part 43 is inputted to the parameter acquiring part 44.

The parameter acquiring part 44 determines such a parameter η that generalized Gaussian distribution with the parameter η as a shape parameter approximates a histogram of the whitened spectral sequence $X_W(0), X_W(1), \ldots, X_W(N-1)$ (step C44). In other words, the parameter acquiring part 44 decides such a parameter η that generalized Gaussian distribution with the parameter η as a shape parameter is close to distribution of the histogram of the whitened spectral sequence $X_W(0), X_W(1), \ldots, X_W(N-1)$.

The generalized Gaussian distribution with the parameter η as a shape parameter is explicitly defined, for example, as shown below. Here, FΓ indicates a gamma function.

[Expression 13]

$$f_{GG}(X \mid \phi, \eta) = \frac{A(\eta)}{\phi}\exp\left(-\left|B(\eta)\frac{X}{\phi}\right|^{\eta}\right),$$

$$A(\eta) = \frac{\eta B(\eta)}{2\Gamma(1/\eta)},\ B(\eta) = \sqrt{\frac{\Gamma(3/\eta)}{\Gamma(1/\eta)}},\ \Gamma(x) = \int_0^{\infty} e^{-t}t^{x-1}dt$$

Figure 20:
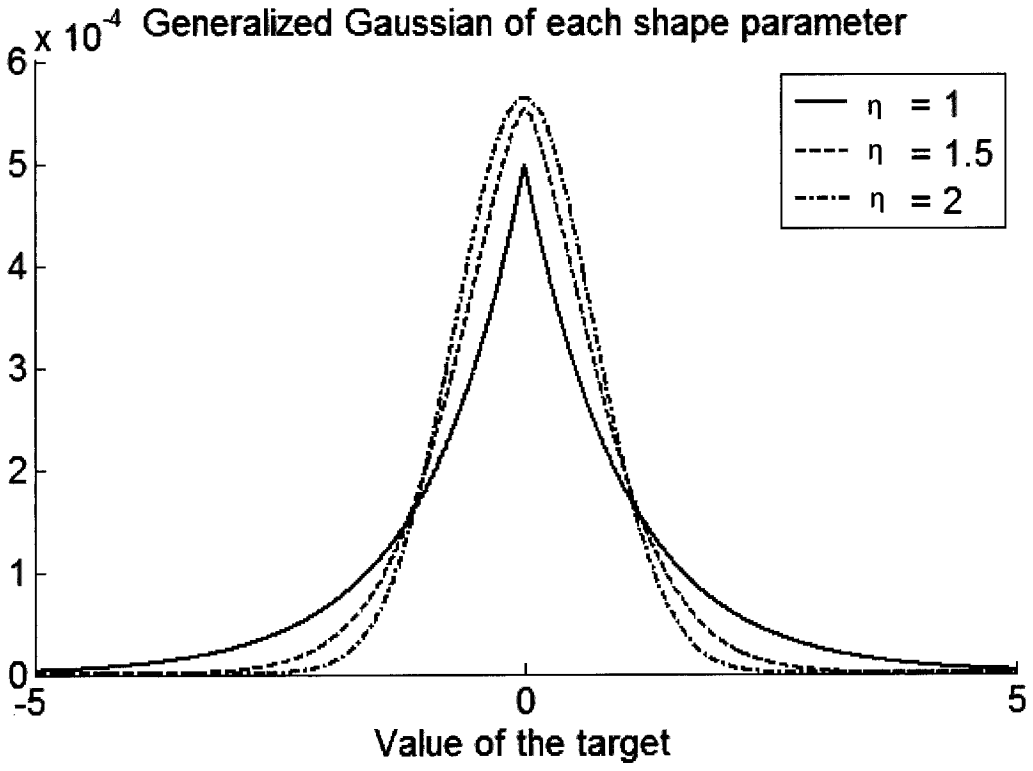
FIG. 20 is a diagram for illustrating generalized Gaussian distribution.

The generalized Gaussian distribution is capable of expressing various distributions by changing η that is a shape parameter. For example, Laplace distribution and Gaussian distribution are expressed at the time of η=1 and at the time of η=2, respectively, as shown in FIG. 20. Here, η is a predetermined number larger than 0, and η may be a predetermined number larger than 0 except 2. Specifically, η may be a predetermined positive number smaller than 2. Here, φ is a parameter corresponding to variance.

Here, η determined by the parameter acquiring part 44 is explicitly defined, for example, by the following expression (C3). Here, $F^{-1}$ is an inverse function of a function F. This expression is derived from a so-called moment method.

[Expression 14]

$$\eta = F^{-1}\left(\frac{m_1}{\sqrt{m_2}}\right) \tag{C3}$$

$$F(\eta) = \frac{\Gamma(2/\eta)}{\sqrt{\Gamma(1/\eta)\Gamma(3/\eta)}}$$

$$m_1 = \frac{1}{N}\sum_{k=0}^{N-1}|X_W(k)|,\ m_2 = \frac{1}{N}\sum_{k=0}^{N-1}|X_W(k)|^2$$

When the inverse function $F^{-1}$ is explicitly defined, the parameter acquiring part 44 can determine the parameter η by calculating an output value when a value of $m_1/((m_2)^{1/2})$ is inputted to the explicitly defined inverse function $F^{-1}$.

When the inverse function $F^{-1}$ is not explicitly defined, the parameter acquiring part 44 may determine the parameter η, for example, by a first method or a second method described below in order to calculate a value of η explicitly defined by the expression (C3).

The first method for determining the parameter η will be described. In the first method, the parameter acquiring part 44 calculates $m_1/((m_2)^{1/2})$ on the basis of a whitened spectral sequence and, by referring to a plurality of different pairs of η and F(η) corresponding to η prepared in advance, obtains η corresponding to F(η) that is the closest to the calculated $m_1/((m_2)^{1/2})$.

The plurality of different pairs of η and F(η) corresponding to η prepared in advance are stored in a storage part 441 of the parameter acquiring part 44 in advance. The parameter acquiring part 44 finds F(η) that is the closest to the calculated $m_1/((m_2)^{1/2})$ by referring to the storage part 441, and reads corresponding to the found F(η) from the storage part 441 and outputs it.

Here, F(η) that is the closest to the calculated $m_1/((m_2)^{1/2})$ refers to such F(η) that an absolute value of a difference from the calculated $m_1/((m_2)^{1/2})$ is the smallest.

The second method for determining the parameter η will be described. In the second method, on the assumption that an approximate curve function of the inverse function $F^{-1}$ is, for example, $\tilde{F}^{-1}$ indicated by an expression (C3') below, the parameter acquiring part 44 calculates $m_1/((m_2)^{1/2})$ on the basis of a whitened spectral sequence and determines η by calculating an output value when the calculated $m_1/((m_2)^{1/2})$ is inputted to the approximate curve function $\tilde{F}^{-1}$. This approximate curve function $\tilde{F}^{-1}$ is only required to be such a monotonically increasing function that an output is a positive value in a used domain.

[Expression 15]

$$\eta = \tilde{F}^{-1}\left(\frac{m_1}{\sqrt{m_2}}\right) \tag{C3'}$$

$$\tilde{F}^{-1}(x) = \frac{0.2718}{0.7697 - x} - 0.1247$$

The η determined by the parameter acquiring part 44 may be explicitly defined not by the expression (C3) but by an expression obtained by generalizing the expression (C3) using positive integers q1 and q2 specified in advance (q1<q2) like an expression (C3").

[Expression 16]

$$\eta = F'^{-1}\left(\frac{m_{q_1}}{(m_{q_2})^{q_1/q_2}}\right) \tag{C3''}$$

$$F'(\eta) = \frac{\Gamma((q_1+1)/\eta)}{(\Gamma(1/\eta))^{1-q_1/q_2}(\Gamma((q_2+1)/\eta))^{q_1/q_2}}$$

$$m_{q_1} = \frac{1}{N}\sum_{k=0}^{N-1}|X_W(k)|^{q_1},\ m_{q_2} = \frac{1}{N}\sum_{k=0}^{N-1}|X_W(k)|^{q_2}$$

In the case where η is explicitly defined by the expression (C3") also, η can be determined in a method similar to the method in the case where η is explicitly defined by the expression (C3). That is, after calculating a value $m_{q1}/((m_{q2})^{q1/q2})$ based on $m_{q1}$ that is the q1-th order moment of a whitened spectral sequence, and $m_{q2}$ that is the q2-th order moment of the whitened spectral sequence on the basis of the whitened spectral sequence, the parameter acquiring part 44 can, by referring to the plurality of different pairs of η and F'(η) corresponding to η prepared in advance, acquire η corresponding to F'(η) that is the closest to the calculated $m_{q1}/((m_{q2})^{q1/q2})$ or can determine η by calculating, on the assumption that an approximate curve function of the inverse function $F'^{-1}$ is $\tilde{F}'^{-1}$, an output value when the calculated $m_{q1}/((m_{q2})^{q1/q2})$ is inputted to the approximate curve function $\tilde{F}^{-1}$, for example, similarly to the first and second methods described above.

As described above, η can be said to be a value based on two different moments $m_{q1}$ and $m_{q2}$ with different orders. For example, η may be determined on the basis of a value of a ratio between a value of a moment with a lower order between the two different moments $m_{q1}$ and $m_{q2}$ with different orders or a value based on the value of the moment (hereinafter referred to as the former) and a value of a moment with a higher order or a value based on the value of the moment (hereinafter referred to as the latter), or a value based on the value of the ratio, or a value obtained by dividing the former by the latter. The value based on a moment refers to, for example, $m^Q$ when the moment is indicated by m, and Q is a predetermined real number. Further, η may be determined by inputting these values to the approximate curve function $\tilde{F}^{-1}$. This approximate curve function $\tilde{F}'^{-1}$ is only required to be such a monotonically increasing function that an output is a positive value in a used domain similarly as described above.

The parameter determining part 27' may determine the parameter η by a loop process. That is, the parameter determining part 27' may further perform the processes of the spectral envelope estimating part 42, the whitened spectral sequence generating part 43 and the parameter acquiring part 44 in which the parameter η determined by the parameter acquiring part 44 is a parameter $\eta_0$ specified by a predetermined method once or more times.

In this case, for example, as shown by a broken line in FIG. 18, the parameter η determined by the parameter acquiring part 44 is outputted to the spectral envelope estimating part 42. The spectral envelope estimating part 42 performs a process similar to the process described above to estimate a spectral envelope, using determined by the parameter acquiring part 44 as the parameter $\eta_0$. The whitened spectral sequence generating part 43 performs a process similar to the process described above to generate a whitened spectral sequence, on the basis of the newly estimated spectral envelope. The parameter acquiring part 44 performs a process similar to the process described above to determine a parameter η, on the basis of the newly generated whitened spectral sequence.

For example, the processes of the spectral envelope estimating part 42, the whitened spectral sequence generating part 43 and the parameter acquiring part 44 may be further performed ι times, which is a predetermined number of times. Here, ι is a predetermined positive integer, and, for example, ι=1 or ι=2.

Further, the spectral envelope estimating part 42 may repeat the processes of the spectral envelope estimating part 42, the whitened spectral sequence generating part 43 and the parameter acquiring part 44 until an absolute value of a difference between the parameter η determined this time and a parameter η determined last time becomes a predetermined threshold or below.

(Decoding)

Since the decoding apparatus and method of the second embodiment are similar to those of the first embodiment, repeated description will be omitted.

[Modification of Coding Apparatus, Decoding Apparatus and Methods Therefor]

When the linear predictive analysis part 22 and the unsmoothed amplitude spectral envelope sequence generating part 23 are grasped as one spectral envelope estimating part 2A, it can be said that this spectral envelope estimating part 2A performs estimation of a spectral envelope regarding the power of absolute values of a frequency domain sample sequence, which is, for example, an MDCT coefficient sequence, corresponding to a time-series signal, as a power spectrum (an unsmoothed amplitude spectral envelope sequence). Here, "regarding . . . as a power spectrum" means that a spectrum raised to the power of $\eta_1$ is used where a power spectrum is usually used.

In this case, it can be said that, the linear predictive analysis part 22 of the spectral envelope estimating part 2A performs linear predictive analysis using a pseudo correlation function signal sequence obtained by performing inverse Fourier transform regarding the $\eta_1$-th power of absolute values of a frequency domain sample sequence, which is, for example, an MDCT coefficient sequence, as a power spectrum, and obtains coefficients transformable to linear predictive coefficients. Further, it can be said that the unsmoothed amplitude spectral envelope sequence generating part 23 of the spectral envelope estimating part 2A performs estimation of a spectral envelope by obtaining an unsmoothed spectral envelope sequence, which is a sequence obtained by raising a sequence of an amplitude spectral envelope corresponding to coefficients transformable to linear predictive coefficients obtained by the linear predictive analysis part 22 to the power of $1/\eta_1$.

Further, when the smoothed amplitude spectral envelope sequence generating part 24, the envelope normalizing part 25 and the coding part 26 are grasped as one coding part 2B, it can be said that this coding part 2B performs such coding that changes bit allocation or that bit allocation substantially changes on the basis of a spectral envelope (an unsmoothed amplitude spectral envelope sequence) estimated by the spectral envelope estimating part 2A, for each coefficient of a frequency domain sample sequence, which is, for example, an MDCT coefficient sequence, corresponding to a time-series signal.

When the decoding part 34 and the envelope denormalizing part 35 are grasped as one decoding part 3A, it can be said that this decoding part 3A obtains a frequency domain sample sequence corresponding to a time-series sequence signal by performing decoding of an inputted integer signal code in accordance with such bit allocation that changes or substantially changes on the basis of an unsmoothed spectral envelope sequence.

If performing coding in which bit assignment is changed or bit assignment is substantially changes on the basis of a spectral envelope (an unsmoothed amplitude spectral envelope sequence), the coding part 2B may perform a coding process other than the arithmetic coding described above. In this case, the decoding part 3A performs a decoding process corresponding to the coding process performed by the coding part 2B.

For example, the coding part 2B may perform Golomb-Rice coding of a frequency domain sample sequence using a Rice parameter determined on the basis of a spectral envelope (an unsmoothed amplitude spectral envelope sequence). In this case, the decoding part 3A may perform Golomb-Rice decoding using a Rice parameter determined on the basis of a spectral envelope (an unsmoothed amplitude spectral envelope sequence).

In the first embodiment, at the time of determining a parameter η, the coding apparatus may not perform the coding process to the end. In other words, the parameter determining part 27 may decide the parameter η on the basis of an estimated code amount. In this case, the coding part 2B obtains an estimated code amount of a code obtained by a coding process similar to the above for a frequency domain sample sequence corresponding to a time-series signal in the same predetermined time interval, using each of a plurality of parameters η. The parameter determining part 27 selects any one of the plurality of parameters η on the basis of the obtained estimated code amount. For example, a parameter η with the smallest estimated code amount is selected. The coding part 2B obtains and outputs a code by performing a coding process similar to the above, using the selected parameter η.

The processes described above are not only executed in order of description in time series but also may be executed in parallel or individually according to processing capacity of an apparatus to execute the processes or as necessary.

[Program and Recording Medium]

Further, each part of each apparatus or each method may be realized by a computer. In that case, content of the processes of each apparatus or each method is written by a program. Then, by executing this program on the computer, each part of each apparatus or each method is realized on the computer.

The program in which the content of the processes is written can be recorded in a computer-readable recording medium. As the computer readable recording medium, any recording medium, for example, a magnetic recording device, an optical disk, a magneto-optical recording medium or a semiconductor memory is possible.

Further, distribution of this program is performed, for example, by sales, transfer, lending and the like of a portable recording medium such as a DVD and a CD-ROM in which the program is recorded. Furthermore, this program may be distributed by storing the program in a storage apparatus of a server computer and transferring the program from the server computer to other computers via a network.

For example, a computer that executes such a program stores the program recorded in the portable recording medium or transferred from the server computer into its storage part once. Then, at the time of executing a process, the computer reads the program stored in its storage part and executes the process in accordance with the read program. Further, as another embodiment of this program, the computer may read the program directly from the portable recording medium and execute the process in accordance with the program. Furthermore, it is also possible for the computer to, each time the program is transferred from the server computer to the computer, execute a process in accordance with the received program one by one. Further, a configuration is also possible in which the processes described above are executed by a so-called ASP (Application Service Provider) type service in which transfer of the program from the server computer to the computer is not performed, and a processing function is realized only by an instruction to execute the program and acquisition of a result. It is assumed that the program comprises information that is provided for processing by an electronic calculator and is equivalent to a program (such as data that is not a direct instruction to a computer but has properties defining processing of the computer).

Further, though it is assumed that each apparatus is configured by executing a predetermined program on a computer, at least a part of content of processes of the apparatus may be realized by hardware.

What is claimed is:

1. A linear predictive coding apparatus for encoding a sound signal, comprising:

a linear predictive analysis part performing linear predictive analysis using a pseudo correlation function signal sequence obtained by performing inverse Fourier transform regarding $\eta_1$-th power of the absolute values of the frequency domain sample sequence corresponding to a time-series signal as a power spectrum to obtain coefficients transformable to linear predictive coefficients, the $\eta_1$ being a positive number, the time-series signal being the sound signal;

a code book storing part storing N (N is an integer equal to or larger than 1) code books corresponding to N kinds of parameters η, respectively, each code book storing a plurality of candidates for coefficients transformable to linear predictive coefficients corresponding to each parameter η;

an adaptation part adapting values of η for the plurality of candidates for coefficients transformable to linear predictive coefficients stored in a code book stored in the code book storing part and the coefficients transformable to linear predictive coefficients obtained by the linear predictive analysis part; and a coding part obtaining a linear predictive coefficient code corresponding to the coefficients transformable to linear predictive coefficients obtained by the linear predictive analysis part, using the plurality of candidates for coefficients transformable to linear predictive coefficients and the coefficients transformable to linear predictive coefficients for which the values of the η have been adapted.

2. The linear predictive coding apparatus according to claim 1, wherein the adaptation part comprises a linear transformation part performing first linear transformation according to the ill for the candidates for coefficients transformable to linear predictive coefficients stored in the code book storing part to obtain a plurality of candidates for coefficients transformable to linear predictive coefficients after the first linear transformation; and the coding part obtains the linear predictive coefficient code corresponding to the coefficients transformable to linear predictive coefficients obtained by the linear predictive analysis part using the coefficients transformable to linear predictive coefficients obtained by the linear predictive analysis part and the plurality of candidates for coefficients transformable to linear predictive coefficients after the first linear transformation obtained by the adaptation part.

3. The linear predictive coding apparatus according to claim 2, wherein the linear transformation part performs the first linear transformation so that a sequence of an amplitude spectral envelope corresponding to the candidates for coefficients transformable to linear predictive coefficients after the first linear transformation is flatter as the $\eta_1$ is smaller.

4. The linear predictive coding apparatus according to claim 1, wherein the adaptation part comprises a linear transformation part performing second linear transformation according to the $\eta_1$ for the coefficients transformable to linear predictive coefficients obtained by the linear predictive analysis part to obtain coefficients transformable to linear predictive coefficients after the second linear transformation; and the coding part obtains the linear predictive coefficient code corresponding to the coefficients transformable to linear predictive coefficients obtained by the linear predictive analysis part using the coefficients transformable to linear predictive coefficients after the second linear transformation obtained by the adaptation part and the plurality of candidates for coefficients transformable to linear predictive coefficients stored in the code book.

5. The linear predictive coding apparatus according to claim 1, wherein $\eta_2$ and $\eta_3$ are predetermined values of the parameter $\eta$;

a code book corresponding to the $\eta_2$ is stored in the code book storing part;

the adaptation part is a linear transformation part performing first linear transformation according to the $\eta_3$ for the plurality of candidates for coefficients transformable to linear predictive coefficients stored in the code book storing part to obtain a plurality of candidates for coefficients transformable to linear predictive coefficients after the first linear transformation, and performing second linear transformation according to the $\eta_3$ for the coefficients transformable to linear predictive coefficients obtained by the linear predictive analysis part to obtain coefficients transformable to linear predictive coefficients after the second linear transformation; and the coding part obtains the linear predictive coefficient code corresponding to the coefficients transformable to linear predictive coefficients obtained by the linear predictive analysis part using the coefficients transformable to linear predictive coefficients after the second linear transformation obtained by the adaptation part and the plurality of candidates for coefficients transformable to linear predictive coefficients after the first linear transformation obtained by the adaptation part.

6. The linear predictive coding apparatus according to claim 1, wherein $\eta_2$ is a predetermined value of the parameter $\eta$;

a plurality of code books are stored in the code book storing part;

the adaptation part is a code book selecting part selecting a code book from among the plurality of code books stored in the code book storing part according to the $\eta_2$ and a linear transformation part performing second linear transformation according to the $\eta_2$ for the coefficients transformable to linear predictive coefficients obtained by the linear predictive analysis part; and for coefficients transformable to linear predictive coefficients after the second linear transformation, the coding part performs coding using the selected code book to obtain a linear predictive coefficient code.

7. The linear predictive coding apparatus according to claim 1, wherein $\eta_2$ is a predetermined value of the parameter $\eta$;

a plurality of code books are stored in the code book storing part;

the adaptation part is a code book selecting part selecting a code book from among the plurality of code books stored in the code book storing part according to the $\eta_2$ and a linear transformation part performing first linear transformation according to the $\eta_1$ for a plurality of candidates for coefficients transformable to linear predictive coefficients stored in the selected code book; and for the coefficients transformable to linear predictive coefficients obtained by the linear predictive analysis part, the coding part performs coding using candidates for coefficients transformable to linear predictive coefficients after the first linear transformation to obtain the linear predictive coefficient code.

8. The linear predictive coding apparatus according to claim 1, wherein $\eta_2$ and $\eta_3$ are predetermined values of the parameter $\eta$;

a plurality of code books are stored in the code book storing part;

the adaptation part is a code book selecting part selecting a code book from among the plurality of code books stored in the code book storing part according to the $\eta_3$ and a linear transformation part performing first linear transformation according to the $\eta_2$ for a plurality of candidates for coefficients transformable to linear predictive coefficients stored in the selected code book and performing second linear transformation according to the $\eta_2$ for the coefficients transformable to linear predictive coefficients obtained by the linear predictive analysis part; and for coefficients transformable to linear predictive coefficients after the second linear transformation, the coding part performs coding using candidates for coefficients transformable to linear predictive coefficients after the first linear transformation to obtain a linear predictive coefficient code.

9. A linear predictive decoding apparatus for decoding a sound signal comprising:

a code book storing part storing a code book; and an adaptation part adapting at least either of the code book stored in the code book storing part and a candidate for coefficients transformable to linear predictive coefficients corresponding to an inputted linear predictive coefficient code among a plurality of candidates for coefficients transformable to linear predictive coefficients stored in the code book, on the basis of inputted $\eta_1$, the $\eta_1$ being a positive number; wherein the coefficients transformable to linear predictive coefficients are used to obtain an unsmoothed spectral envelope sequence, which is a sequence obtained by raising a sequence of an amplitude spectral envelope corresponding to the coefficients transformable to linear predictive coefficients to the power of $1/\eta_1$.

10. The linear predictive coding apparatus according to any of claims 2 to 3, wherein p is an order of coefficients transformable to linear predictive coefficients; the coefficients transformable to linear predictive coefficients or the candidates for coefficients transformable to linear predictive coefficients are indicated by $\hat{\omega}[k][k=1, 2, \ldots, p]$; the coefficients transformable to linear predictive coefficients or the candidates for coefficients transformable to linear predictive coefficients after the first linear transformation and the second linear transformation are indicated by $\tilde{\omega}[k][k=1, 2, \ldots, p]$; $x_1, x_2, \ldots x_p, y_1, y_2, \ldots y_{p-1}, z_2, z_3, \ldots z_p$ are predetermined non-negative numbers; at least one of $y_1, y_2, \ldots z_2, z_3, \ldots z_p$ is a predetermined positive number; and K is a matrix in which elements other than $x_1, x_2, \ldots x_p, y_1, y_2, \ldots y_{p-1}$, and $z_2, z_3, \ldots z_p$ are 0; and the linear transformation part performs at least one of the first linear transformation and the second linear transformation by the following expression:

[Expression 17]

$$\begin{pmatrix} \tilde{\omega}[1] \\ \tilde{\omega}[2] \\ \vdots \\ \tilde{\omega}[p] \end{pmatrix} = K \begin{pmatrix} \hat{\omega}[1] - \frac{\pi}{p+1} \\ \hat{\omega}[2] - \frac{2\pi}{p+1} \\ \vdots \\ \hat{\omega}[p] - \frac{p\pi}{p+1} \end{pmatrix} + \begin{pmatrix} \hat{\omega}[1] \\ \hat{\omega}[2] \\ \vdots \\ \hat{\omega}[p] \end{pmatrix}$$

$$K = \begin{pmatrix} x_1 & y_1 & & & & 0 \\ z_2 & x_2 & y_2 & & & \\ & z_3 & x_3 & y_3 & & \\ & & \ddots & \ddots & \ddots & \\ & & & \ddots & \ddots & \\ 0 & & & & z_p & x_p \end{pmatrix}.$$

11. The linear predictive coding apparatus according to claim 2 or 7, wherein the linear transformation part performs the first linear transformation so that the order of the candidates for coefficients transformable to linear predictive coefficients after the first linear transformation is smaller as the $\hat{\beta}_1$ is smaller.

12. The linear predictive coding apparatus according to any of claims 1, 2, 4 and 5, wherein a plurality of code books are stored in the code book storing part;

the adaptation part comprises a code book selecting part selecting a code book from among the plurality code books stored in the code book storing part according to the $\eta_1$; and the coding part obtains the linear predictive coefficient code corresponding to the coefficients transformable to linear predictive coefficients obtained by the linear predictive analysis part using the coefficients transformable to linear predictive coefficients obtained by the linear predictive analysis part and the plurality of candidates for coefficients transformable to linear predictive coefficients obtained by the adaptation part.

13. The linear predictive coding apparatus according to claim 12, wherein a plurality of code books that are different in the number of candidates for coefficients transformable to linear predictive coefficients are stored in the code book storing part; and the code book selecting part selects a code book with a larger number of candidates for coefficients transformable to linear predictive coefficients from among the plurality of code books stored in the code book storing part as the $\eta_{11}$ is larger.

14. The linear predictive coding apparatus according to claim 12, wherein a plurality of code books that are different in the degree of flatness of an unsmoothed spectral envelope sequence, which is a sequence obtained by raising a sequence of an amplitude spectral envelope corresponding to candidates for coefficients transformable to linear predictive coefficients in each code book to the power of $1/\eta_1$, are stored in the code book storing part; and from among the plurality of code books stored in the code book storing part, the code book selecting part selects such a code book that the unsmoothed spectral envelope sequence, which is the sequence obtained by raising the sequence of the amplitude spectral envelope corresponding to the candidates for coefficients transformable to linear predictive coefficients stored in the code books to the power of $1/\eta_1$, is flatter as the $\eta_1$ is smaller.

15. The linear predictive coding apparatus according to claim 12, wherein a plurality of code books that are different in the interval between candidates for coefficients transformable to linear predictive coefficients are stored in the code book storing part; and the code book selecting part selects a code book with a narrower interval between candidates for coefficients transformable to linear predictive coefficients, from among the plurality of code books stored in the code book storing part as the $\eta_1$ is smaller.

16. A linear predictive coding apparatus for encoding a sound signal, comprising:

a linear predictive analysis part performing linear predictive analysis using a pseudo correlation function signal sequence obtained by performing inverse Fourier transform regarding $\eta_1$-th power of the absolute values of the frequency domain sample sequence corresponding to a time-series signal as a power spectrum to obtain coefficients transformable to linear predictive coefficients, the $\eta_1$ being a positive number, the time-series signal being the sound signal;

a code book storing part storing a code book;

an adaptation part adapting at least either of the code book stored in the code book storing part and the coefficients transformable to linear predictive coefficients on the basis of the $\eta_1$ inputted; and a coding part coding the coefficients transformable to linear predictive coefficients or the adapted coefficients transformable to linear predictive coefficients using the code book or the adapted code book.

17. A computer-readable recording medium in which a program for causing a computer to function as each part of the linear predictive coding apparatus according to claim 1 or the linear predictive decoding apparatus according to claim 9 is recorded.

18. The linear predictive decoding apparatus according to claim 9, further comprising a decoding part obtaining candidates for coefficients transformable to linear predictive coefficients corresponding to the inputted linear predictive coefficient code, among the plurality of candidates for coefficients transformable to linear predictive coefficients stored in the code book, as coefficients transformable to linear predictive coefficients; wherein the adaptation part is a linear transformation part performing linear transformation according to the $\eta_1$, which is a predetermined positive number, for the coefficients transformable to linear predictive coefficients obtained by the decoding part to obtain coefficients transformable to linear predictive coefficients.

19. The linear predictive decoding apparatus according to claim 9, wherein a plurality of code books are stored in the code book storing part;

the adaptation part is a code book selecting part selecting a code book from among the plurality of code books stored in the code book storing part according to $\eta_2$, the $\eta_2$ being a positive number, and a linear transformation part performing linear transformation according to the $\eta_1$, which is a predetermined positive number, for the coefficients transformable to linear predictive coefficients obtained by the decoding part, to obtain coefficients transformable to linear predictive coefficients; and the linear predictive decoding apparatus further comprises the decoding part obtaining candidates for coefficients transformable to linear predictive coefficients corresponding to an inputted linear predictive coefficient code, among the plurality of candidates for coefficients transformable to linear predictive coefficients stored in the selected code book, as coefficients transformable to linear predictive coefficients.

20. The linear predictive decoding apparatus according to claim 18, wherein the linear transformation part performs the linear transformation so that a sequence of an amplitude spectral envelope corresponding to the coefficients transformable to linear predictive coefficients after the linear transformation is flatter as the $\eta_1$ is smaller.

21. The linear predictive decoding apparatus according to claim 9, wherein a plurality of code books are stored in the code book storing part; and the adaptation part is a code book selecting part selecting a code book from among the plurality of code books stored in the code book storing part according to the $\eta_1$, and further comprises a decoding part decoding the inputted linear predictive coefficient code to obtain coefficients transformable to linear predictive coefficients using the selected code book.

22. The linear predictive decoding apparatus according to claim 21, wherein a plurality of code books that are different in the number of candidates for coefficients transformable to linear predictive coefficients are stored in the code book storing part, and the code book selecting part selects a code book with a larger number of candidates for coefficients transformable to linear predictive coefficients from among the plurality of code books stored in the code book storing part as the $\eta_1$ is larger.

23. The linear predictive decoding apparatus according to any of claims 18 to 20, wherein p is an order of coefficients transformable to linear predictive coefficients; the coefficients transformable to linear predictive coefficients obtained by the decoding part are indicated by $\hat{\omega}[k][k=1, 2, \ldots, p]$; coefficients transformable to linear predictive coefficients after the linear transformation are indicated by $\tilde{\omega}[k][k=1, 2, \ldots, p]$; $x_1, x_2, \ldots x_p, y_1, y_2, \ldots y_{p-1}, z_2, z_3, \ldots z_p$ are predetermined non-negative numbers; at least one of $y_1, y_2, \ldots y_{p-1}, z_2, z_3, \ldots z_p$ is a predetermined positive number; and K is a matrix in which elements other than $x_1, x_2, \ldots, x_p, y_1, y_2, \ldots y_{p-1}, z_2, z_3, \ldots z_p$ are 0; and the linear transformation part performs the linear transformation by the following expression:

[Expression 18]

$$\begin{pmatrix} \tilde{\omega}[1] \\ \tilde{\omega}[2] \\ \vdots \\ \tilde{\omega}[p] \end{pmatrix} = K \begin{pmatrix} \hat{\omega}[1] - \frac{\pi}{p+1} \\ \hat{\omega}[2] - \frac{2\pi}{p+1} \\ \vdots \\ \hat{\omega}[p] - \frac{p\pi}{p+1} \end{pmatrix} + \begin{pmatrix} \hat{\omega}[1] \\ \hat{\omega}[2] \\ \vdots \\ \hat{\omega}[p] \end{pmatrix}$$

$$K = \begin{pmatrix} x_1 & y_1 & & & 0 \\ z_2 & x_2 & y_2 & & \\ & z_3 & x_3 & y_3 & \\ & & \ddots & \ddots & \ddots \\ & & & \ddots & \ddots \\ 0 & & & z_p & x_p \end{pmatrix}.$$

24. The linear predictive decoding apparatus according to claim 18 or 19, wherein the linear transformation part performs the linear transformation so that the order of coefficients transformable to linear predictive coefficients after the linear transformation is smaller as the $\eta_1$ is smaller.

25. The linear predictive decoding apparatus according to claim 21 or 22, wherein a plurality of code books that are different in the degree of flatness of an unsmoothed spectral envelope sequence, which is a sequence obtained by raising a sequence of an amplitude spectral envelope corresponding to candidates for coefficients transformable to linear predictive coefficients stored in each code book to the power of are stored in the code book storing part; and from among the plurality of code books stored in the code book storing part, the code book selecting part selects such a code book that the unsmoothed spectral envelope sequence, which is the sequence obtained by raising the sequence of the amplitude spectral envelope corresponding to the candidates for coefficients transformable to linear predictive coefficients stored in the code books to the power of $1/\eta_1$, is flatter as the $\eta_1$ is smaller.

26. The linear predictive decoding apparatus according to claim 21 or 22, wherein a plurality of code books that are different in the interval between candidates for coefficients transformable to linear predictive coefficients are stored in the code book storing part; and the code book selecting part selects a code book with a narrower interval between candidates for coefficients transformable to linear predictive coefficients, from among the plurality of code books stored in the code book storing part as the $\eta_1$ is smaller.

27. A linear predictive coding method for encoding a sound signal, comprising:

a linear predictive analysis step in which a linear predictive analysis part performs linear predictive analysis using a pseudo correlation function signal sequence obtained by performing inverse Fourier transform regarding power of the absolute values of the frequency domain sample sequence corresponding to a time-series signal as a power spectrum to obtain coefficients transformable to linear predictive coefficients, the $\eta_1$ being a positive number, the time-series signal being the sound signal;

an adaptation step in which an adaptation part adapts values of $\eta$ for a plurality of candidates for coefficients transformable to linear predictive coefficients stored in a code book stored in a code book storing part storing N (N is an integer equal to or larger than 1) code books corresponding to N kinds of parameters $\eta$, respectively, each code book storing a plurality of candidates for coefficients transformable to linear predictive coefficients corresponding to each parameter $\eta$, and the coefficients transformable to linear predictive coefficients obtained in the linear predictive analysis step; and a coding step in which a coding part obtains a linear predictive coefficient code corresponding to the coefficients transformable to linear predictive coefficients obtained by the linear predictive analysis part, using the plurality of candidates for coefficients transformable to linear predictive coefficients and the coefficients transformable to linear predictive coefficients for which the values of the $\eta$ have been adapted.

28. A linear predictive coding method for encoding a sound signal, comprising:

a linear predictive analysis step of performing linear predictive analysis using a pseudo correlation function signal sequence obtained by performing inverse Fourier transform regarding $\eta_1$-th power of the absolute values of the frequency domain sample sequence corresponding to a time-series signal as a power spectrum to obtain coefficients transformable to linear predictive coefficients, the $\eta_1$ being a positive number, the time-series signal being the sound signal;

an adaptation step of adapting at least either of a code book stored in a code book storing part and the coefficients transformable to linear predictive coefficients on the basis of the $\eta_1$ inputted; and a coding step of coding the coefficients transformable to linear predictive coefficients or the adapted coefficients transformable to linear predictive coefficients using the code book or the adapted code book.

29. A linear predictive decoding method for decoding a sound signal comprising an adaptation step of adapting at least either of a code book stored in a code book storing part and a candidate for coefficients transformable to linear predictive coefficients corresponding to an inputted linear predictive coefficient code among a plurality of candidates for coefficients transformable to linear predictive coefficients stored in the code book, on the basis of inputted $\eta_1$, the $\eta_1$ being a positive number; wherein the coefficients transformable to linear predictive coefficients are used to obtain an unsmoothed spectral envelope sequence, which is a sequence obtained by raising a sequence of an amplitude spectral envelope corresponding to the coefficients transformable to linear predictive coefficients to the power of $1/\eta_1$.

* * * * *